US011089837B2

(12) United States Patent
Pollack et al.

(10) Patent No.: US 11,089,837 B2
(45) Date of Patent: Aug. 17, 2021

(54) TENSION MEMBER GUIDES FOR LACING SYSTEMS

(71) Applicant: Boa Technology Inc., Denver, CO (US)

(72) Inventors: Thomas Pollack, Golden, CO (US); Kristopher Lovett, Denver, CO (US); Thomas Trudel, Conifer, CO (US); Cody Henderson, Denver, CO (US); Clark Morgan, Denver, CO (US); Mark Soderberg, Conifer, CO (US); Anna Hetman, Denver, CO (US)

(73) Assignee: Boa Technology Inc., Denver, CO (US)

( * ) Notice: Subject to any disclaimer, the term of this patent is extended or adjusted under 35 U.S.C. 154(b) by 0 days.

(21) Appl. No.: 16/676,368

(22) Filed: Nov. 6, 2019

(65) Prior Publication Data

US 2020/0068997 A1 Mar. 5, 2020

Related U.S. Application Data

(63) Continuation of application No. 15/667,486, filed on Aug. 2, 2017, now Pat. No. 10,499,709.
(Continued)

(51) Int. Cl.
*A43C 7/02* (2006.01)
*A43C 1/04* (2006.01)
(Continued)

(52) U.S. Cl.
CPC ..... *A43C 7/02* (2013.01); *A43C 1/04* (2013.01); *A43C 5/00* (2013.01); *A43C 11/004* (2013.01); *A43C 11/165* (2013.01); *A43C 1/00* (2013.01)

(58) Field of Classification Search
CPC ..... A43C 11/004; A43C 11/165; A43C 1/00; A43C 1/04; A43C 5/00; A43C 7/02
See application file for complete search history.

(56) References Cited

U.S. PATENT DOCUMENTS 55,923 A 6/1866 Sprague
59,332 A 10/1866 White et al.
(Continued)

FOREIGN PATENT DOCUMENTS

CA 2112789 8/1994
CA 2114387 8/1994
(Continued)

OTHER PUBLICATIONS

U.S. Appl. No. 09/956,601 Including its prosecution history, filed Sep. 18, 2001, Hammerslag.
(Continued)

*Primary Examiner* — Robert Sandy
*Assistant Examiner* — David M Upchurch
(74) *Attorney, Agent, or Firm* — Kilpatrick Townsend & Stockton, LLP

(57) ABSTRACT

A tension member guide that is configured to direct or route a tension member about a path of an article includes a cover member and a guide member that is partially covered by the cover member. The cover member is attachable to the article and includes a pair of slits or incisions. The guide member is folded along a longitudinal length to form a loop or channel within which the tension member may be inserted. The guide member is positioned in relation to the cover member so that opposing end portions of the loop or channel are inserted through the slits or incisions such that the opposing end portions are positioned on an opposite side of the cover member from a remainder of the guide member.

16 Claims, 54 Drawing Sheets

Related U.S. Application Data

(60) Provisional application No. 62/370,032, filed on Aug. 2, 2016.

(51) Int. Cl.

| | |
|---|---|
| ***A43C 11/00*** | (2006.01) |
| ***A43C 11/16*** | (2006.01) |
| ***A43C 5/00*** | (2006.01) |
| *A43C 1/00* | (2006.01) |

(56) References Cited

U.S. PATENT DOCUMENTS

| | | | |
|---|---|---|---|
| 80,834 | A | 8/1868 | Prussia |
| 117,530 | A | 8/1871 | Foote |
| 228,946 | A | 6/1880 | Schulz |
| 230,759 | A | 8/1880 | Drummond |
| 301,854 | A | 7/1884 | Buch |
| 371,394 | A | 10/1887 | Warren |
| 379,113 | A | 3/1888 | Hibberd |
| 460,743 | A | 10/1891 | Dickson, Jr. |
| 568,056 | A | 9/1896 | Vail, Jr. |
| 746,563 | A | 12/1903 | McMahon |
| 819,993 | A | 5/1906 | Haws et al. |
| 886,779 | A | 5/1908 | Dunstan |
| 908,704 | A | 1/1909 | Sprinkle |
| 1,060,422 | A | 4/1913 | Bowdish |
| 1,062,511 | A | 5/1913 | Short |
| 1,083,775 | A | 1/1914 | Thomas |
| 1,090,438 | A | 3/1914 | Worth et al. |
| 1,170,472 | A | 2/1916 | Barber |
| 1,288,859 | A | 12/1918 | Feller et al. |
| 1,390,991 | A | 9/1921 | Fotchuk |
| 1,393,188 | A | 10/1921 | Whiteman |
| 1,469,661 | A | 2/1922 | Migita |
| 1,412,486 | A | 4/1922 | Paine |
| 1,416,203 | A | 5/1922 | Hobson |
| 1,429,657 | A | 9/1922 | Trawinski |
| 1,481,903 | A | 4/1923 | Hart |
| 1,466,673 | A | 9/1923 | Solomon et al. |
| 1,530,713 | A | 2/1924 | Clark |
| 1,502,919 | A | 7/1924 | Seib |
| 1,505,430 | A | 8/1924 | Roberts |
| 1,538,454 | A | 5/1925 | Trawinski |
| 1,548,407 | A | 8/1925 | Chisholm |
| 1,862,047 | A | 6/1932 | Boulet et al. |
| 1,995,243 | A | 6/1934 | Clarke |
| 2,088,851 | A | 8/1937 | Gantenbein |
| 2,109,751 | A | 3/1938 | Matthias et al. |
| 2,124,310 | A | 9/1938 | Murr, Jr. |
| 2,316,102 | A | 4/1943 | Preston |
| 2,500,622 | A | 3/1950 | Aho |
| 2,539,026 | A | 1/1951 | Mangold |
| 2,611,940 | A | 9/1952 | Cairns |
| 2,636,237 | A | 4/1953 | Price |
| 2,673,381 | A | 3/1954 | Dueker |
| 2,743,761 | A | 5/1956 | Snyder et al. |
| 2,745,160 | A | 5/1956 | Jones |
| 2,893,090 | A | 7/1959 | Pagoda |
| 2,907,086 | A | 10/1959 | Ord |
| 2,926,406 | A | 3/1960 | Zahnor et al. |
| 2,991,523 | A | 7/1961 | Del Conte |
| 3,028,602 | A | 4/1962 | Miller |
| 3,035,319 | A | 5/1962 | Wolff |
| D193,807 | S | 10/1962 | Stanley |
| 3,106,003 | A | 10/1963 | Herdman |
| 3,112,545 | A | 12/1963 | Williams |
| 3,122,810 | A | 3/1964 | Lawrence et al. |
| 3,163,900 | A | 1/1965 | Martin |
| D200,394 | S | 2/1965 | Hakim |
| 3,169,325 | A | 2/1965 | Fesl |
| 3,193,950 | A | 7/1965 | Liou |
| 3,197,155 | A | 7/1965 | Chow |
| 3,214,809 | A | 11/1965 | Zahnor |
| 3,221,384 | A | 12/1965 | Aufenacker |
| 3,276,090 | A | 10/1966 | Nigon |
| D206,146 | S | 11/1966 | Hendershot |
| 3,345,707 | A | 10/1967 | Rita |
| D210,649 | S | 4/1968 | Getgay |
| 3,401,437 | A | 9/1968 | Christpohersen |
| 3,430,303 | A | 3/1969 | Perrin et al. |
| 3,491,465 | A | 1/1970 | Martin |
| 3,545,106 | A | 12/1970 | Martin |
| 3,618,232 | A | 11/1971 | Shnuriwsky |
| 3,620,402 | A | 11/1971 | Wentland |
| 3,668,791 | A | 6/1972 | Salzman et al. |
| 3,678,539 | A | 7/1972 | Group |
| 3,703,775 | A | 11/1972 | Gatti |
| 3,729,779 | A | 5/1973 | Porth |
| 3,738,027 | A | 6/1973 | Schoch |
| 3,751,176 | A | 8/1973 | Von Hollen |
| 3,793,749 | A | 2/1974 | Gertsch et al. |
| 3,808,644 | A | 5/1974 | Schoch |
| 3,816,211 | A | 6/1974 | Haigh |
| 3,845,575 | A | 11/1974 | Boden |
| 3,890,679 | A | 6/1975 | Simon |
| 3,934,346 | A | 1/1976 | Sasaki et al. |
| 3,975,838 | A | 8/1976 | Martin |
| 4,012,277 | A | 3/1977 | Lundskow et al. |
| 4,084,267 | A | 4/1978 | Zadina |
| 4,095,354 | A | 6/1978 | Annovi |
| 4,130,949 | A | 12/1978 | Seidel |
| 4,142,307 | A | 3/1979 | Martin |
| 4,227,322 | A | 10/1980 | Annovi |
| 4,261,081 | A | 4/1981 | Lott |
| 4,267,622 | A | 5/1981 | Burnett-Johnston |
| 4,327,470 | A | 5/1982 | Lawrence |
| RE31,052 | E | 10/1982 | Adams |
| 4,394,803 | A | 7/1983 | Goldstein |
| 4,408,403 | A | 10/1983 | Martin |
| 4,417,703 | A | 11/1983 | Weinhold |
| 4,433,456 | A | 2/1984 | Baggio |
| 4,433,679 | A | 2/1984 | Maudlin et al. |
| 4,452,405 | A | 6/1984 | Adomeit |
| 4,463,761 | A | 8/1984 | Pols et al. |
| 4,480,395 | A | 11/1984 | Schoch |
| 4,507,878 | A | 4/1985 | Semouha |
| 4,516,576 | A | 5/1985 | Kirchner |
| 4,539,735 | A | 9/1985 | Kasai |
| 4,551,932 | A | 11/1985 | Schoch |
| 4,553,342 | A | 11/1985 | Derderian et al. |
| 4,555,830 | A | 12/1985 | Petrini et al. |
| 4,574,500 | A | 3/1986 | Aldinio et al. |
| 4,616,432 | A | 10/1986 | Bunch et al. |
| 4,616,524 | A | 10/1986 | Biodia |
| 4,619,057 | A | 10/1986 | Sartor et al. |
| 4,620,378 | A | 11/1986 | Sartor |
| 4,631,839 | A | 12/1986 | Bonetti et al. |
| 4,631,840 | A | 12/1986 | Gamm |
| 4,633,599 | A | 1/1987 | Morell et al. |
| 4,644,938 | A | 2/1987 | Yates et al. |
| 4,654,985 | A | 4/1987 | Chalmers |
| 4,660,300 | A | 4/1987 | Morell et al. |
| 4,660,302 | A | 4/1987 | Arieh et al. |
| 4,680,878 | A | 7/1987 | Pozzobon et al. |
| 4,719,670 | A | 1/1988 | Kurt |
| 4,719,709 | A | 1/1988 | Vaccari |
| 4,719,710 | A | 1/1988 | Pozzobon |
| 4,722,477 | A | 2/1988 | Floyd |
| 4,741,115 | A | 5/1988 | Pozzobon |
| 4,748,726 | A | 6/1988 | Schoch |
| 4,760,653 | A | 8/1988 | Baggio |
| 4,780,969 | A | 11/1988 | White, Jr. |
| 4,787,124 | A | 11/1988 | Pozzobon et al. |
| 4,790,081 | A | 12/1988 | Benoit et al. |
| 4,796,829 | A | 1/1989 | Pozzobon et al. |
| 4,799,297 | A | 1/1989 | Baggio et al. |
| 4,802,291 | A | 2/1989 | Sartor |
| 4,811,503 | A | 3/1989 | Iwama |
| 4,826,098 | A | 5/1989 | Pozzobon et al. |
| 4,841,649 | A | 6/1989 | Baggio et al. |
| 4,856,207 | A | 8/1989 | Datson |
| 4,862,878 | A | 9/1989 | Davison |
| 4,870,723 | A | 10/1989 | Pozzobon et al. |

(56) References Cited

U.S. PATENT DOCUMENTS 4,870,761 A 10/1989 Tracy
4,884,760 A 12/1989 Baggio et al.
4,901,938 A 2/1990 Cantley et al.
4,924,605 A 5/1990 Spademan
D308,282 S 6/1990 Bergman et al.
4,937,953 A 7/1990 Walkhoff
4,961,544 A 10/1990 Biodia
4,962,875 A 10/1990 Sodeno
4,974,299 A 12/1990 Moon
4,979,953 A 12/1990 Spence
4,989,805 A 2/1991 Burke
5,001,817 A 3/1991 De Bortoli et al.
5,016,327 A 5/1991 Klausner
5,042,177 A 8/1991 Schoch
5,062,225 A 11/1991 Gorza
5,065,480 A 11/1991 DeBortoli
5,065,481 A 11/1991 Walkhoff
5,079,809 A 1/1992 Teich et al.
5,108,216 A 4/1992 Geyer et al.
5,117,567 A 6/1992 Berger
5,129,130 A 7/1992 Lecouturier
5,152,038 A 10/1992 Schoch
5,157,813 A 10/1992 Carroll
5,158,428 A 10/1992 Gessner et al.
5,167,612 A 12/1992 Bonutti
5,177,882 A 1/1993 Berger
5,178,137 A 1/1993 Goor et al.
5,181,331 A 1/1993 Berger
5,184,378 A * 2/1993 Batra ..... A43C 1/04 24/714.6
D333,552 S 3/1993 Berger et al.
5,205,055 A 4/1993 Harrell
5,213,094 A 5/1993 Bonutti
5,233,767 A 8/1993 Kramer
5,249,377 A 10/1993 Walkhoff
5,259,094 A 11/1993 Zepeda
5,261,997 A 11/1993 Inselmann
5,315,741 A 5/1994 Debberke
5,319,868 A 6/1994 Hallenbeck
5,319,869 A 6/1994 McDonald et al.
5,325,613 A 7/1994 Sussmann
5,326,632 A 7/1994 Zenda et al.
5,327,662 A 7/1994 Hallenbeck
5,333,398 A 8/1994 Seo
5,335,401 A 8/1994 Hanson
5,341,583 A 8/1994 Hallenbeck
5,345,697 A 9/1994 Quellais
5,346,461 A 9/1994 Heinz et al.
5,355,596 A 10/1994 Sussmann
5,357,654 A 10/1994 Hsing-Chi
5,365,947 A 11/1994 Bonutti
5,371,957 A 12/1994 Gaudio
5,377,430 A * 1/1995 Hatfield ..... A43B 3/08 24/714.6
5,381,609 A 1/1995 Hieblinger
5,392,535 A 2/1995 Van Noy et al.
5,395,304 A 3/1995 Tarr et al.
D357,576 S 4/1995 Steinweis
5,425,161 A 6/1995 Schoch
5,425,185 A 6/1995 Gansler
5,430,960 A 7/1995 Richardson
5,433,648 A 7/1995 Frydman
5,437,617 A 8/1995 Heinz et al.
5,454,140 A 10/1995 Murai
5,456,268 A 10/1995 Bonutti
5,463,822 A 11/1995 Miller
5,477,593 A 12/1995 Leick
D367,755 S 3/1996 Jones
D367,954 S 3/1996 Dion
5,502,902 A 4/1996 Sussmann
5,511,325 A 4/1996 Hieblinger
5,526,585 A 6/1996 Brown et al.
5,535,531 A 7/1996 Karabed et al.
5,537,763 A 7/1996 Donnadieu et al.
5,557,864 A 9/1996 Marks
5,566,474 A 10/1996 Leick et al.
D375,831 S 11/1996 Perry
5,596,820 A 1/1997 Edauw et al.
5,599,000 A 2/1997 Bennett
5,599,288 A 2/1997 Shirley et al.
5,600,874 A 2/1997 Jungkind
5,606,778 A 3/1997 Jungkind
5,607,448 A 3/1997 Stahl et al.
D379,113 S 5/1997 McDonald et al.
D379,626 S 6/1997 Mak
5,638,588 A 6/1997 Jungkind
5,640,785 A 6/1997 Egelja
5,647,104 A 7/1997 James
5,651,198 A 7/1997 Sussmann
5,669,116 A 9/1997 Jungkind
5,685,830 A 11/1997 Bonutti
5,692,319 A * 12/1997 Parker ..... A43B 7/1495 36/114
5,718,021 A 2/1998 Tatum
5,718,065 A 2/1998 Locker
5,720,084 A 2/1998 Chen
5,732,483 A 3/1998 Cagliari
5,732,648 A 3/1998 Aragon
5,736,696 A 4/1998 Del Rosso
5,737,854 A 4/1998 Sussmann
5,755,044 A 5/1998 Veylupek
5,756,298 A 5/1998 Burczak
5,761,777 A 6/1998 Leick
5,772,146 A 6/1998 Kawamoto et al.
5,784,809 A 7/1998 McDonald
5,791,068 A 8/1998 Bernier et al.
5,819,378 A 10/1998 Doyle
5,833,640 A 11/1998 Vazquez, Jr. et al.
5,839,210 A 11/1998 Bernier et al.
5,845,371 A 12/1998 Chen
5,891,061 A 4/1999 Kaiser
5,906,057 A 5/1999 Borsoi
5,909,946 A 6/1999 Okajima
D413,197 S 8/1999 Faye
5,934,599 A 8/1999 Hammerslag
5,937,542 A 8/1999 Bourdeau
5,956,823 A 9/1999 Borel
5,971,946 A 10/1999 Quinn et al.
6,015,110 A 1/2000 Lai
6,032,387 A 3/2000 Johnson
6,038,791 A 3/2000 Cornelius et al.
6,052,921 A 4/2000 Oreck
6,070,886 A 6/2000 Cornelius et al.
6,070,887 A 6/2000 Cornelius et al.
6,083,857 A 7/2000 Bottger
6,088,936 A 7/2000 Bahl
6,102,412 A 8/2000 Staffaroni
D430,724 S * 9/2000 Matis ..... D2/969
6,119,318 A 9/2000 Maurer
6,119,372 A 9/2000 Okajima
6,128,835 A 10/2000 Ritter et al.
6,128,836 A 10/2000 Barret
6,148,489 A 11/2000 Dickie et al.
D438,452 S 3/2001 Tsai
6,202,953 B1 3/2001 Hammerslag
6,219,891 B1 4/2001 Maurer et al.
6,240,657 B1 6/2001 Weber et al.
6,256,798 B1 7/2001 Egolf et al.
6,267,390 B1 7/2001 Maravetz et al.
6,286,233 B1 9/2001 Gaither
6,289,558 B1 9/2001 Hammerslag
6,311,633 B1 11/2001 Keire
D456,130 S 4/2002 Towns
6,370,743 B2 4/2002 Choe
6,401,364 B1 6/2002 Burt
6,416,074 B1 7/2002 Maravetz et al.
6,464,657 B1 10/2002 Castillo
6,467,195 B2 10/2002 Pierre et al.
6,477,793 B1 11/2002 Pruitt et al.
6,502,286 B1 1/2003 Dubberke
6,543,159 B1 4/2003 Carpenter et al.
6,568,103 B2 5/2003 Durocher
D477,364 S 7/2003 Tsai
6,606,804 B2 8/2003 Kaneko et al.

(56) References Cited

U.S. PATENT DOCUMENTS 6,685,662 B1 2/2004 Curry et al.
6,689,080 B2 2/2004 Castillo
6,694,643 B1 2/2004 Hsu
6,708,376 B1 3/2004 Landry
6,711,787 B2 3/2004 Jungkind et al.
6,735,829 B2 5/2004 Hsu
6,757,991 B2 7/2004 Sussmann
6,775,928 B2 8/2004 Grande et al.
6,792,702 B2 9/2004 Borsoi et al.
6,793,641 B2 9/2004 Freeman et al.
6,796,951 B2 9/2004 Freeman et al.
D497,183 S 10/2004 Chiu
6,802,439 B2 10/2004 Azam et al.
6,823,610 B1 11/2004 Ashley
6,871,812 B1 3/2005 Chang
6,877,256 B2 4/2005 Martin et al.
6,880,271 B2 4/2005 Caeran
6,899,720 B1 5/2005 McMillan
6,922,917 B2 8/2005 Kerns et al.
6,938,913 B2 9/2005 Elkington
6,942,632 B2 9/2005 Cho
6,945,543 B2 9/2005 De Bertoli et al.
D510,183 S 10/2005 Tresser
6,962,571 B2 11/2005 Castillo
6,976,972 B2 12/2005 Bradshaw
6,993,859 B2 2/2006 Martin et al.
D521,226 S 5/2006 Douglas et al.
7,073,279 B2 7/2006 Min
7,076,843 B2 7/2006 Sakabayashi
7,082,701 B2 8/2006 Dalgaard et al.
7,096,559 B2 8/2006 Johnson et al.
7,134,224 B2 11/2006 Elkington et al.
7,182,740 B1 2/2007 Castillo
7,198,610 B2 4/2007 Ingimundarson et al.
7,266,911 B2 9/2007 Holzer et al.
D553,346 S * 10/2007 Dekovic ..... D2/972
D553,842 S * 10/2007 Paz ..... D2/972
7,281,341 B2 10/2007 Reagan et al.
7,293,373 B2 11/2007 Reagan et al.
7,314,458 B2 1/2008 Bodenschatz
7,331,126 B2 2/2008 Johnson
7,343,701 B2 3/2008 Pare et al.
7,360,282 B2 4/2008 Borsoi
7,367,522 B2 5/2008 Chen
7,386,947 B2 6/2008 Martin et al.
7,392,602 B2 7/2008 Reagan et al.
7,401,423 B2 7/2008 Reagan et al.
7,402,147 B1 7/2008 Allen
D587,105 S 2/2009 Chang
7,490,458 B2 2/2009 Ford
7,516,914 B2 4/2009 Kovacevich et al.
7,568,298 B2 8/2009 Kerns
7,582,102 B2 9/2009 Heinz et al.
7,584,528 B2 9/2009 Hu
7,591,050 B2 9/2009 Hammerslag
7,597,675 B2 10/2009 Ingimundarson et al.
7,600,660 B2 10/2009 Kasper et al.
7,617,573 B2 11/2009 Chen
7,618,386 B2 11/2009 Nordt, III et al.
7,618,389 B2 11/2009 Nordt, III et al.
7,624,517 B2 12/2009 Smith
7,648,404 B1 1/2010 Martin
7,650,705 B2 1/2010 Donnadieu et al.
7,662,122 B2 2/2010 Sterling
7,694,354 B2 4/2010 Philpott et al.
7,704,219 B2 4/2010 Nordt, III et al.
7,713,225 B2 5/2010 Ingimundarson et al.
7,752,774 B2 7/2010 Ussher
7,757,412 B2 7/2010 Farys
7,774,956 B2 8/2010 Dua et al.
7,789,844 B1 9/2010 Allen
7,794,418 B2 9/2010 Ingimundarson et al.
7,806,842 B2 10/2010 Stevenson et al.
7,819,830 B2 10/2010 Sindel et al.
D626,322 S 11/2010 Servettaz
7,841,106 B2 11/2010 Farys
7,871,334 B2 1/2011 Young et al.
7,877,845 B2 2/2011 Signori
7,878,998 B2 2/2011 Nordt, III et al.
7,887,500 B2 2/2011 Nordt, III et al.
D633,375 S 3/2011 Jablonka
7,896,827 B2 3/2011 Ingimundarson et al.
7,900,378 B1 3/2011 Busse
7,908,769 B2 3/2011 Pellegrini
7,922,680 B2 4/2011 Nordt, III et al.
7,935,068 B2 5/2011 Einarsson
7,947,005 B2 5/2011 Castillo
7,947,061 B1 5/2011 Reis
7,950,112 B2 5/2011 Hammerslag et al.
7,954,204 B2 6/2011 Hammerslag et al.
7,963,049 B2 6/2011 Messmer
7,992,261 B2 8/2011 Hammerslag et al.
7,993,296 B2 8/2011 Nordt, III et al.
8,016,781 B2 9/2011 Ingimundarson et al.
D646,790 S 10/2011 Castillo et al.
8,056,150 B2 11/2011 Stokes et al.
8,056,265 B2 11/2011 Pirkle et al.
8,061,061 B1 11/2011 Rivas
8,074,379 B2 12/2011 Robinson, Jr. et al.
8,091,182 B2 1/2012 Hammerslag et al.
8,105,252 B2 1/2012 Rousso
8,109,015 B2 2/2012 Signori
8,128,587 B2 3/2012 Stevenson et al.
D663,850 S 7/2012 Joseph
D663,851 S 7/2012 Joseph
8,215,033 B2 7/2012 Carboy et al.
8,231,074 B2 7/2012 Hu et al.
8,231,560 B2 7/2012 Ingimundarson et al.
D665,088 S 8/2012 Joseph
8,235,321 B2 8/2012 Chen
8,245,371 B2 8/2012 Chen
8,257,293 B2 9/2012 Ingimundarson et al.
8,266,827 B2 9/2012 Dojan et al.
8,277,401 B2 10/2012 Hammerslag et al.
8,302,329 B2 11/2012 Hurd et al.
8,303,527 B2 11/2012 Joseph
8,308,098 B2 11/2012 Chen
8,321,999 B2 12/2012 Boden
D673,443 S 1/2013 Elrod
8,353,087 B2 1/2013 Chen
8,353,088 B2 1/2013 Ha
8,381,362 B2 2/2013 Hammerslag et al.
D677,045 S 3/2013 Voskuil
D679,019 S 3/2013 Siddle et al.
D679,175 S 4/2013 Moreau et al.
8,424,168 B2 4/2013 Soderberg et al.
8,434,200 B2 5/2013 Chen
8,468,657 B2 6/2013 Soderberg et al.
8,490,299 B2 7/2013 Dua et al.
8,516,662 B2 8/2013 Goodman et al.
D691,027 S 10/2013 Rainer
8,578,632 B2 11/2013 Bell et al.
8,652,164 B1 2/2014 Aston
D702,529 S 4/2014 Diez Herrera
8,713,820 B2 5/2014 Kerns et al.
D712,727 S 9/2014 Geiger
8,984,719 B2 3/2015 Soderberg et al.
9,072,341 B2 7/2015 Jungkind
D735,987 S 8/2015 Hsu
9,101,181 B2 8/2015 Soderberg et al.
9,125,455 B2 9/2015 Kerns et al.
9,138,030 B2 9/2015 Soderberg et al.
9,248,040 B2 2/2016 Soderberg et al.
9,339,082 B2 5/2016 Hammerslag et al.
9,375,053 B2 6/2016 Burns et al.
9,408,437 B2 8/2016 Goodman et al.
D767,269 S 9/2016 Lovett et al.
9,439,477 B2 9/2016 Neiley
9,516,923 B2 12/2016 Capra et al.
D776,421 S 1/2017 Venturini
9,532,626 B2 1/2017 Lovett et al.
9,610,185 B2 4/2017 Capra et al.
9,629,417 B2 4/2017 Cavanagh et al.
9,681,705 B2 6/2017 Trudel et al.

(56) References Cited

U.S. PATENT DOCUMENTS 9,700,101 B2 7/2017 Lovett et al.
9,706,814 B2 7/2017 Converse et al.
9,713,362 B2 * 7/2017 Farris ..... A43B 13/41
2002/0002781 A1 1/2002 Bouvier
2002/0007570 A1 1/2002 Girard
2002/0050076 A1 5/2002 Borsoi et al.
2002/0052568 A1 5/2002 Houser et al.
2002/0062579 A1 5/2002 Caeran
2002/0095750 A1 7/2002 Hammerslag
2002/0129518 A1 9/2002 Borsoi et al.
2002/0148142 A1 10/2002 Oorei et al.
2002/0166260 A1 11/2002 Borsoi
2002/0178548 A1 12/2002 Freed
2003/0041478 A1 3/2003 Liu
2003/0051374 A1 3/2003 Freed
2003/0079376 A1 5/2003 Oorei et al.
2003/0144620 A1 7/2003 Sieller
2003/0150135 A1 8/2003 Liu
2003/0177662 A1 9/2003 Elkington et al.
2003/0204938 A1 11/2003 Hammerslag
2004/0041452 A1 3/2004 Williams
2004/0159017 A1 8/2004 Martin
2004/0211039 A1 10/2004 Livingston
2004/0221433 A1 11/2004 Wolfberg
2005/0054962 A1 3/2005 Bradshaw
2005/0060912 A1 3/2005 Holzer et al.
2005/0081339 A1 4/2005 Sakabayashi
2005/0081403 A1 4/2005 Mathieu
2005/0087115 A1 4/2005 Martin
2005/0098673 A1 5/2005 Huang
2005/0102861 A1 5/2005 Martin
2005/0126043 A1 6/2005 Reagan et al.
2005/0172463 A1 8/2005 Rolla
2005/0178872 A1 8/2005 Hyun
2005/0184186 A1 8/2005 Tsoi et al.
2005/0198866 A1 9/2005 Wiper et al.
2005/0247813 A1 11/2005 Kovacevich et al.
2005/0273025 A1 12/2005 Houser
2006/0135901 A1 6/2006 Ingimundarson et al.
2006/0148351 A1 7/2006 Tao et al.
2006/0156517 A1 * 7/2006 Hammerslag ..... A43C 1/04
24/68 SK
2006/0174516 A1 8/2006 Peruzzo
2006/0179685 A1 8/2006 Borel et al.
2006/0185193 A1 8/2006 Pellegrini
2006/0196083 A1 9/2006 Martin
2006/0213085 A1 9/2006 Azam et al.
2006/0287627 A1 12/2006 Johnson
2007/0006489 A1 1/2007 Case, Jr. et al.
2007/0063459 A1 3/2007 Kavarsky
2007/0068040 A1 3/2007 Farys
2007/0084956 A1 4/2007 Chen
2007/0113524 A1 5/2007 Lander
2007/0128959 A1 6/2007 Cooke
2007/0149657 A1 6/2007 Skuratowicz et al.
2007/0169378 A1 7/2007 Sodeberg et al.
2007/0276306 A1 11/2007 Castillo
2008/0016717 A1 1/2008 Ruban
2008/0060167 A1 3/2008 Hammerslag et al.
2008/0060168 A1 3/2008 Hammerslag et al.
2008/0066272 A1 3/2008 Hammerslag et al.
2008/0066345 A1 3/2008 Hammerslag et al.
2008/0066346 A1 3/2008 Hammerslag et al.
2008/0068204 A1 3/2008 Carmen et al.
2008/0083135 A1 4/2008 Hammerslag et al.
2008/0092279 A1 4/2008 Chiang
2008/0172848 A1 7/2008 Chen
2008/0196224 A1 8/2008 Hu
2009/0019734 A1 1/2009 Reagan et al.
2009/0071041 A1 3/2009 Hooper
2009/0090029 A1 4/2009 Kishino
2009/0099562 A1 4/2009 Ingimudarson et al.
2009/0124948 A1 5/2009 Ingimudarson et al.
2009/0172928 A1 7/2009 Messmer et al.
2009/0184189 A1 7/2009 Soderberg et al.
2009/0272007 A1 11/2009 Beers et al.
2009/0277043 A1 11/2009 Graser et al.
2009/0287128 A1 11/2009 Ingimudarson et al.
2010/0064547 A1 3/2010 Kaplan
2010/0081979 A1 4/2010 Ingimudarson et al.
2010/0094189 A1 4/2010 Ingimudarson et al.
2010/0101061 A1 4/2010 Ha
2010/0115744 A1 5/2010 Fong
2010/0139057 A1 6/2010 Soderberg et al.
2010/0154254 A1 6/2010 Fletcher
2010/0174221 A1 7/2010 Ingimudarson et al.
2010/0175163 A1 7/2010 Litke
2010/0217169 A1 8/2010 Ingimudarson
2010/0251524 A1 10/2010 Chen
2010/0269373 A1 10/2010 Pirkle et al.
2010/0299959 A1 12/2010 Hammerslag
2010/0319216 A1 12/2010 Grenzke et al.
2010/0331750 A1 12/2010 Ingimudarson
2011/0000173 A1 1/2011 Lander
2011/0004135 A1 1/2011 Kausek
2011/0071647 A1 3/2011 Mahon
2011/0098618 A1 4/2011 Fleming
2011/0099843 A1 5/2011 Jung
2011/0144554 A1 6/2011 Weaver, II et al.
2011/0162236 A1 7/2011 Voskuil et al.
2011/0167543 A1 7/2011 Kovacevich et al.
2011/0178448 A1 7/2011 Einarsson
2011/0184326 A1 7/2011 Ingimundarson et al.
2011/0191992 A1 8/2011 Chen
2011/0197362 A1 8/2011 Chella et al.
2011/0218471 A1 9/2011 Ingimundarson et al.
2011/0225843 A1 * 9/2011 Kerns ..... A43B 3/0052
36/50.1
2011/0258876 A1 10/2011 Baker et al.
2011/0266384 A1 11/2011 Goodman et al.
2011/0288461 A1 11/2011 Arnould et al.
2011/0301521 A1 12/2011 Weissenbock et al.
2011/0306911 A1 12/2011 Tran
2012/0000091 A1 1/2012 Cotterman et al.
2012/0004587 A1 1/2012 Nickel et al.
2012/0005865 A1 1/2012 Boden
2012/0005995 A1 1/2012 Emery
2012/0010547 A1 1/2012 Hinds
2012/0023717 A1 2/2012 Chen
2012/0029404 A1 2/2012 Weaver, II et al.
2012/0047620 A1 3/2012 Ellis et al.
2012/0101417 A1 4/2012 Joseph
2012/0102783 A1 5/2012 Swigart et al.
2012/0138882 A1 6/2012 Moore et al.
2012/0157902 A1 6/2012 Castillo et al.
2012/0167290 A1 7/2012 Kovacevich et al.
2012/0174437 A1 7/2012 Heard
2012/0204381 A1 8/2012 Ingimundarson et al.
2012/0228419 A1 9/2012 Chen
2012/0246974 A1 10/2012 Hammerslag et al.
2012/0310273 A1 12/2012 Thorpe
2013/0012856 A1 1/2013 Hammerslag et al.
2013/0014359 A1 1/2013 Chen
2013/0019501 A1 1/2013 Gerber
2013/0025100 A1 1/2013 Ha
2013/0091667 A1 4/2013 Chen
2013/0091674 A1 4/2013 Chen
2013/0092780 A1 4/2013 Soderberg et al.
2013/0192091 A1 * 8/2013 Kohatsu ..... A43B 23/026
36/103
2013/0239303 A1 9/2013 Cotterman et al.
2013/0269219 A1 10/2013 Burns et al.
2013/0277485 A1 10/2013 Soderberg et al.
2013/0312293 A1 11/2013 Gerber
2013/0340283 A1 12/2013 Bell et al.
2013/0345612 A1 12/2013 Bannister et al.
2014/0068838 A1 3/2014 Beers et al.
2014/0082963 A1 3/2014 Beers
2014/0094728 A1 4/2014 Soderberg et al.
2014/0117140 A1 5/2014 Goodman et al.
2014/0123440 A1 5/2014 Capra et al.
2014/0123449 A1 5/2014 Soderberg et al.
2014/0208550 A1 7/2014 Neiley
2014/0221889 A1 8/2014 Burns et al.

(56) References Cited

U.S. PATENT DOCUMENTS

| | | | | |
|---|---|---|---|---|
| 2014/0257156 | A1 | 9/2014 | Capra et al. | |
| 2014/0290016 | A1 | 10/2014 | Lovett et al. | |
| 2014/0359981 | A1 | 12/2014 | Cotterman et al. | |
| 2015/0005685 | A1 | 1/2015 | Chetlapalli et al. | |
| 2015/0007422 | A1 | 1/2015 | Cavanagh et al. | |
| 2015/0014463 | A1 | 1/2015 | Converse et al. | |
| 2015/0026936 | A1 | 1/2015 | Kerns et al. | |
| 2015/0033519 | A1 | 2/2015 | Hammerslag et al. | |
| 2015/0059206 | A1* | 3/2015 | Lovett | F16G 11/02 36/50.1 |
| 2015/0076272 | A1 | 3/2015 | Trudel et al. | |
| 2015/0089779 | A1 | 4/2015 | Lawrence et al. | |
| 2015/0089835 | A1 | 4/2015 | Hammerslag et al. | |
| 2015/0101160 | A1 | 4/2015 | Soderberg et al. | |
| 2015/0150705 | A1 | 6/2015 | Capra et al. | |
| 2015/0151070 | A1 | 6/2015 | Capra et al. | |
| 2015/0190262 | A1 | 7/2015 | Capra et al. | |
| 2015/0223608 | A1 | 8/2015 | Capra et al. | |
| 2015/0237962 | A1 | 8/2015 | Soderberg et al. | |
| 2015/0289595 | A1* | 10/2015 | Rushbrook | A43C 1/06 36/50.1 |
| 2015/0313319 | A1 | 11/2015 | Ha | |
| 2015/0335458 | A1 | 11/2015 | Romo | |
| 2016/0044994 | A1* | 2/2016 | Soderberg | A43C 11/165 36/97 |
| 2016/0058127 | A1 | 3/2016 | Burns et al. | |
| 2016/0058130 | A1 | 3/2016 | Boney et al. | |
| 2016/0157561 | A1 | 6/2016 | Schum et al. | |

FOREIGN PATENT DOCUMENTS

| | | | |
|---|---|---|---|
| CH | 199766 | | 9/1938 |
| CH | 204 834 | A | 5/1939 |
| CN | 2613167 | | 4/2004 |
| CN | 201015448 | | 2/2008 |
| DE | 400 174 | C | 8/1924 |
| DE | 641976 | | 2/1937 |
| DE | 23 41 658 | | 3/1974 |
| DE | 29 00 077 | A1 | 7/1980 |
| DE | 31 01 952 | A1 | 9/1982 |
| DE | 38 13 470 | | 11/1989 |
| DE | 3822113 | | 1/1990 |
| DE | 92 00 982 | U1 | 5/1993 |
| DE | 43 02 401 | A1 | 8/1994 |
| DE | 43 05 671 | A1 | 9/1994 |
| DE | 9308037 | | 10/1994 |
| DE | 43 26 049 | A1 | 2/1995 |
| DE | 9315776 | | 2/1995 |
| DE | 29503552.8 | | 4/1995 |
| DE | 196 24 553 | | 1/1998 |
| DE | 197 00 309 | | 7/1998 |
| DE | 19945045 | A1 | 3/2001 |
| DE | 11 2006 000 124 | T5 | 1/2008 |
| DE | 20 2010 000 354 | U1 | 6/2010 |
| DE | 11 2013 005 273 | T5 | 9/2015 |
| DE | 11 2014 003 135 | T5 | 4/2016 |
| EP | 0 056 953 | | 8/1982 |
| EP | 0 079 874 | | 5/1983 |
| EP | 0 099 504 | | 2/1984 |
| EP | 0 123 050 | | 10/1984 |
| EP | 0 155 596 | | 9/1985 |
| EP | 0 201 051 | | 11/1986 |
| EP | 0 255 869 | | 2/1988 |
| EP | 0 297 342 | | 1/1989 |
| EP | 0 393 380 | | 10/1990 |
| EP | 0 474 708 | | 3/1992 |
| EP | 0 589 232 | A1 | 3/1994 |
| EP | 0 589 233 | A1 | 3/1994 |
| EP | 0 614 625 | A1 | 9/1994 |
| EP | 0 651 954 | A1 | 5/1995 |
| EP | 0 679 346 | | 11/1995 |
| EP | 0 693 260 | B1 | 1/1996 |
| EP | 0 734 662 | A1 | 10/1996 |
| EP | 0 848 917 | | 6/1998 |
| EP | 0 923 965 | | 6/1999 |
| EP | 0 937 467 | | 8/1999 |
| EP | 1163860 | | 12/2001 |
| EP | 1 219 195 | | 7/2002 |
| EP | 1 236 412 | | 9/2002 |
| EP | 2 052 636 | | 4/2009 |
| EP | 2298107 | B1 | 3/2011 |
| EP | 2359708 | | 8/2011 |
| EP | 2981184 | | 2/2016 |
| EP | 3003087 | | 4/2016 |
| EP | 3019043 | | 5/2016 |
| EP | 3044477 | | 7/2016 |
| EP | 3071159 | | 9/2016 |
| FR | 1 404 799 | | 7/1965 |
| FR | 2 019 991 | A | 7/1970 |
| FR | 2 399 811 | | 9/1979 |
| FR | 2 565 795 | | 6/1984 |
| FR | 2 598 292 | A1 | 11/1987 |
| FR | 2 726 440 | A1 | 5/1996 |
| FR | 2 770 379 | A1 | 5/1999 |
| FR | 2 814 919 | A1 | 4/2002 |
| GB | 189911673 | | 7/1899 |
| GB | 216400 | | 5/1924 |
| GB | 2 449 722 | A | 12/2008 |
| IT | 1220811 | | 6/1990 |
| IT | PD 2003 A 000197 | | 4/2003 |
| IT | PD 2003 A 000198 | | 3/2005 |
| JP | 51-121375 | | 10/1976 |
| JP | 54-108125 | | 2/1978 |
| JP | H02-236025 | | 9/1990 |
| JP | 6-284906 | | 2/1996 |
| JP | 3030988 | | 11/1996 |
| JP | 3031760 | | 12/1996 |
| JP | 53-124987 | | 3/1997 |
| JP | 10-199366 | | 7/1998 |
| JP | 2004-016732 | | 1/2004 |
| JP | 2004-041666 | | 2/2004 |
| JP | 2009-504210 | | 2/2009 |
| KR | 20-0367882 | | 11/2004 |
| KR | 20-0400568 | | 8/2005 |
| KR | 10-0598627 | | 7/2006 |
| KR | 10-0953398 | | 4/2010 |
| KR | 10-200-0111031 | | 10/2010 |
| KR | 10-1025134 | B1 | 3/2011 |
| KR | 10-1028468 | | 4/2011 |
| KR | 10-1053551 | | 7/2011 |
| WO | 94/27456 | | 12/1994 |
| WO | 1995/03720 | | 2/1995 |
| WO | 95/11602 | | 5/1995 |
| WO | 97/28713 | A1 | 8/1997 |
| WO | 98/33408 | | 8/1998 |
| WO | 98/37782 | | 9/1998 |
| WO | 99/09850 | | 3/1999 |
| WO | 99/15043 | | 4/1999 |
| WO | 99/43231 | | 9/1999 |
| WO | 00/53045 | | 9/2000 |
| WO | 2000/76337 | A1 | 12/2000 |
| WO | 01/08525 | | 2/2001 |
| WO | 01/15559 | | 3/2001 |
| WO | 02/051511 | | 7/2002 |
| WO | 20004/093569 | | 11/2004 |
| WO | 2005/013748 | A1 | 2/2005 |
| WO | 2007/016983 | | 2/2007 |
| WO | 2008/015214 | | 2/2008 |
| WO | 2008/033963 | | 3/2008 |
| WO | 2009/134858 | | 11/2009 |
| WO | 2009/134864 | | 11/2009 |
| WO | 2010/059989 | A2 | 5/2010 |
| WO | 2012/165803 | A2 | 12/2012 |
| WO | 2013/025704 | A1 | 2/2013 |
| WO | 2014/036371 | A1 | 3/2014 |
| WO | 2015/035885 | | 3/2015 |
| WO | 2015/179332 | A1 | 11/2015 |

(56) References Cited

FOREIGN PATENT DOCUMENTS

| | | | |
|---|---|---|---|
| WO | 2015/181928 | A1 | 12/2015 |
| WO | 2018/026957 | A1 | 2/2018 |

OTHER PUBLICATIONS

ASOLO® Boot Brochure Catalog upon information and belief date is as early as Aug. 22, 1997, 12 pages.
La Sportiva, A Technical Lightweight Double Boot for Cold Environments, 1 page. Accessed on May 27, 2015. Retrieved from http://www.sportiva.com/products/footwear/mountain/spantik.
"Strength of materials used to make my Safety Harnesses," Elaine, Inc. Jul. 9, 2012. Retrieved from <https://web.archive.org/web/20120709002720/http://www.childharness.ca/strength_data.html> on Mar. 17, 2014, 2 pages.
International Search Report and Written Opinion for PCT/US2013/032326 dated Jun. 14, 2013, 27 pages.
International Preliminary Report on Patentability for PCT/US2013/032326 dated Sep. 16, 2014, 6 pages.
International Search Report and Written Opinion for PCT/US2013/057637 dated Apr. 7, 2014, 34 pages.
International Preliminary Report on Patentability for PCT/US2013/057637 dated Mar. 3, 2015, 9 pages.
International Search Report and Written Opinion for PCT/US2013/068342 dated Apr. 7, 2014, 29 pages.
International Preliminary Report on Patentability for PCT/US2013/068342 dated May 5, 2015, 9 pages.
International Search Report and Written Opinion for PCT/US2014/014952 dated Apr. 25, 2014, 17 pages.
International Preliminary Report on Patentability for PCT/US2014/014952 dated Aug. 11, 2015, 9 pages.
International Search Report and Written Opinion for PCT/US2014/066212 dated Apr. 22, 2015, 16 pages.
International Search Report and Written Opinion for PCT/US2014/032574 dated Oct. 31, 2014, 19 pages.
International Search Report and Written Opinion for PCT/US2014/045291 dated Nov. 6, 2014, 12 pages.
International Preliminary Report on Patentability for PCT/US2014/045291 dated Jan. 5, 2016, all pages.
International Search Report and Written Opinion for PCT/US2014/013458 dated May 19, 2014, 12 pages.
International Search Report and Written Opinion for PCT/US2013/068814 dated Jun. 9, 2014, 18 pages.
International Preliminary Report on Patentability for PCT/US2013/068814 dated May 12, 2015, 12 pages.
Receipt of Certificate of Design Registration No. 1529678 from the Japanese Patent Office for design application No. 2014-015570 dated Jun. 26, 2015, 1 page.
International Search Report and Written Opinion for PCT/US2014/055710 dated Jul. 6, 2015, 19 pages.
International Search Report and Written Opinion for PCT/US2014/054420 dated Jul. 6, 2015, 21 pages.
The Preliminary Rejections from the Korean Intellectual Property Office for Application No. 30-2014-34959, is not translated into English. The document requests a renaming of the application to be in accordance with Korean patent law, 5 pages total.
The Preliminary Rejections from the Korean Intellectual Property Office for Application No. 30-2014-34959, is not translated into English. The document requests a revision of the drawings to be in accordance with Korean patent law, 6 pages total.
Certificate of Design Registration No. 30-809409 on Aug. 3, 2015 from the Korean Intellectual Property Office for Appln No. 30-2015-11475, 2 pages.
Certificate of Design Registration No. 30-809410 on Aug. 3, 2015 from the Korean Intellectual Property Office for Appln No. 30-2015-11476, 2 pages.
European Search Report for EP 14168875 dated Oct. 29, 2014, 9 pages.
International Search Report and Written Opinion for PCT/US2014/020894 dated Jun. 20, 2014, 12 pages.
International Preliminary Report on Patentability for PCT/US2014/020894 dated Sep. 8, 2015, 7 pages.
International Search Report and Written Opinion for PCT/US2014/041144 dated Dec. 10, 2014, 13 pages.
International Preliminary Report on Patentability for PCT/US2014/041144 dated Dec. 8, 2015, all pages.
International Search Report and Written Opinion for PCT/US2014/046238 dated Nov. 21, 2014, 17 pages.
International Preliminary Report on Patentability for PCT/US2014/046238 dated Jan. 12, 2016, all pages.
Office Action from the German Patent and Trademark Office for Appln No. 402015100191.2, regarding the title of the invention, 2 pages.
Anonymous, "Shore durometer," Wikipedia, the free encyclopedia, Mar. 10, 2012, XP002747470, Retrieved from the Internet: URL: https://en.wikipedia.org/w/index.php?title=Shore_durometer&oldid=481128180 [retrieved on Oct. 20, 2015] * shore A, shore D, durometer, polymer, rubber, gel; the whole document *, 6 pages.
Notice of Reasons for Rejection from the Japanese Patent Office dated Oct. 5, 2015 for design application No. 2015-004923, 4 pages.
"Save Tourniquet," 3 pages. Copyright 2015. Accessed on Dec. 11, 2015. Retrieved from http://www.savetourniquet.com/.
European Search Report for EP 14760642 dated Aug. 5, 2016, all pages.
Extended European Search Report for EP 14743075 dated Oct. 10, 2016, all pages.
Supplementary European Search Report for EP 13761841 dated Oct. 21, 2015, all pages.
International Search Report and Written Opinion for PCT/US2015/054530 dated Jan. 13, 2016, all pages.
Notice of Reasons for Rejection for JP2016-518004 dispatched Jan. 27, 2017, all pages.
Notice of Preliminary Rejection for Korean Patent Appln No. 10-2015-7037205 dated Jul. 6, 2017, all pages.
International Search Report and Written Opinion in PCT/US2011/034692 dated Feb. 27, 2012, all pages.
International Preliminary Report on Patentability in PCT/US2011/034692 dated Nov. 15, 2012, all pages.
International Search Report and Written Opinion for PCT/US2009/065405 dated Jun. 28, 2010, all pages.
International Preliminary Report on Patentability in PCT/US2009/065405 dated May 24, 2011, all pages.

* cited by examiner

TENSION MEMBER GUIDES FOR LACING SYSTEMS

CROSS-REFERENCE TO RELATED APPLICATIONS

This application is a continuation of U.S. patent application Ser. No. 15/667,486 filed Aug. 2, 2017, entitled "Tension Member Guides Of A Lacing System" which claims benefit and priority to Provisional U.S. Patent Application No. 62/370,032 filed Aug. 2, 2016, entitled "Tension Member Guides of a Lacing System;" the entire disclosures of which are hereby incorporated by reference, for all purposes, as if fully set forth herein.

BACKGROUND OF THE INVENTION

The embodiments described herein are generally related to closure or tightening systems, devices, and methods for closing and/or tightening an article. The embodiments are specifically related to guide or components that are used to route a tension member or lace about a path of the article.

Closure or tightening systems are commonly used to tighten and close an article. For example, a reel based mechanism may be used to close or tighten footwear. A knob of the reel based mechanism is typically coupled with a spool that includes a channel around which a lace is wound as the knob is rotated by the user. The reel based mechanism may include teeth that engage, or another ratchet type mechanism, that prevent counter-rotation of the spool and/or knob. A tension member is typically attached to the reel based mechanism so that rotation of the knob by the user causes tensioning of the tension member. The tension member is typically routed along a path of the article via one or more guide members, such as eyelets in conventional footwear.

BRIEF DESCRIPTION OF THE INVENTION

The embodiments described herein provide various tension member guides that may be employed to direct or route a tension member or lace about a path of an article and to or from a tightening mechanism. According to one aspect, the tension member guide may include a main body and a guide member. The main body may be coupleable to the article, such as footwear, and may include a pair of slits or incisions. The guide member may be folded along a longitudinal length to form a loop or channel within which the tension member may be inserted. The looped guide member may have a center portion and two end portions that are disposed on opposite sides of the center portion. The guide member may be positioned on the main body so that each end portion of the two end portions is inserted through one slit or incision of the pair of slits or incisions such that the two end portions are positioned on an opposite side of the main body from the center portion. The main body may be folded over the guide member so that the guide member, other than the two end portions, is positioned between opposing sides of the main body. A reinforcement member may be attached to the main body and to a proximal end of the guide member.

When the tension member guide is coupled with footwear, the two end portions of the guide member may be positioned on an interior side of an upper of the footwear. A surface or face of the main body may include a material that is heat weldable to the footwear in order to enable easy coupling of the tension member guide to the footwear. In some embodiments, the main body may include an additional pair of slits or incisions and an additional guide member may be positioned on the main body so that opposing end portions of the additional guide member are inserted through the additional pair of slits or incisions. In such embodiments, the opposing end portions of the additional guide member may be positioned on an exterior surface of the main body and the two end portions of the guide member may be positioned on an interior surface of the main body.

A method of coupling a tension member guide with a shoe or footwear includes providing the tension member guide and coupling the tension member guide with the footwear. The tension member guide includes a main body that includes a pair of slits or incisions and a guide member that is folded along a longitudinal length to form a loop or channel within which a tension member may be inserted. The guide member has a center portion and two end portions that are disposed on opposite sides of the center portion and the guide member is positioned on the main body so that each end portion of the two end portions is inserted through one slit or incision of the pair of slits or incisions such that the two end portions are positioned on an opposite side of the main body from the center portion. The tension member guide may be coupled with the footwear so that the two end portions are positioned near an eyestay edge of the footwear.

The method may also include inserting the tension member through the loop or channel of the guide member and/or folding the main body over the guide member so that the guide member, other than the two end portions, is positioned between opposing sides of the main body. The method may further include heat welding a surface or face of the main body to the footwear. The tension member guide may also include a reinforcement member that is attached to the main body and to a proximal end of the guide member. The tension member guide may be coupled with the footwear so that the two end portions of the guide member are positioned on an interior side of an upper of the footwear. The main body may also include an additional pair of slits or incisions and an additional guide member may be positioned on the main body so that opposing end portions of the additional guide member are inserted through the additional pair of slits or incisions.

According to another aspect, a tension member guide includes a first member and a second member. The first member has a longitudinal length and a lateral width and the second member is folded along a longitudinal length to form a loop or channel within which a tension member may be inserted. The looped second member has a center portion and two end portions disposed on opposite sides of the center portion. The second member is formed of a lower friction material than the first member and the second member is coupled with the first member so that the second member is positioned atop one side of the first member.

The folded second member may be shorter longitudinally than the first member so that a proximal end of the tension member guide is thinner than a distal end of the tension member guide. The first member may not be folded over the looped end of the second member. The second member may be folded so that opposing longitudinal ends of the second member are longitudinally offset from one another. The first member may include a material that is heat weldable to an article. The second member may include an outer material and an inner material, in which the outer material is configured to provide structural support and the inner material is configured to provide a low friction surface. In some embodiments, the tension member guide also includes a third member that is positioned atop a proximal end of the second member so that the proximal end of the second member is disposed between the first member and the third member.

A method of coupling a tension member guide with an article, such as a shoe or footwear, includes providing a tension member guide and coupling the tension member guide with the article. The tension member guide includes a first member having a longitudinal length and a lateral width and a second member that is folded along a longitudinal length to form a loop or channel. The second member has a center portion and two end portions that are disposed on opposite sides of the center portion. The second member is formed of a lower friction material than the first member and the second member is coupled with the first member so that the second member is positioned atop one side of the first member.

The method may also include inserting a tension member through the loop or channel of the folded second member and/or heat welding the first member to the article. The first member may not be folded over a looped end of the second member and/or the tension member guide may also include a third member that is positioned atop a proximal end of the second member so that the proximal end of the second member is disposed between the first member and the third member.

According to another aspect, a tension member guide includes a material body having a channel formed therein and a reinforcement material that is disposed within the channel of the material body to reinforce the material body. The material body is folded to form a loop or channel within which a tension member may be inserted. The material body may be formed of a woven material and/or the reinforcement material may include reinforcing fibers or fiber bundles.

The material body may include a plurality of channels and the reinforcement material may be distributed among the plurality of channels so that a density of the reinforcement material within the plurality of channels is greater nearer to a center portion of the material body. The increased density of the reinforcement material near the center portion of the material body may cause the tension member guide to exhibit an increased flexing or bowing toward opposing end portions of the material body in response to tensioning of the tension member. A low friction material may be positioned on an inner surface of the loop or channel of the folded material body.

A method of coupling a tension member guide with an article, such as a shoe or footwear, may include providing a tension member guide and coupling the tension member guide with the article. The tension member guide may include a material body having a channel formed therein and a reinforcement material that is disposed within the channel of the material body to reinforce the material body. The material body may be folded to form a loop or channel within which a tension member may be inserted. The method may also include inserting the tension member within the loop or channel formed in the folded material body.

The material body may include a plurality of channels and the reinforcement material may be distributed among the plurality of channels so that a density of the reinforcement material within the plurality of channels is greater nearer to a center portion of the material body in comparison with opposing end portions of the material body. The material body may be formed of a woven material.

BRIEF DESCRIPTION OF THE DRAWINGS

The present invention is described in conjunction with the appended figures.

Figure 1A:
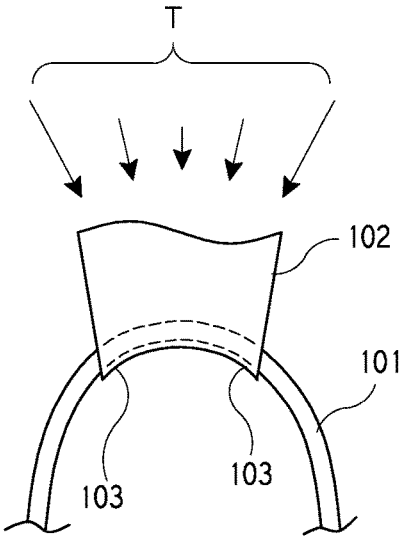
FIGS. 1A-B illustrate lace guides that may be used to route or direct a tension member or lace about a path of an article.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE DRAWINGS

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

The embodiments described herein provide embodiments of guides or components (hereinafter guides) that may be used to route or direct a tension member or lace about a path of an article, such as footwear. The tension member may be a lace or cord that is tensionable via operation of a tightening mechanism. The tension member may be routed about an article, via the guides, so that tensioning of the tension member causes the article to close and/or tighten. Specifically, the tension member may be routed along and across an opening of the article so that tensioning of the tension member urges one side of the opening toward an opposite side of the opening in order to close and tighten the article. Various forms of footwear (e.g., shoes, boots, and the like) include such an arrangement of a tension member and guides. For example, conventional shoes and boots commonly employ shoelaces that are routed about the shoe's tongue and that are tensioned to urge opposing sides of the tongue toward one another to close and tighten the shoe/boot about the user's foot.

The guide is generally positioned near the opening of the article, such as on opposing sides of the eyestay, and directs, routes, or guides the tension member along and/or across the opening. The guide may be made of a low friction material that minimizes frictional engagement of the tension member and guide. The guides described herein are generally formed of a fabric or webbing type materials that is folded over to form a loop. The tension member is inserted within the loop and the loop functions to guide or direct the tension member about the path. Additional details of the guide members are described in greater detail below.

As briefly described above, the lace is tensioned via a tightening mechanism. In a specific embodiment, the tightening mechanism is a reel based closure system. The reel based closure system includes a knob that may be grasped and rotated by a user to tension the lace. Exemplary embodiments of reel based closure devices are further described in U.S. patent application Ser. No. 13/098,276, filed Apr. 29, 2011, titled "Reel Based Lacing System", U.S. patent application Ser. No. 14/328,521, filed Jul. 10, 2014, titled "Closure Devices Including Incremental Release Mechanisms and Methods Therefor," and U.S. patent application Ser. No. 12/623,362, filed Nov. 20, 2009, titled "Reel Based Lacing System", the entire disclosures of which are incorporated by reference herein.

In another embodiment, the tightening mechanism is a motorized device or mechanism that tensions the tension member or lace. An exemplary embodiment of a motorized mechanism that may be used to tension the lace is further described in U.S. patent application Ser. No. 14/015,807, filed Aug. 30, 2013, titled "Motorized Tensioning System for Medical Braces and Devices", the entire disclosure of which is incorporated by reference herein.

In yet other embodiments, the tightening mechanism may be a pull cord type device that is configured to be grasped and pulled by a user to tension the lace. Exemplary pull cord devices are further described in U.S. patent application Ser. No. 14/166,799, filed Jan. 28, 2014, and titled "Lace Fixation Assembly and System", the entire disclosure of which is incorporated by reference herein. For ease is describing the various embodiments herein, the tightening mechanism will be referred to generally as a "reel assembly" or "reel based closure device".

Figure 1B:
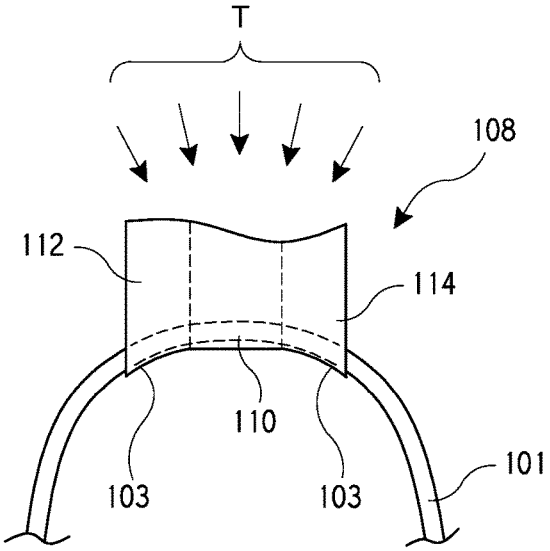

Referring now to FIGS. 1A-B, illustrated are two lace guides that may be used to route or direct a lace 101 about a path. FIG. 1A illustrates a conventional lace guide 102. Lace guide 102 is formed of a fabric or webbing material that is folded backward to form a loop within which the lace 101 is inserted. The fabric or webbing material of the lace guide 102 is a solitary or single fabric material. Tensioning of the lace 101 causes opposing ends 103 of the lace guide 102 to flex and bend as illustrated. Because the lace guide 102 is made of a single or solitary material, the tension imposed or parted on the lace guide 102 from the lace 101 is concentrated near the opposing ends 103, as illustrated by the tension vectors T. As illustrated, the tension T is greatest in the opposing ends 103 of the lace guide 102 and is reduced toward the center of the lace guide 102. Because the tension T is greatest near the opposing ends 103 of the lace guide 102, the lace guide 102 may experience significantly more wear near the opposing ends 103. The increased tension T experienced near the opposing ends 103 may also cause the lace guide 102 to pinch, bunch, or squeeze inward to some degree as illustrated.

As illustrated in FIG. 1B, the tension T imparted on the lace guide 108 may be more uniform if the lace guide 108 is formed to have a varying elasticity between the opposing ends 103. The varying elasticity may be achieved by forming the lace guide of various elastic materials or sections. Specifically, FIG. 1B illustrates a lace guide 108 having a middle material or section 110 (hereinafter middle section 110), a first end material or section 112 (hereinafter first end section 112), and a second end material or section 114 (hereinafter second end section 114). The elasticity of the middle section 110 is different than either or both the first end section 112 and the second end section 114. Typically, the middle section 110 has less elasticity, stretch, or flexibility (i.e., is more rigid) then either the first end section 112 or the second end section 114. Stated differently, the first end section 112 and second end section 114 are more elastic, flexible, or stretchable than the middle section 110. As such when the lace 101 is tensioned, the first end section 112 and second end section 114 stretch, flex, or otherwise deform to a greater degree than the middle section 110. The varying elastic sections of the lace guide 108 enable the lace guide 108 to form a more natural U-shaped curve in response to tensioning of the lace 101. In this manner, the first end section 112 and second end section 114 function as a buffer or transition zone between the opposing ends 103 and the middle section 110 of the lace guide 108. As a result, the tension T that is more uniform across the lace guide 108 and less concentrated on the opposing ends 103 in comparison with the conventional lace guides 102. The uniform tension profile results in less wear and a longer life of the lace guide 108.

In some embodiments, the middle section 110 of the lace guide 108 is made of a different material than either or both the first end section 112 and the second end section 114. For example, the middle section 110 may be made of a material having significantly less elasticity than either or both first end section 112 or second end section 114. The first end section 112 and second end section 114 may be made of a material having a similar elasticity. In such an embodiment, the first end section 112 and second end section 114 may flex, stretch, or deform by a similar amount or in a similar manner in response to tensioning of the lace 101. In other embodiments, the first end section 112 may be made of a material that is different than, and/or that has a different elasticity than, the second end section 114. In such embodiments, the flexing, stretching, or deformation of the first end section 112 may be different than that exhibited or experienced by the second end section 114. For example, the middle section 110 and first end section 112 may be made of the same less elastic material while the second end section 114 is made of a more elastic material. In such embodiments, only the second end section 114 may stretch, flex, or deform to a greater degree than the middle section 110. Exemplary materials for the middle section 110 include: Nylon, Polyester, Polyethylene, Polypropylene, etc. Exemplary materials for the first end section 112 and/or second end section include: Nylon that is blended with Lycra®, Spandex, Elastane, etc.; Thermoplastic Polyurethane (TPU); Teflon™, Vulcanized Rubber; etc.

The first end section 112, middle section 110, and second end section 114, are formed so that the lace guide 108 is a single and solitary guide rather than three separate guides or materials positioned adjacent one another. The single and solitary lace guide 108 may be formed by weaving the more elastic materials of the first end section 112 and second end section 114 with the less elastic material of the middle section 110. In this manner, the elastic materials of the first end section 112 and second end section 114 may be integrally formed with the less elastic material of the middle section 110. In other embodiments, the first end section 112 and/or second end section 114 may be separate material layers from the middle section 110. In such embodiments, the separate material layers may be coupled with a common backing via heat pressing, RF or sonic welding, and the like.

In yet other embodiments, the middle section 110, the first end section 112, and the second end section 114 may be made of the same material. The increased elasticity of the first end section 112 and or second end section 114 may be formed or constructed by varying the weave or pattern of the material. For example, the middle section 110 may have a relatively tight weave or pattern of the material while the first end section 112 and/or second end section 114 have a relatively loose weave or pattern. This may allow the first end section 112 and/or second end section 114 to stretch or flex to a greater degree even though the lace guide 108 is made entirely of a single material.

The middle section 110 may also aid in preventing bunching of the lace guide 108 toward the center of the guide. For example, the less flexible material of the middle section 110 may reinforce the guide 108 and help counteract inward forces that are exerted on the opposing ends 103 due to tensioning the lace 101. The middle section 110 may be engineered to counteract such forces by weaving the material in an engineered manner and/or by selecting appropriate materials that are able to resist compressive forces. The decreases bunching of the guide 108 may help maintain a uniform tension T laterally across the guide 108.

Figure 4A:
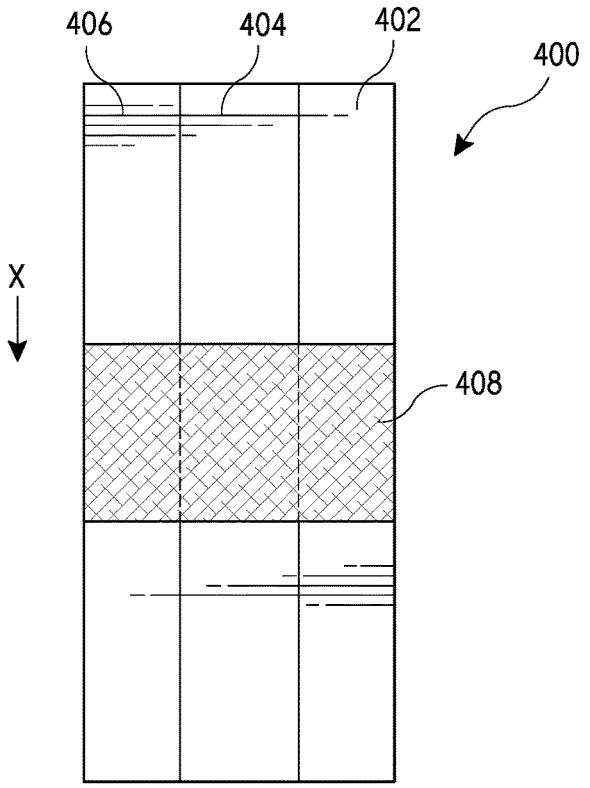
FIGS. 4A-C illustrate a lace guide that is configured to provide a decreased frictional engagement between the lace guide and a lace that is inserted through the lace guide.
Figure 4B:
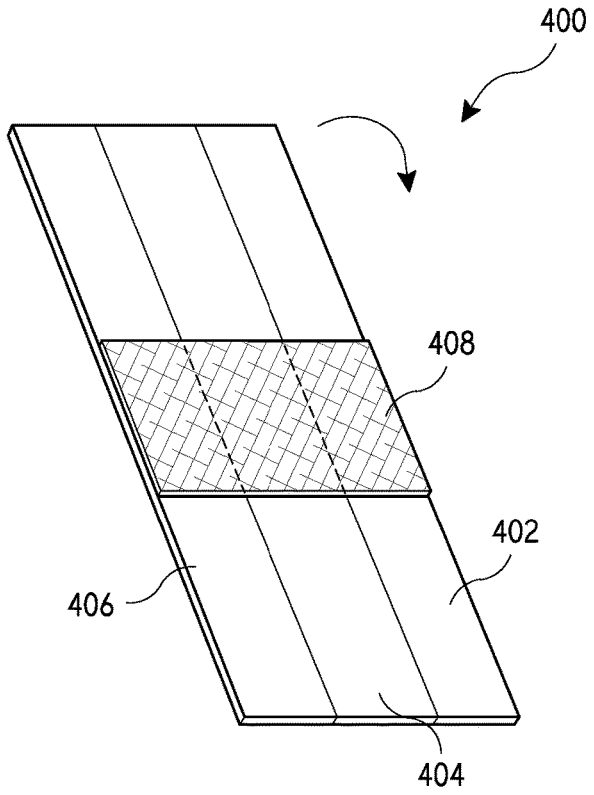
Figure 4C:
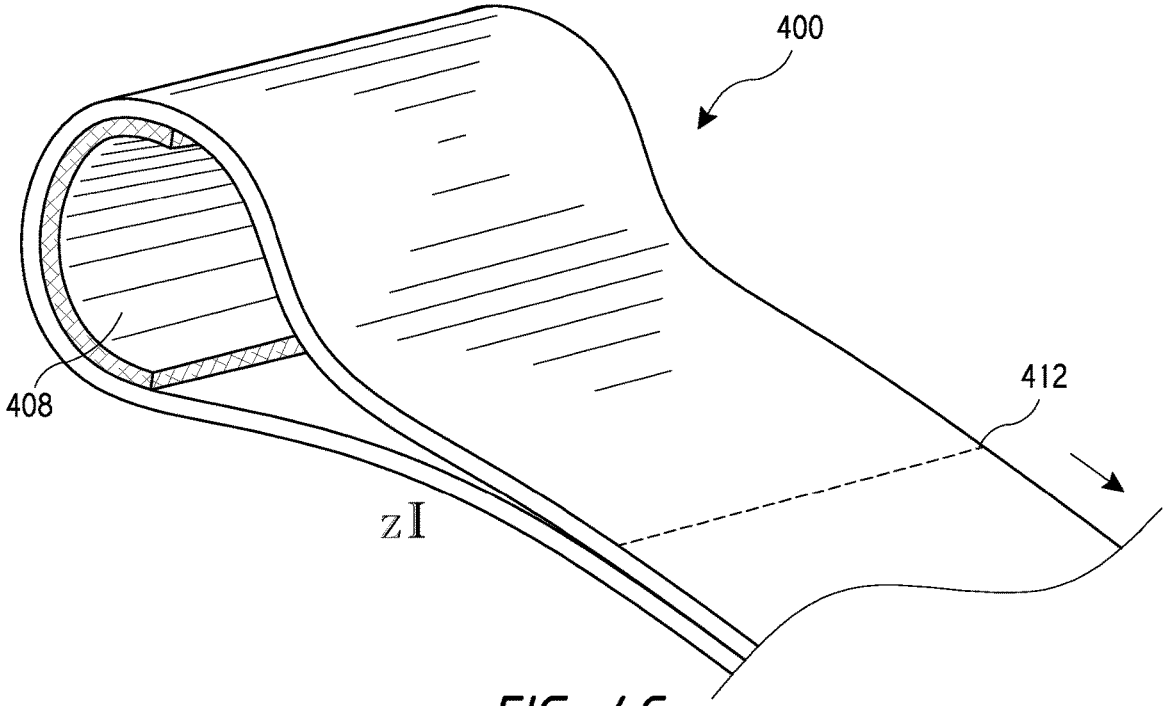

Referring now to FIGS. 4A-C, illustrated is an embodiment of a lace guide 400 that is configured to provide a decreased frictional engagement between the lace guide 400 and a lace inserted through the lace guide. The lace guide 400 may be a lace guide that is made of a single material, such as the lace guide 102 of FIG. 1A, or may be a lace guide that is made of multiple materials or sections, such as the lace guide 108 of FIG. 1B. FIGS. 4A and 4B illustrate the lace guide 400 having a middle section 404, a first end section 402, and a second end section 406. Each of these sections may be made of the same material or different materials as previously described.

The use of the more elastic materials, such as in the lace guide 108 of FIG. 1B, may increase the frictional engagement of the lace and lace guide due to the increase deformation or stretching of the elastic material. To counteract this increased frictional engagement, or to merely decrease the frictional engagement of any lace guide, the lace guide 400 includes a low friction material 408 that is positioned laterally across the middle section 404, the first end section 402, and the second end section 406. In some embodiments, the low friction material 408 may extend laterally across the lace guide 400 between the opposing ends. In other embodiments, the low friction material 408 may extend outward from the opposing ends of the lace guide 400 or may terminate shy of the opposing ends so that the low friction material 408 is entirely enclosed within the lace guide 400 between the opposing ends (not shown).

The low friction material 408 typically extends along only a portion of a longitudinal length of the lace guide 400 (e.g., X direction) rather than along the entire longitudinal length of the lace guide 400. Stated differently, the low friction material 408 is typically shorter longitudinally then the lace guide 400. This configuration may reduce the overall thickness of the lace guide 400 when the lace guide his coupled or attached to a shoe. For example, FIG. 4C illustrates that when the guide 400 is folded over on itself, a thickness Z is reduced due to the low friction material 408 not extending to where the opposing surfaces of the material make contact (i.e., near point 112). This configuration also reduces the amount of low friction material that is required, which may reduce manufacturing costs and/or increase manufacturability. In other embodiments the low friction material 408 may extend along the entire longitudinal length of the lace guide 400 as desired.

In any embodiment, the low friction material 408 is typically attached or coupled with the inner surface of the lace guide 400. As illustrated in FIG. 4C, the low friction material 408 is positioned so as to be centrally located within a loop 410 formed in the lace guide 400. The low friction material 408 extends substantially or nearly entirely around the loop 410 formed in the lace guide 400 so as to be in direct contact with a lace (not shown) that is positioned within the loop 410 of the lace guide 400. In this manner, the lace contacts and slides against and along the low friction material 408 rather than against and along the middle section 404, the first end section 402, and or the second end section 406. Because the low friction material 408 has a lower coefficient of friction than either the middle section 404, the first end section 402, or the second end section 406, the frictional engagement of the lace and a lace guide 400 is significantly reduced. Exemplary materials that may be used for the low friction material 408 include: Polytetrafluoroethylene (Teflon™); Polypropylene; High-density Polyethylene (HDPE); Ultra High Molecular Weight Polyethylene (Dyneema®); etc.

As further illustrated in FIG. 4C, the low friction material 408 terminates short of a stitch or coupling line 412, which represents a point of line at which the lace guide 408 is attached to footwear or another article. In this manner, the thickness Z of the lace guide 408 at the stitch or coupling line is reduced or minimized.

Figure 6:
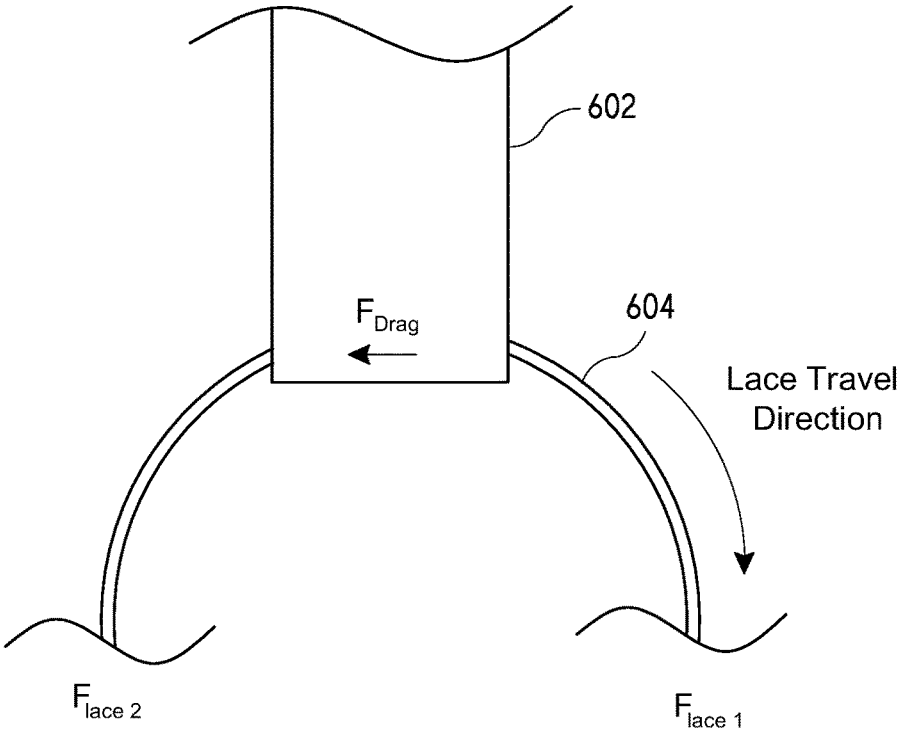
FIG. 6 illustrates a lace guide with a lace inserted through the lace guide so as to be guided and directed thereby.

Referring now to FIG. 6, illustrated is a lace guide 602 with a lace 604 inserted through the lace guide 602 so as to be guided and directed thereby. As illustrated when the lace 604 is tensioned, a force $F_{lace1}$ is exerted on one end of the lace 604 while a force $F_{lace2}$ is exerted on the opposite end of the lace 604. Tensioning of the lace 604 causes a frictional engagement of the lace 604 and the lace guides 602. The frictional force exhibited between the lace 604 and the lace guide 602 may be a dynamic force that is dependent on one or more of the following factors: the lace tension, the material of lace guides 602, the sliding of the lace 604 through the lace guides 602, and various other factors. In some instances, the frictional force may be more equivalent to a frictional drag force rather than a conventional frictional force experienced between two solid objects. The frictional engagement of the lace 604 and the lace guide 602 is denoted as $F_{Drag}$. The force $F_{lace2}$ is essentially equivalent to the force $F_{lace1}$ and the frictional engagement $F_{Drag}$ of the lace 604 and lace guide 602.

The frictional engagement $F_{Drag}$ between the lace 604 and the lace guide 602 may cause a "loading" of lace tension in a distal portion or end of the lacing system. For example, referring briefly to FIG. 7, as the lace 704 is tensioned, the lace 704 may slide through the lace guides, 706 & 708, that are positioned in the upper portion of the lace path as the lace urges opposing eyestays of the shoe together. The lace 704 similarly slides through the lace guides, 710 & 712, positioned in the middle portion of the lace path, and slides through the lace guides, 714 & 716, positioned in the lower portion of the lace path, but the lace 704 slides through these lace guides to a lesser degree respectively due to the loss in lace tension as a result of frictional engagement with the respective lace guides.

Figure 7:
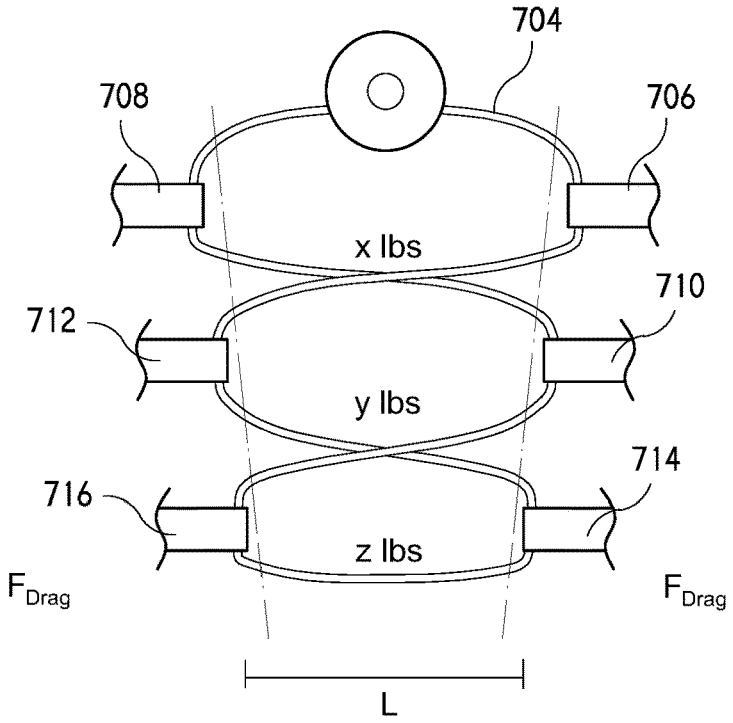
FIG. 7 illustrates effects of frictional engagement between a lace and a lace guide along a lace path of an article.

As the user flexes their foot in the footwear, such as by walking, running, bending, and the like, the footwear's tongue is typically flexed forward and into engagement with the upper portion of the lace 704—i.e., the portion of the lace 704 disposed near the guides, 706 & 708, positioned in the upper portion of the lace path. The result is a temporary increase in lace tension that causes the lace 704 to slide through each of the guides, 706-716. In some instances, the opposing eyestays near the upper portion of the lace path may flex outward while the opposing eyestays near the lower portion of the lace path are pulled inward, which may result in the opposing eyestays having a V-shape or other non-parallel shape as illustrated in FIG. 7.

Due to the frictional engagement of the lace 704 and the lace guides 706-716, the lace tension along the lace path may not be able to equalize and/or return to a relatively uniform state and thus, lace tension may be trapped or captured in the lower portion of the footwear. For example, since the frictional engagement $F_{Drag}$ of the lace 704 and lace guides 706-716 is a function of the lace tension, once the lace tension in the lower portion of the lace path is temporarily increased, the frictional engagement $F_{Drag}$ of the lace 704 and lower lace guides, 714 and 716, is correspondingly increased. The increased frictional engagement $F_{Drag}$ of the lace 704 and lower lace guides, 714 and 716, may affect the lace's ability to slide within the lower lace guide, 714 and 716, thereby locking or maintaining an increased lace tension in the lower portion of the lace path relative to the other portions of the lace path. Stated differently, if the temporary increase in lace tension causes an amount X of lace 704 to slide within the lower lace guides, 714 and 716, toward the upper lace path and lace guides, the increased frictional engagement $F_{Drag}$ of the lace 704 and lower lace guides, 714 and 716, may result in an amount X minus Y (i.e., X-Y) sliding within the lower lace guides, 714 and 716, in the opposite direction (i.e., away from the upper lace path and lace guides), where Y represents some nominal non-zero amount.

The result is that the length of lace L between the lower lace guides, 714 and 716, is shortened by an amount corresponding to Y, which results in an increased lace tension between the lower lace guides, 714 and 716. Stated differently, the length L represents the difference between the amount of lace (i.e., X) that slides through the lower lace guides, 714 and 716, toward the upper lace guides, 704 and 706, due to the increased lace tensioning, and the amount of lace (i.e., X-Y) that returns or slides back through the lower lace guides, 714 and 716, when the lace tension is relieved. The inability of the lace 704 to slide back through the lower lace guides, 714 and 716, when tension is relieved is due to the increased frictional engagement $F_{Drag}$ of the lace 704 and lower lace guides, 714 and 716.

As the above described process is repeated due to repeated running, walking, flexing, bending, and the like of the foot, the length of lace L between the lower lace guides, 714 and 716, may continue to be decreased, thereby resulting in a continued increase in the lace tension and shoe tightening adjacent this portion of the lace 704. A similar, although typically less dramatic, effect may occur in the middle lace guides, 710 and 712, which may result in the opposing eyestays having a constant V-shape configuration, or non-parallel shape, as illustrated in FIG. 7.

An effect of this process may be that a greater lace tension is locked, captured, or maintained in the lower portions of the lace path in comparison to the upper portions of the lace path. For example, as illustrated in FIG. 7, the lower portion of the lace path may experience a lace tension of Z lbs, whereas the middle portion of the lace path may experience a lace tension of Y lbs, and the upper portion of the lace path may experience a lace tension of X lbs. In some instances, Y lbs may be equal to X lbs plus some nominal non-zero amount, and Z lbs may be equal to Y lbs plus some nominal non-zero amount. In other instances, Y lbs and X lbs may be relatively the same and Z lbs may be appreciably greater than X lbs and/or Y lbs.

In shoes and other footwear, the result of the above described process is a pinching, tightening, or constriction of the lower portion of the lace path about a user's foot, which is commonly positioned near the toe-box. Accordingly, the user may experience some level of discomfort after extended periods of time when wearing such shoes or footwear.

The above issues may be alleviated or eliminated by employing lace guides that have an engineered amount of stretch. The engineered stretch results in some of the lace tension stretching the guide longitudinally rather than causing the lace to slide through the guide. As a result, the lace and guide system may experience less sliding of the lace through the guide and/or more stretching of the guide, in comparison with conventional guides, due to a temporary tensioning of the lace. This may result in less locking of the lace tension in the lower portion of the lace path, such as adjacent the toe box.

Figure 8:
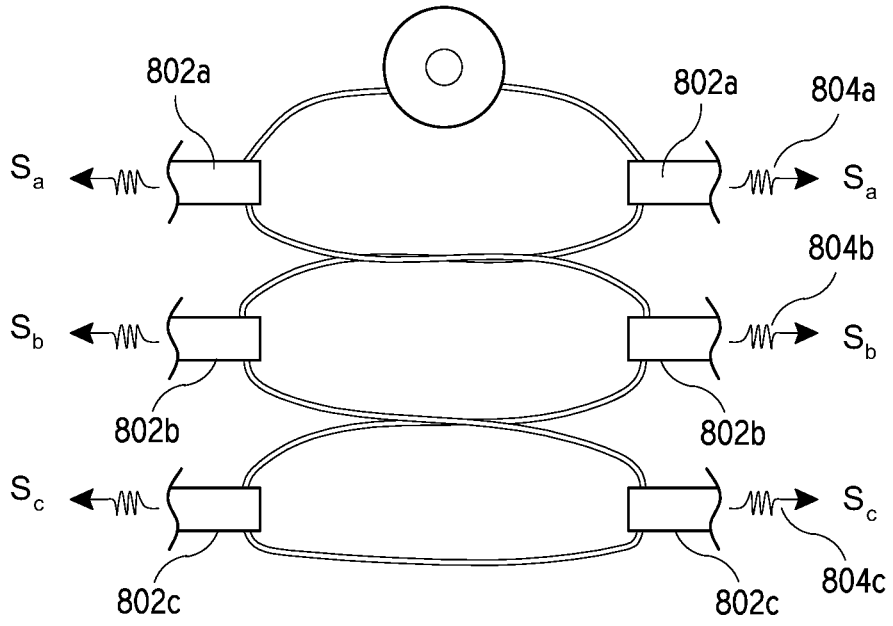
FIG. 8 illustrates a representation of an article that is fitted with lace guides having an engineered degree of stretch or elasticity.

FIG. 8 illustrates a representation of a shoe that is fitted with lace guides having an engineered degree of stretch or elasticity. Specifically, the shoe employs a first pair of lace guides 802*a* that are positioned in the upper portion of the lace path, a second pair of lace guides 802*b* that are positioned in the middle portion of the lace path, and a third pair of lace guides 802*c* that are positioned in the lower portion of the lace path. The first set of lace guides 802*a* are configured or engineered to have or exhibit a stretch $S_a$ (represented by spring element 804*a*). The second set of lace guides 802*b* are configured or engineered to have or exhibit a stretch $S_b$ (represented by spring element 804*b*) and the third set of lace guides 802*c* are configured or engineered to have or exhibit a stretch $S_c$ (represented by spring element 804*c*).

Figure 9:
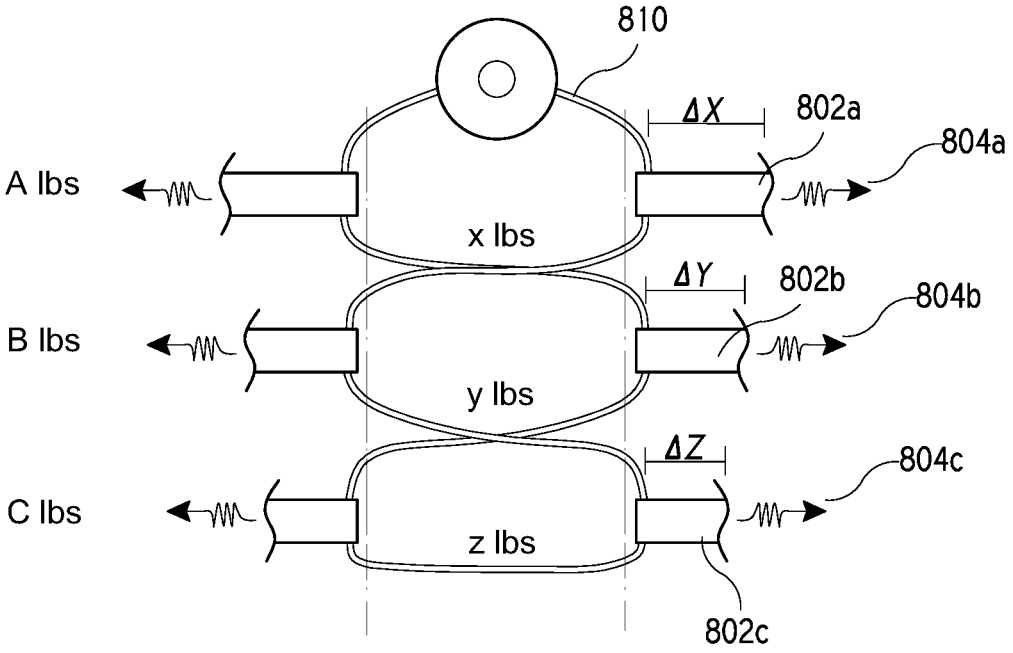
FIG. 9 illustrates the lace guides of FIG. 8 being stretched or tensioned due to tensioning of a lace.

FIG. 9 illustrates the lace guides with the engineered stretch (i.e., guides 802*a*-802*c*) being stretched due to tensioning of the lace 810. The tensioning of the lace 810 may be a temporary tensioning due to walking, running, jumping, or various other activities after the lace is initially tensioned via a reel based device or other tensioning mechanism. The temporary tensioning may cause the shoe's tongue to flare or widen in response to the foot moving within the shoe. The widening or flaring of the tongue may cause the first set of lace guides 802*a* to experience a load or tensioning force of A lbs, which causes the first set of lace guides 802*a* to elastically stretch by an amount ΔX. The widening or flaring of the tongue may similarly cause the second set of lace guides 802*b* and the third set of lace guides 802*c* to experience a load or tensioning force of B lbs and C lbs, respectively, which causes the respective guides to elastically stretch by an amount ΔY and ΔZ, respectively.

The elastic stretching of the second set of lace guides 802*b* and/or the third set of lace guides 802*c* is typically less than the elastic stretch of the first set of lace guides 802*a*, although the stretch of any of the lace guides may be engineered to exhibit a desired stretch. The elastic stretching of the lace guides, 802*a-c*, results in significantly less slippage or sliding of the lace 810 through the respective lace guide. Rather than the lace sliding through the guides, increases in the lace tension, and specifically instant and temporary lace tension increases, causes the lace guides 802*a-c* to elastically stretch. As such, dynamic changes in lace tension are transferred to and stored as spring or elastic energy in the guide rather than as the frictional force $F_{Drag}$ previously described.

The elastic stretching of the lace guides 802*a-c* results in a more parallel lace path as illustrated in FIG. 9, even when the lace tension is dynamically adjusted, such as in response to the user's foot moving within the shoe. The elastic stretching of the lace guides, 802*a-c*, also results in significantly less sliding of the lace through the lower most set of lace guides (i.e., 802*c*), which results in less lace tension being locked or captured in the lower portions of the lace path adjacent the toe box. This may increase the user's comfort in wearing the shoe.

For example, the lower portion of the lace path adjacent the third set of lace guides 802*c* may experience a lace load or tension of Z lbs while the middle portion of the lace path adjacent the second set of lace guides 802*b* experiences a lace load or tension of Y lbs and the upper portion of the lace path adjacent the first set of lace guides 802*a* experiences a lace load or tension of X lbs. The lace loads or tensions, X lbs, Y lbs, and Z lbs may be more uniform and/or similar than those experienced in shoes that employ conventional lace guides and thus, the shoes may be more comfortable to wear.

While FIG. 9 illustrates the lace path employing three sets of guides with an engineered stretch, it should be realized that the lace path may employ more or fewer lace guide sets as desired. Also, in some embodiments it may be possible to utilize the stretch of the lace guides to lock in lace tension in a desired area. For example, the lace may be initially tensioned by a desired amount in one portion of the shoe and the lace tension may be locked or maintained in that portion of the shoe via the elastic stretching of the lace guides. For example, a lace guide with a desired engineering stretch may be employed in the middle portion of the shoe and used to separate the lace tension in the lower portion of the shoe from the upper portion of the shoe. The stretching of the lace guide may ensure that lace tensions in the upper portion of the shoe are not transferred to the lower portion of the shoe and vice versa. The stretchable lace guides may be employed in various configurations with non-stretchable lace guides as desired to achieve any desired fit and/or performance of the shoe.

Figure 2A:
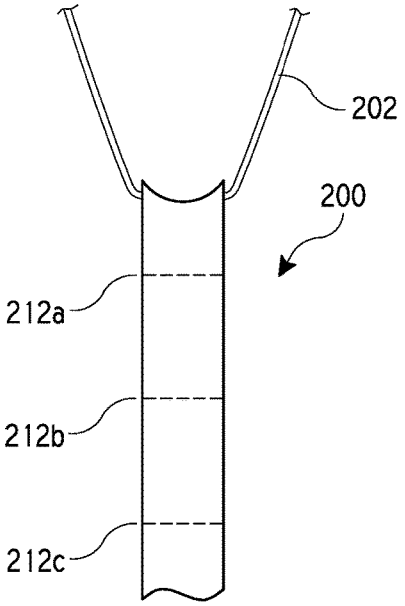
FIGS. 2A-C illustrate additional lace guides that may be used to route or direct a tension member or lace about a path of an article.
Figure 2B:
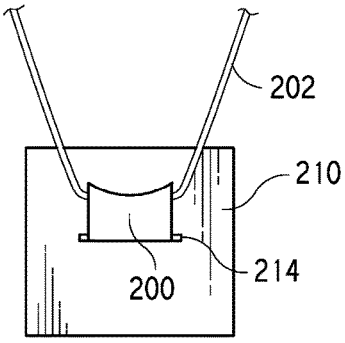
Figure 2C:
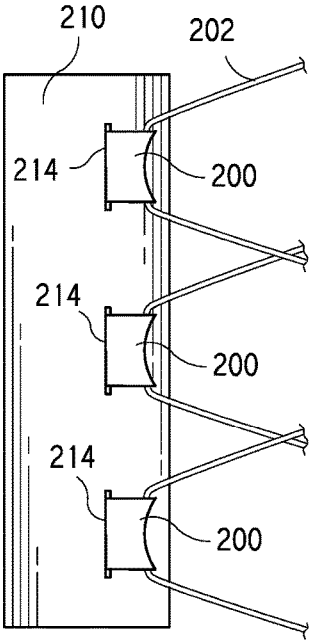

Referring now to FIGS. 2A-C, illustrated are embodiments of lace guides 200 that may be employed on a shoe. The lace guides 200 may be similar to any of those described herein, such as by employing a less frictional inner surface or liner and the like. As illustrated in FIG. 2A, the lace guide 200 includes an elongated body. The elongated body may have an engineered stretch as previously described. In some embodiments, the engineered stretch may vary along the longitudinal length of the guide 200, such as by being more flexible or more stiff near the lace 202.

The lace guide 200 is designed to be attached to the shoe along its longitudinal length in order to achieve a designed effect. For example, the lace guide 200 may be attached to the shoe at a first point 212*a* that is near the lace 202, at a second point 212*c* that is near the shoe's sole, and/or at a third point 212*b* that is positioned between the first point 212*a* and the second point 212*c*. Attaching the lace guide 200 to the shoe at these or various other points effects how the lace guide 200 functions within the shoe as further described in FIGS. 3A-B. FIG. 2B illustrates that the lace guide 200 may be coupled with the shoe so that a main body of the lace guide 200 is disposed under an upper 210 of the shoe and so that a distal end of the lace guide 200 protrudes through a slit or opening 214 of the upper 210. FIG. 2C illustrates that multiple lace guides 200 may be attached to the shoe in the manner illustrated in FIG. 2B. This configuration may be employed so that the majority of the lace guide 200 remains hidden from view.

Figure 3A:
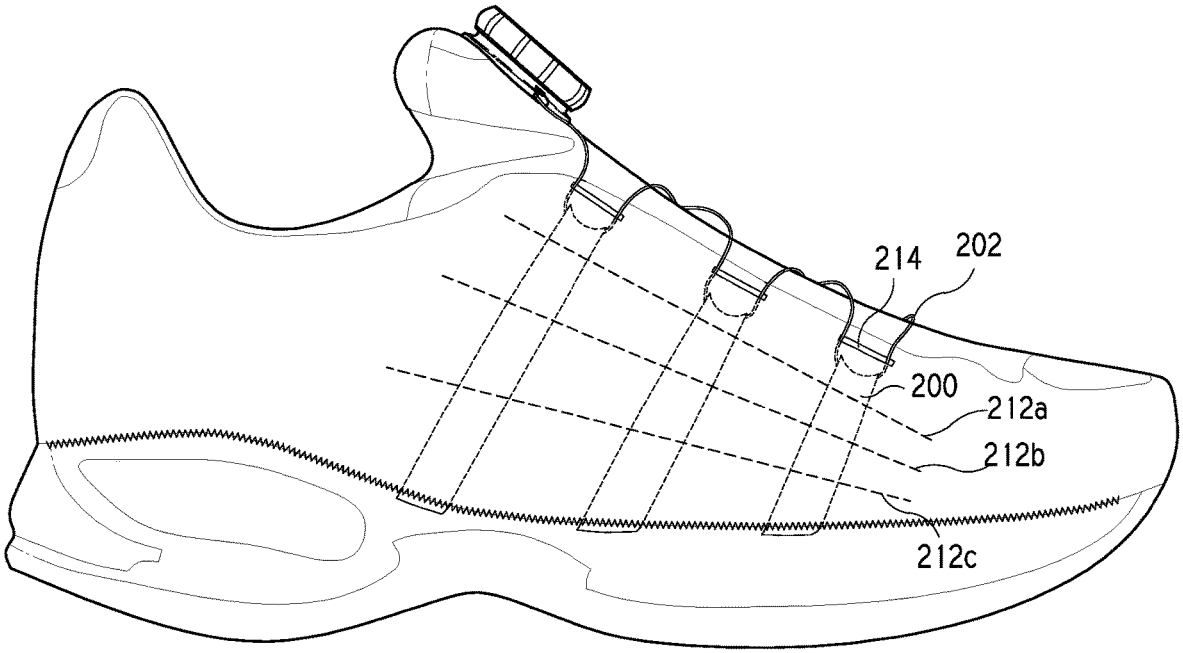
FIGS. 3A-B illustrate the lace guide of FIG. 2A attached to the upper of a shoe.
Figure 3B:
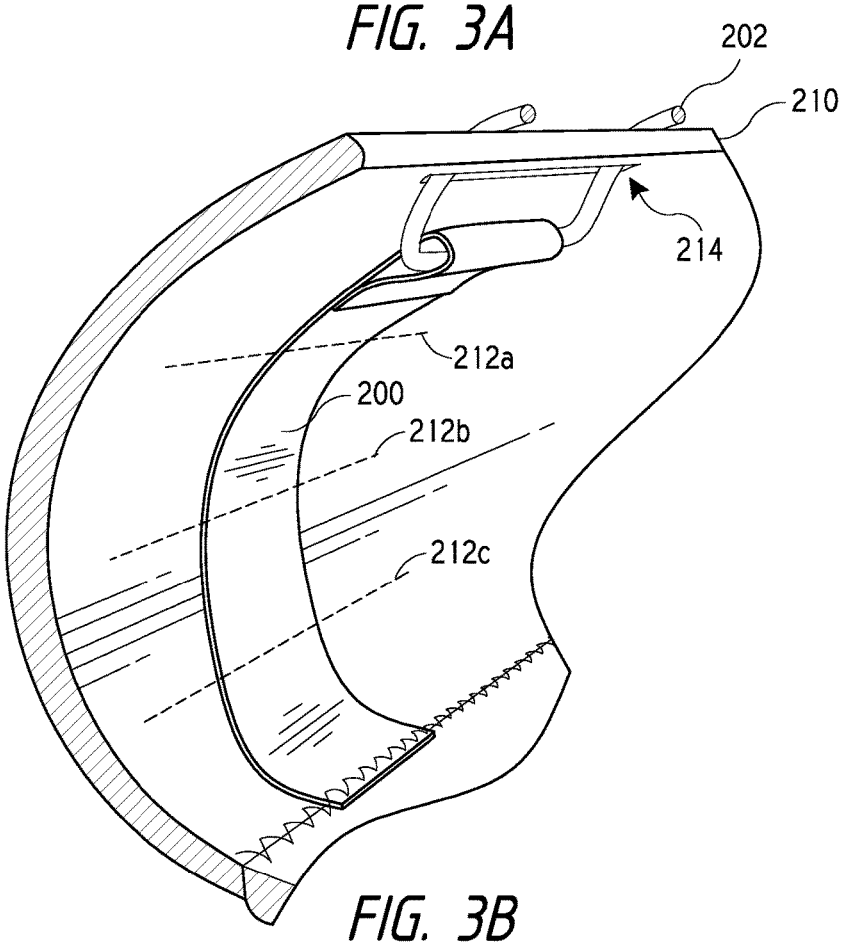

Referring now to FIGS. 3A-B, illustrated is the lace guide 200 attached to the upper 210 of a shoe. FIG. 3B shows the inner surface of the upper 210 and various points that the lace guide 200 may be attached to the inner surface of the upper 210. Specifically, FIG. 3B illustrates a first coupling point 212*a*, a second coupling point 212*c*, and a third coupling point 212*b* as previously described. Coupling the lace guide 200 at one of the various points effects how the lace guide 200 functions. For example, if the lace guide is attached to the upper 210 at the first coupling point 212*a*, the elastic stretch of the lace guide 200 is decreased and/or the force of the lace guide 200 on the upper 210 is exerted closer to the shoe's tongue. In contrast, if the lace guide 200 is attached to the upper 210 at the second lace coupling point 212*b*, the elastic stretch of the lace guide 200 is significantly greater and/or the force of the lace guide 200 on the upper 210 is exerted closer to the shoe's sole.

Unlike the illustration of FIG. 2B, the lace guide 200 is illustrated in FIGS. 3A-B as being entirely disposed underneath the upper 210. In this configuration, the lace 202 extends from the lace guide 200 and through the slit 214 in the upper 210. The configuration of FIGS. 3A-B ensures that the lace guide 200 is entirely hidden from view, which may be visually appealing or desired amongst some users.

Figure 5:
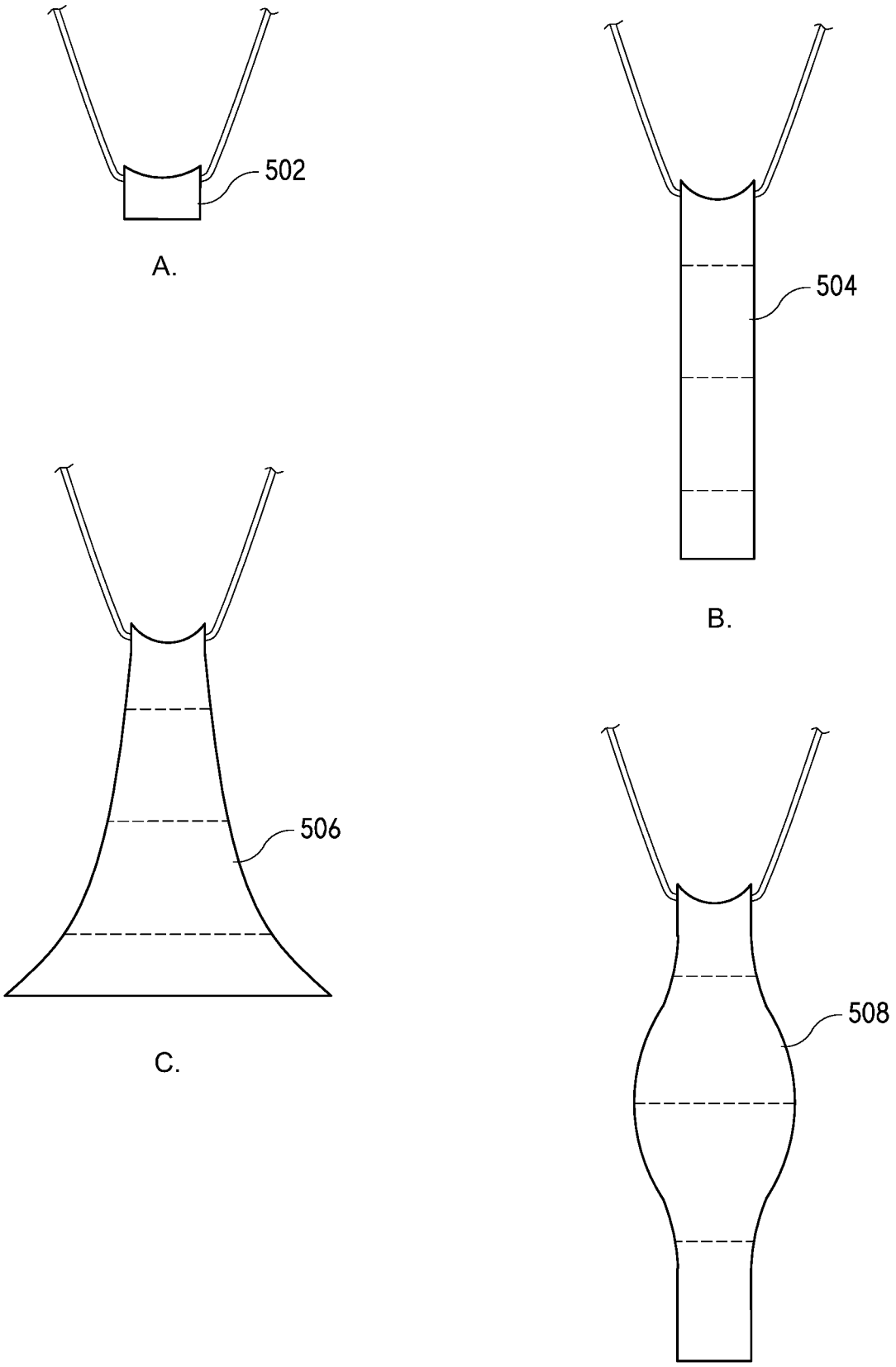
FIG. 5 illustrates various lace guide configurations that may be employed to achieve a desired tensioning of an article.

FIG. 5 illustrates various lace guide configurations that may be employed to achieve a desired tensioning of an article, such as a shoe. For example, a relatively short lace guide 502 may be employed when minimal attachment space is available and/or when little to no stretch of the lace guide is desired. In other embodiments, an elongated lace guide 504 may be employed when significantly more stretching is desired and/or when it is desirable to distribute the closure force along a length of the shoe. In other embodiments, a lace guide 506 may be employed that has a wider bottom portion in comparison with an upper portion. This lace guide 506 may be employed when it is desirable to distribute the closure force laterally about the shoe and specifically about the bottom portion of the guide 506. In yet other embodiments, a lace guide 508 may have a reverse hourglass configuration having a wider midsection than either the top or bottom sections. This configuration may be employed when tensioning of a middle portion of the shoe is desired.

Figure 10A:
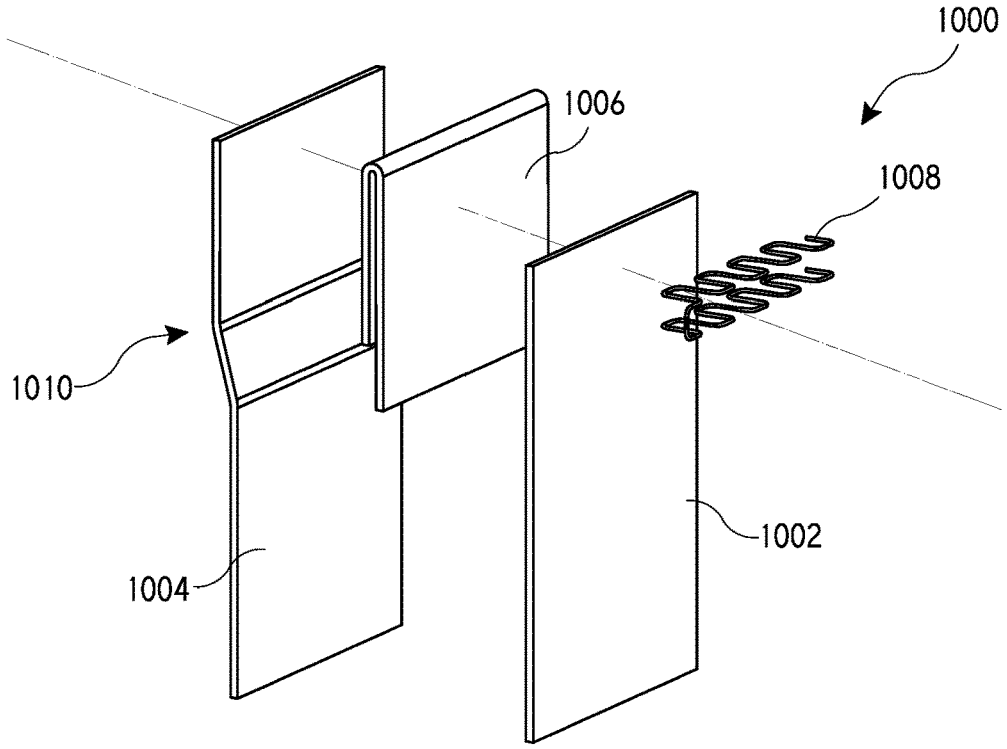
FIGS. 10A-C illustrate a lace guide that is configured to be easily and quickly attached to an article.
Figure 10B:
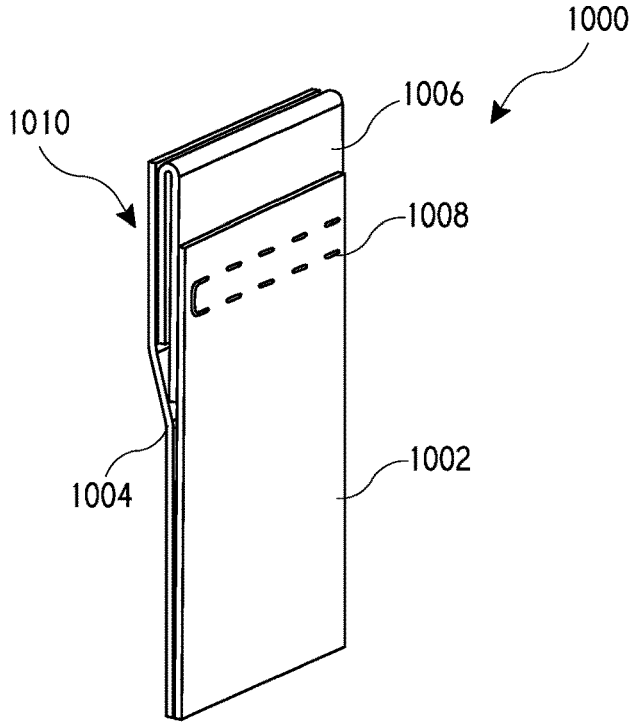
Figure 10C:
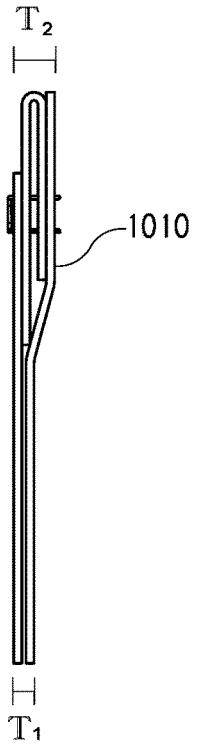

Referring now to FIGS. 10A-C, illustrated is an embodiment of a tension member guide or lace guide 1000 (hereinafter lace guide 1000) that is configured to be easily and quickly attached to an article, such as a shoe, and that is configured to direct or route a tension member or lace about a path of the article. The lace guide 1000 includes a first material member or inner member 1004 (hereinafter inner member 1004), a second material member or middle member 1006 (hereinafter middle member 1006), and a third material member or outer member 1002 (hereinafter outer member 1002). The inner member 1004 includes a longitudinal length, a lateral width, a first face that is positionable against the article, and a second face that is opposite the first face. The middle member 1006 is typically positioned between and coupled to the outer member 1002 and the inner member 1004, although in some embodiments the outer member 1002 may be omitted. The middle member 1006 functions as the component of the lace guide 1000 that contacts the lace (not shown) and guides or routes the lace along a path of the article. The middle member 1006 is typically made of a less frictional material in comparison with the outer member 1002 and the inner member 1004, since the middle member 1006 operationally contacts or engages the lace.

In some embodiments, the middle member 1006 comprises an outer material layer and an inner material layer, similar to the configuration illustrated in FIG. 4A. The outer material layer may be a more firm or rigid material than the inner material layer in order to reinforce or structurally support the inner material layer. The inner material layer may be the low frictional material that engages and directly contacts the lace. In an exemplary embodiment, the outer material layer may be a Nylon material and the inner material layer may be a Teflon material. In other embodiments, the middle member 1006 may be a single material layer that is both low friction and structurally strong. For example, the middle member 1006 may be a Nylon/Teflon blend material layer.

In any embodiment, the middle member 1006 is sandwiched between and coupled to the outer member 1002 and the inner member 1004. The middle member 1006 is folded along a longitudinal length to form a loop or channel within which the lace is inserted. The looped middle member 1006 has a center portion and two end portions along a lateral width with the two end portions being disposed on opposite sides of the center portion as illustrated. When coupled with the outer member 1002 and the inner member 1004, the middle member 1006 is longitudinally shorter than the outer and inner members as illustrated. This configuration allows a proximal end of the lace guide 1000 to be thinner than a distal end of the lace guide 1000. Specifically, FIG. 10C illustrates a side profile of the lace guide 1000 and shows that the proximal end of the lace guide 1000 has a thickness $T_1$, which is significantly thinner than a thickness $T_2$ of the distal end of the lace guide 1000. The middle member 1006 may be positioned between the outer member 1002 and the inner member 1004 so that opposing ends of the middle member 1006 are offset from one another as shown. This configuration provides a gradual transition, rather than an abrupt transition, between the thicker distal end $T_2$ and the thinner proximal end $T_1$. As illustrated, when the middle member 1006 is coupled with the inner member 1004, the middle member 1006 is longitudinally aligned with the inner member 1004 and is positioned atop of the second face of the inner member 1004.

FIG. 10B illustrates the assembled components of the lace guide 1000. As illustrated, the outer member 1002 and the inner member 1004 typically do not extend or fold over the middle member 1006 so that a top or looped end of the middle member 1006 remains exposed. In this configuration, the middle member 1006, which is the component of the lace guide 1000 that directly contacts and guides/routes the lace may be unencumbered by the outer and inner members, 1002 and 1004. As such, the middle member 1006 may be free to flex, bend, adjust, or conform to the lace as the lace is tensioned. In such embodiments, the outer member 1002 and the inner member 1004 may be used mainly to reinforce the middle member 1006 and/or to attach the middle member 1006 to the article. In some instances, the middle member 1006 may be pivotable outward from the inner member 1004 along a coupling line formed via stitching 1008. In other embodiments, the outer member 1002 and the inner member 1004 may extend partially or fully over the middle member 1006 as desired. In some embodiments, a top end of the outer member 1002 may be positioned proximally of the top or looped end of the middle member

1006. A top end of the inner member 1004 may be substantially even with the top or looped end of the middle member 1006.

Since the lace guide 1000 is made of several components, stitching 1008 may be used to initially attach the various components together. The stitching 1008 may be inserted through the outer member 1002 and inner member 1004 and through a proximal portion of the middle member 1006. In other embodiments, the various members may be initially coupled via welding (heat, RF, sonic, and the like), adhesive bonding, mechanical fastening, or via any other known method. The proximal ends of the outer member 1002 and the inner member 1004 may be similarly attached via stitching, welding, bonding, and the like.

An inner surface 1010 of the inner member 1004 is configured to easily and quickly couple with the article. For example, the inner surface 1010 of the inner member 1004 may include an adhesive layer that enables the inner member 1004 to quickly attach to an article via heat welding, sonic welding, adhesive bonding, and the like. In a particular embodiment, the lace guide 1000 may be attached to the inner surface of a shoe's upper (not shown) by positioning the inner surface 1010 of the inner member 1004 against the inner surface of the upper and welding the two inner surfaces together. Specifically, the inner surface 1010 may include a TPU material that allows the guide 1000 to be heat welded to the surface of the article.

Lace guide 1000 is a unitary component that may be quickly and easily attached to an article to form a path for routing or guiding a lace about the article. In some embodiments, the middle member 1006 may be configured to more uniformly distribute lace tension as described herein.

A method of coupling the lace guide 1000 with an article includes providing a lace guide 1000 having a configuration as described above and coupling the lace guide 1000 with the article. The method also typically includes inserting a tension member through the loop or channel formed in the middle member 1006. Coupling the lace guide 1000 with the article may include heat welding the inner member 1004 to the article.

Figure 11A:
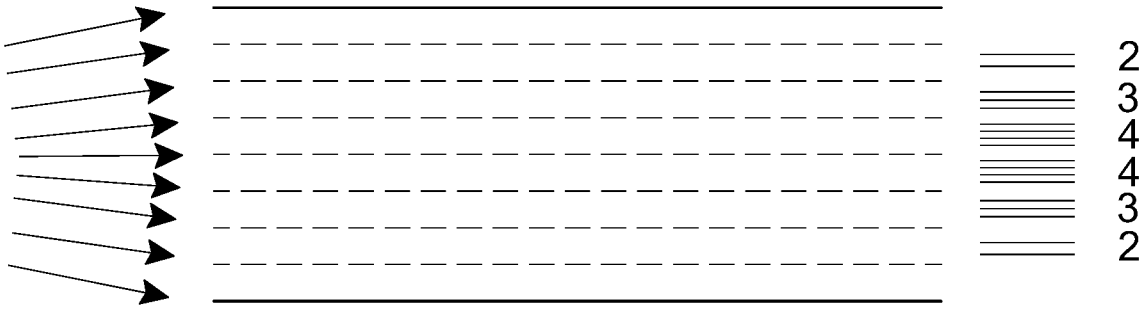
FIGS. 11A-C illustrate a lace guide that exhibits an engineered flex or stretch in response to tensioning of a lace.
Figure 11B:
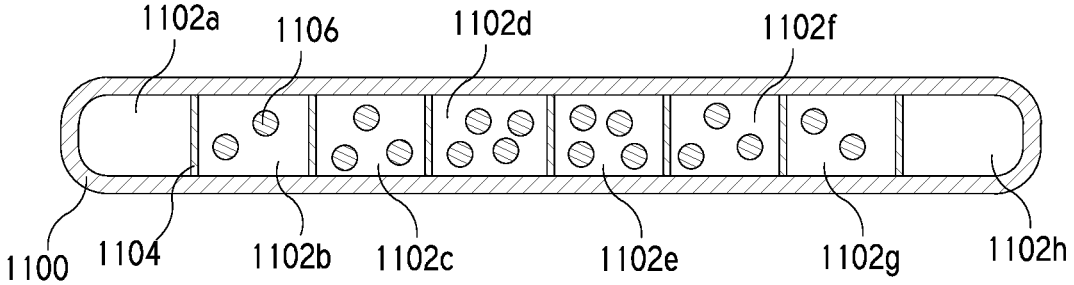
Figure 11C:
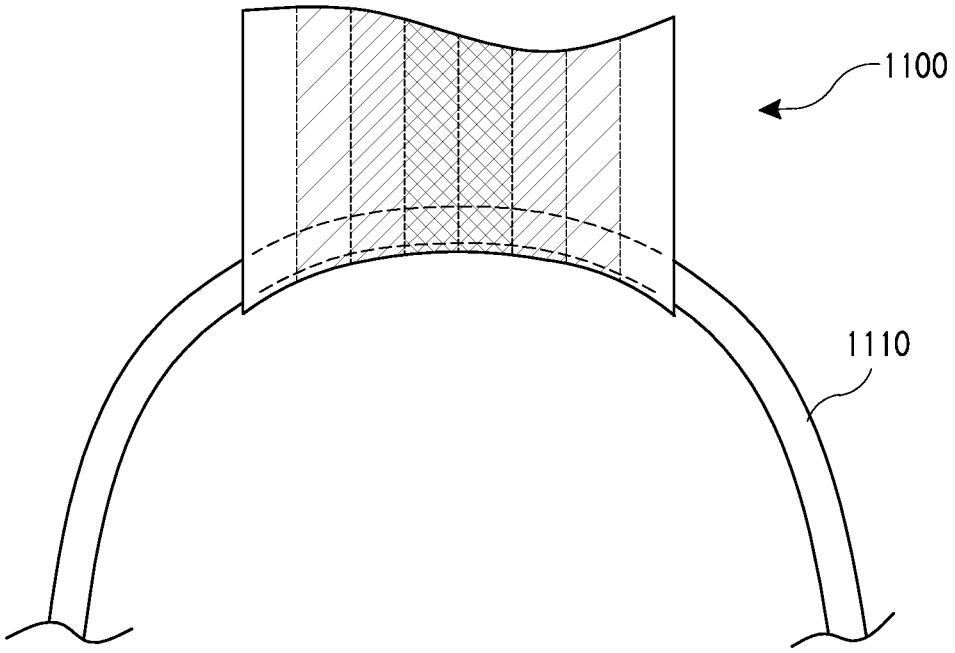

Referring now to FIGS. 11A-C, illustrated is an embodiment of a tension member guide or lace guide 1100 (hereinafter lace guide 1100) that exhibits an engineered flex or stretch. The lace guide 1100 is configured to direct or route a tension member or lace about a path of an article. The engineered flex of the lace guide 1100 is formed via individual channels or lumens 1102 that are formed in a body of the lace guide 1100. The individual channels or lumens 1102 extend between a proximal end and a distal end of a material body of the lace guide 1100. The lace guide 1100 is woven in a manner that forms the individual channels or lumens 1102 within the material body. The weft or fabric threads form walls 1104 in the fabric body that separate each of the individual channels 1102. FIGS. 11A-C illustrate the lace guide 1100 having eight separate channels—i.e., channels 1102*a*-1102*h*, although it should be realized that more or fewer channels 1102 may be formed as desired.

As illustrated in FIG. 11C, the material body of the lace guide 1100 is folded between the proximal end and the distal end to form a loop or channel within which a tension member or lace 1110 (hereinafter lace 1110) may be inserted. The looped end of the material body has a central portion and opposing ends or end portions that are disposed on opposite sides of the central portion as illustrated. The lace guide 1100 is configured to have more flexibility toward or at the opposing ends in comparison with the central portion of the lace guide 1100. This configuration enables the lace guide 1100 to curve and conform to the lace 1110 as the lace is tensioned, which results in a more even distribution of the lace tension over the lateral width of the lace guide 1100.

The increased flexibility of the opposing ends is achieved by stuffing or positioning a reinforcement material (e.g., fibers) within at least one channel 1102, and more commonly various channels 1102, of the lace guide's material body. The reinforcement material functions to reinforce the channels 1102 of the lace guide 1100 within which the reinforcement is positioned. FIG. 11B illustrates that fibers or fiber bundles 1106 are inserted within some or all of the lace guide's channels 1102 in varying degrees. The stiffness of an individual channel 1102 increases as the number of fibers 1106 that are inserted within the channel—i.e., the fiber density within the channel—increases. Stated differently, the flexibility of an individual channel decreases as more and more fibers 1106 are positioned within the channel. This is due to the inserted fibers functioning to reinforce a respective channel, which increases the stiffness and decreases the flexibility of the respective channel. As shown in FIG. 11B, the lace guide 1100 may be formed so that the central channels (i.e., channels 1102*d* and 1102*e*) have the greatest density of fibers 1106 (i.e., the most fibers 1106 positioned with the channel). The two channels immediately adjacent the central channels (i.e., channels 1102*c* and 1102*f*) may have a slightly lower fiber density and the next two immediately adjacent channels (i.e., channels 1102*b* and 1102*g*) may have an even lower fiber density. The two outer channels (i.e., channels 1102*a* and 1102*g*) may have the lowest fiber density of all the channels. In this manner, the fiber density of the individual channels may gradually decrease laterally from the central portion of the lace guide 1100. As a results, as the lace 1110 is tensioned, the lace guide 1100 may flex and conform laterally outward from the central portion of the lace guide 1100 in an engineered manner. The engineered flex or curvature may be designed to uniformly distribute the lace tension laterally across the lace guide 1100, which may greatly reduce lace wear on the guide.

The fibers 1106 are typically positioned within the channels 1102 during weaving or formation of the lace guide 1100. FIG. 11A illustrates a representative embodiment of the fibers that may be positioned within the lace guide 1100. Specifically, FIG. 11A illustrates that four fibers or fiber bundles may be positioned within the two central channels (1102*d* and 1102*e*), three fibers/fiber bundles may be positioned within the immediately adjacent channels (1102*c* and 1102*f*), two fibers may be positioned within the next laterally adjacent channels (1102*b* and 1102*g*), and the two lateral most channels (1102*a* and 1102*h*) may be free of any fibers. The embodiment of FIG. 11A is for illustrative purposes only and is not intended to limit the lace guide 1100 to any specific configuration. Rather, as one of skill will recognize, the channel arrangement and fiber density may be varied as desired to achieve a desired flex or curvature of the guide in response to lace tensioning.

The increasing fiber density toward the central portion of the lace guide 1100 also aids in preventing bunching of the lace guide 1100 toward the center of the guide. For example, since the central channels are "stuffed" with more fibers, these channels are more readily able to resist inward compressive forces that are exerted on the lace guide 1100 by the lace 1110 under tension. The fiber density in the individual channels, 1102*a*-1102*h*, may be engineered to counteract the inward compressive forces and/or to provide a curvature or flex of the guide as desired. The decreased bunching of the guide 1100 and/or engineered flex/curvature may help maintain a uniform tension or load laterally across the guide 1100.

In some instances, the inner surface of the lace guide 1100 may include a low friction material that reduces frictional engagement of the lace 1110 and lace guide 1100. For example, the inner surface of the lace guide 1100 may have a configuration similar to FIGS. 4A-C where a low friction material is positioned within a looped end of the guide 1100.

A method of coupling the lace guide 1100 with an article includes providing a lace guide 1100 having a configuration as described herein and coupling the lace guide 1100 with the article. The method also typically includes inserting the lace 1110 within the loop or channel formed in the folded material body of the lace guide 1100.

Figure 12:
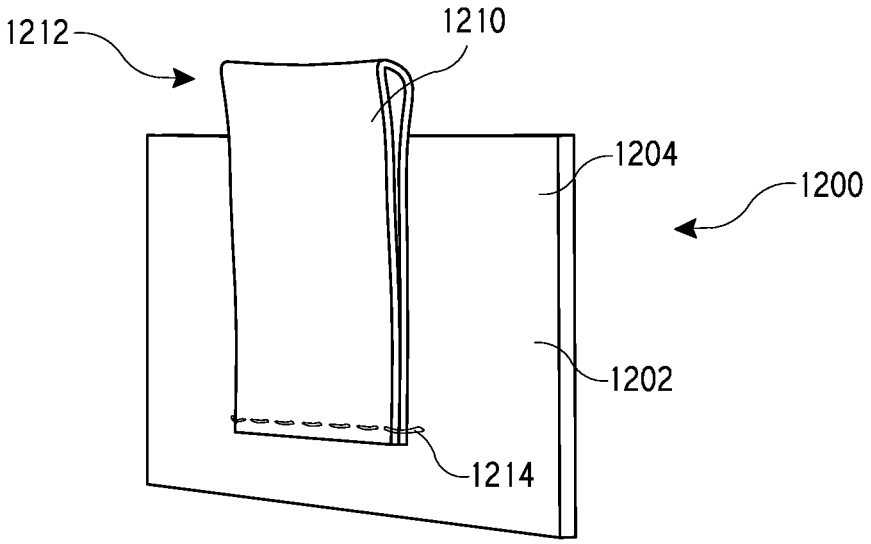
FIG. 12 illustrates a component that enables a lace guide to be quickly and easily attached to an article.

Referring now to FIG. 12, illustrated is an embodiment of a component 1200 that enables a lace guide to be quickly and easily attached to an article, such as a shoe. The component 1200 includes an attachment member 1202 and a guide member 1210. The guide member 1210 is folded over to form a loop 1212 through which a lace or tension member (not shown) is inserted. Opposing ends of the guide member 1210 are attached to the attachment member 1202 via stitching 1214, adhesive bonding, welding (e.g., RF, heat, sonic, and the like), or via any other attachment method. An inner surface 1204 of the attachment member includes a material that aids in coupling the attachment member 1202 with the article. For example, the inner surface 1204 of the attachment member 1202 may include TPU or another material that aids in heat welding the attachment member 1202 to the article. The inner surface 1204 may likewise include a pressure and/or heat sensitive material that aids in coupling the component 1200 with the article.

The attachment member 1202 provides a larger surface area that distributes any force or load applied to the guide member 1210 over a larger surface area, which helps ensure that the component 1200 does not detach from the article. In some embodiments, the surface that is opposite the inner surface 1204 (i.e., the outer surface) includes the attachment material. In such embodiments, the inner surface 1204 may be free of the attachment material. The component 1200 may be manufactured as separate individual units, which may be individually positioned about the article and coupled therewith to form a lace path about the article.

Figure 13A:
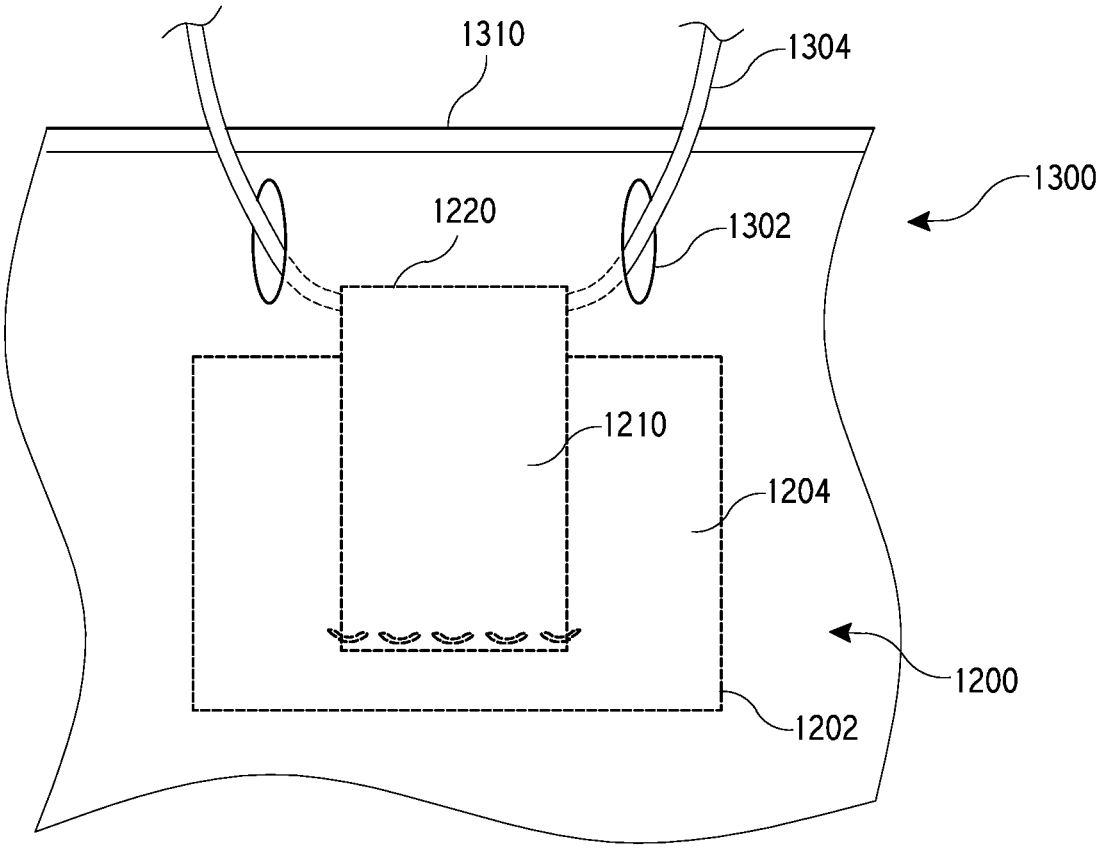
FIGS. 13A-D illustrate various embodiments of attaching the component of FIG. 12 to an article.
Figure 13B:
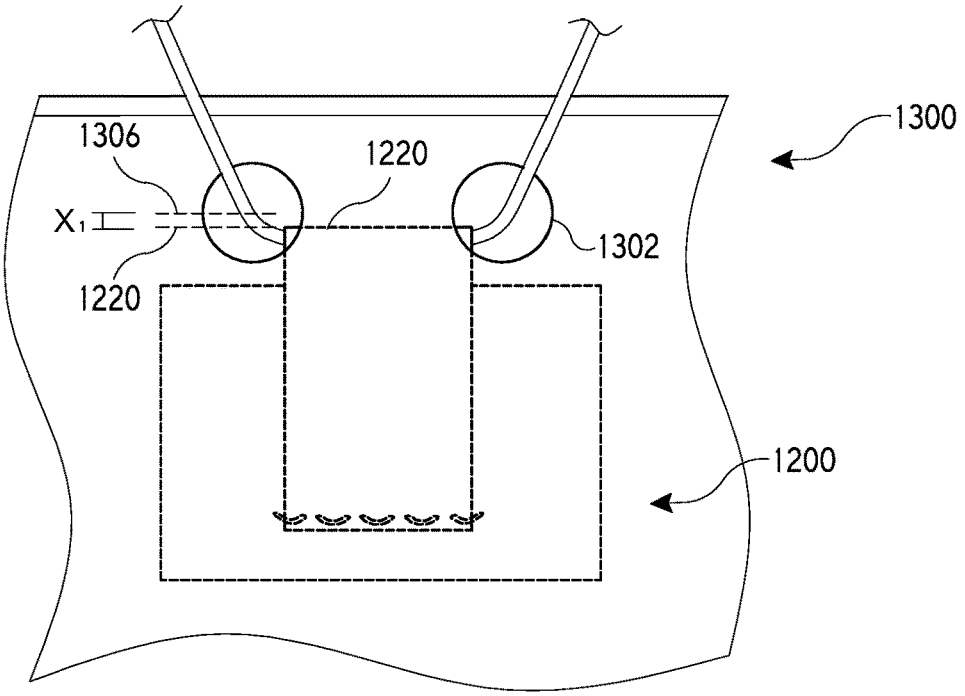
Figure 13C:
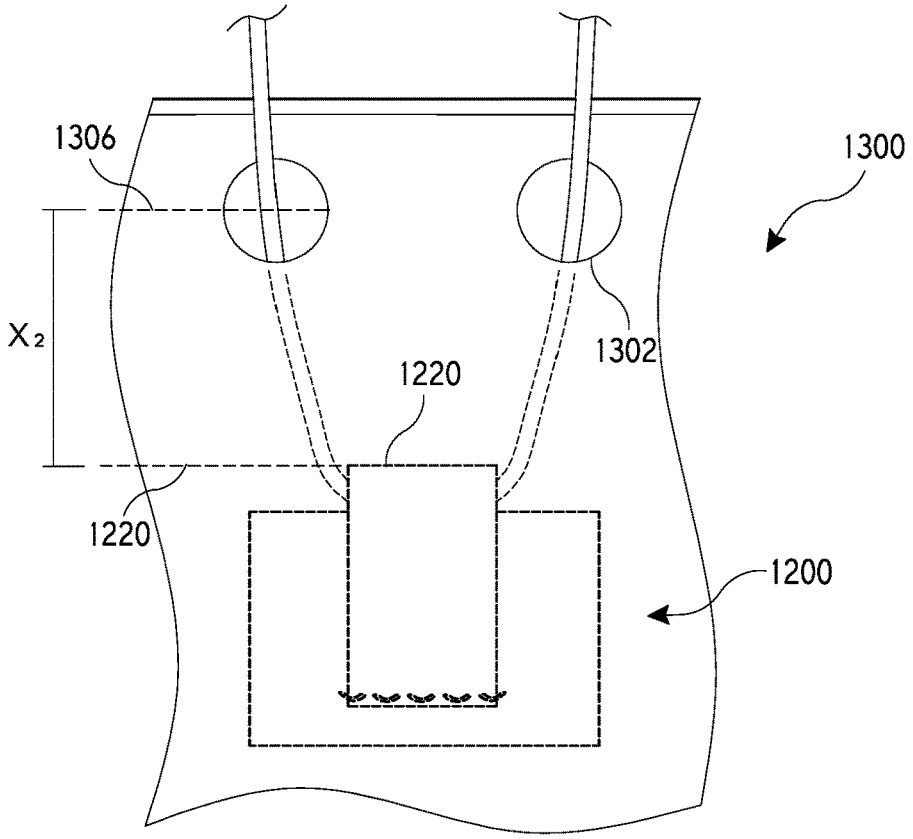

FIGS. 13A-C illustrate various embodiments of attaching the component 1200 to an article, such as a shoe. FIG. 13A illustrates an embodiment in which the component 1200 is attached to an article 1300. The article 1300 includes a pair of lace ports 1302 through which a lace 1304 is inserted. The component 1200 is positioned on the inner surface of the article 1300 so that it is not visible from the article's exterior. The inner surface 1204 of the attachment component 1202 is coupled with the inner surface of the article 1300 so that the guide member 1210 is sandwiched between the inner surface of the article 1300 and the inner surface 1204 of the attachment member 1202. In other embodiments, the outer surface (not numbered) of the attachment member 1202 may be attached to the inner surface of the article so that the guide member 1210 does not contact the inner surface of the article 1300.

The component 1200 is positioned about the article 1300 so that the loop end or edge 1220 is recessed from an edge 1310 of the article 1300. Ideally the loop edge 1220 is positioned so that when tensioned, a natural curvature of the lace 1304 causes the lace 1304 to be positioned roughly centrally through the lace ports 1302 as illustrated. Positioning the component 1200 in this manner reduces the frictional engagement of the lace 1304 with the lace ports 1302. Specifically, the configuration reduces or prevents the lace 1304 from rubbing against the top, bottom, or side edges of the lace ports 1302.

FIG. 13B illustrates the component 1200 positioned within the article 1300 so that the loop edge 1220 is nearer to the lace ports 1302. Specifically, the loop edge 1220 is positioned so that it is adjacent a centerline 1306 of the lace ports 1302. The loop edge 1220 may be offset from the centerline 1306 by a distance $X_1$, which distance may be less than the radius of the lace ports 1302. In other embodiments, the loop edge 1220 may be substantially equal with the centerline 1306 of the lace ports 1302. In some embodiments, the edges or corners of the guide member 1210 may be visible through the lace ports 1302. In any embodiment, the component 1200 should be positioned within the article 1300 so that the lace 1304 is positioned roughly centrally within the lace ports 1302 when the lace 1304 is tensioned. The configuration of FIG. 13B may be especially useful when the lace 1304 is extremely flexible or bendable.

FIG. 13C illustrates an embodiment in which the component 1200 is disposed within the article 1300 so that the loop edge 1220 is significantly offset from the centerline 1306 of the lace ports 1302. The loop edge 1220 is offset from the centerline 1306 by a distance $X_2$, which is significant enough that the component is far removed from the lace ports 1302. Similar to the previous embodiments, the component 1200 is ideally positioned so that the lace 1304 is positioned roughly centrally through the lace ports 1302 when tensioned. The configuration of FIG. 13C may be especially useful for lace that is less flexible and thus, requires a greater distance to flex, bend, or curve through the guide member 1210.

Figure 13D:
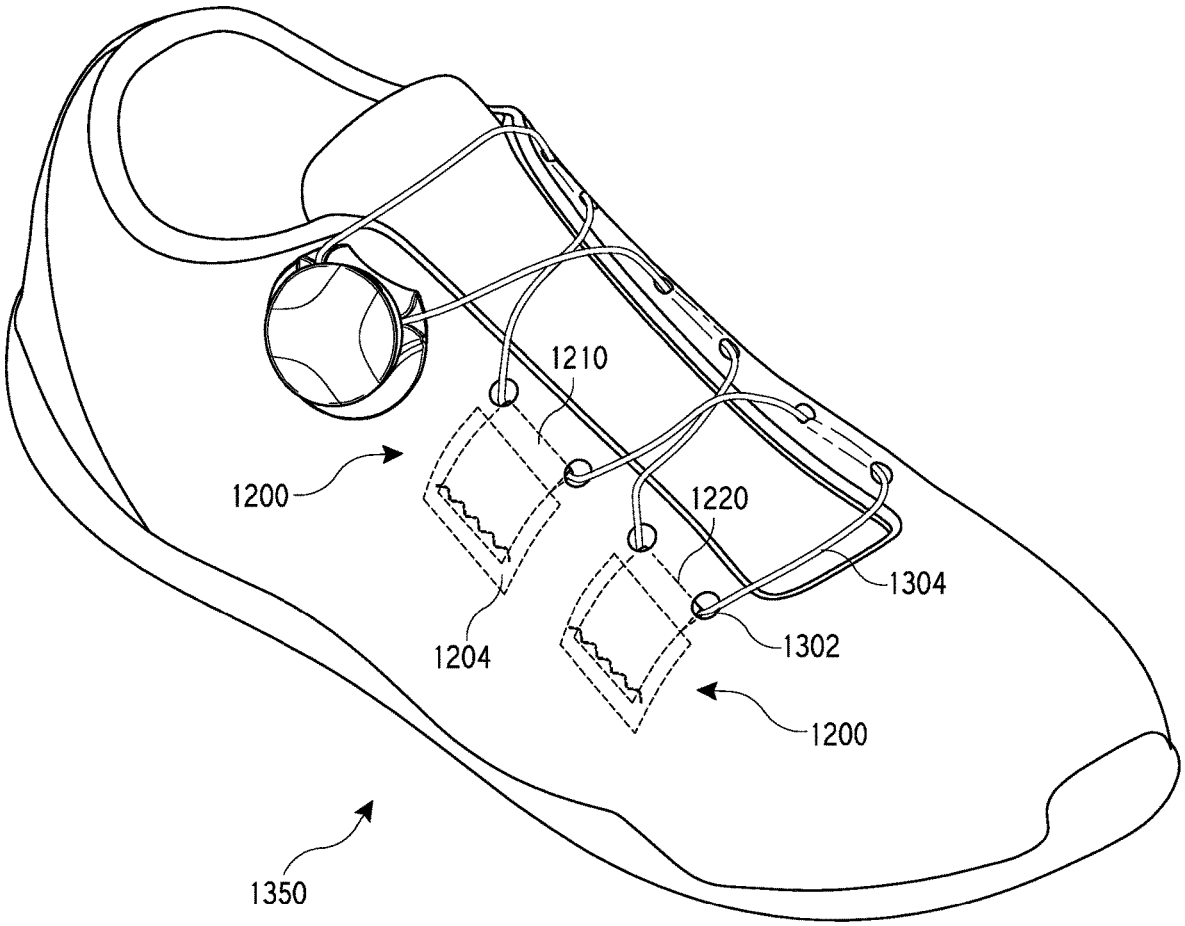

FIG. 13D illustrates the attachment component 1200 positioned on an inner surface of the shoe 1350 so that the component 1200 is not visible from the shoe's exterior. The inner surface 1204 of the component 1200 may be coupled with the inner surface of the shoe 1350 so that the guide member 1210 is sandwiched between the inner surface of the shoe 1350 and the inner surface 1204 of the attachment component 1200. The shoe 1350 includes multiple attachment components 1200 that are arranged about the shoe 1350 to guide a lace 1304 that is positioned along a path about the shoe 1350. FIG. 13D illustrates the lace 1304 in a tensioned state where the loop edge 1220 is positioned near a centerline of the lace ports 1302. In this state, the lace 1304 is positioned roughly centrally through the lace ports 1302 so that frictional engagement of the lace 1304 and lace ports 1302 is minimized. In an un-tensioned state, the loop edge 1220 may be recessed from the centerline of the lace ports 1302.

Figure 14:
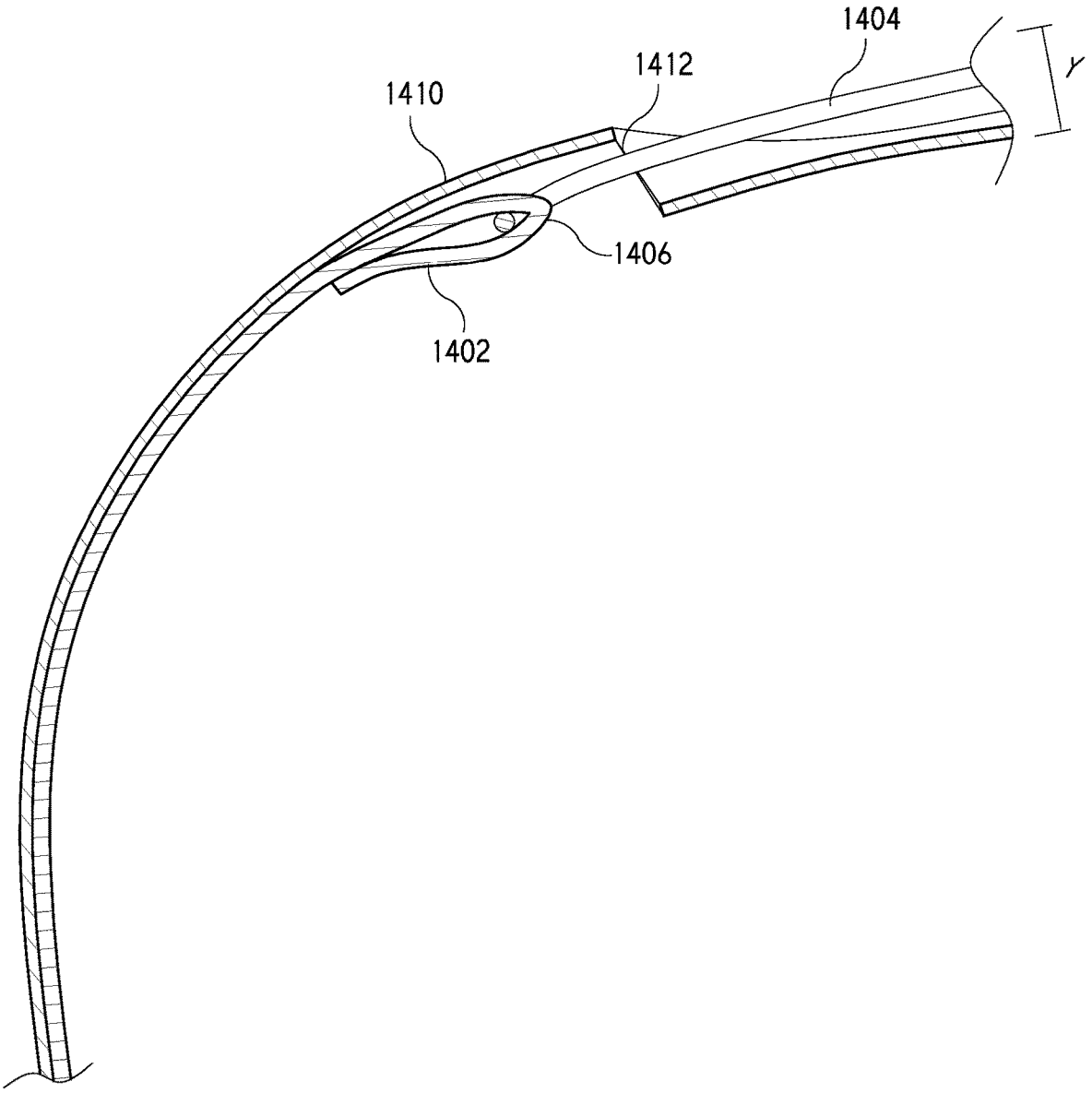
FIG. 14 illustrate an exemplary positioning of a guide member within an article.

Referring now to FIG. 14, illustrated is an ideal positioning of the guide member 1402 within an article 1410. Specifically, the guide member 1402 is positioned so that a distal edge 1406 of the guide member 1402 is roughly central relative to a lace port 1412 when a lace 1404 is tensioned. For example, the lace port 1412 may have an opening width of Y and the distal edge 1406 of the guide member 1402 may be positioned at roughly Y/2 in relation to an upper material of the article 1410. This configuration aids in positioning the lace 1404 roughly centrally through the lace port 1412 when the lace is tensioned, which reduces frictional contact or engagement of the lace 1404 with the lace ports 1412 and article 1410.

Figure 15A:
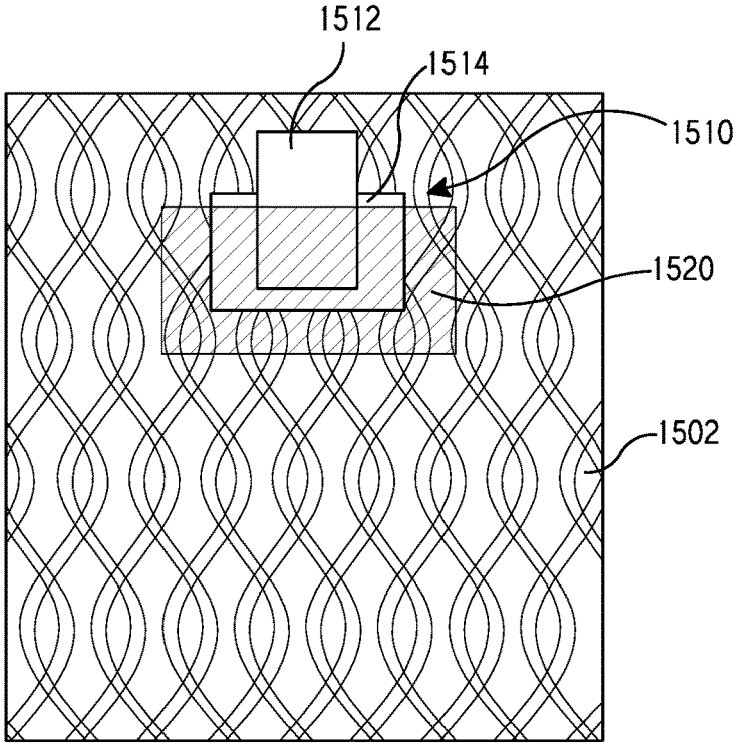
FIGS. 15A-B illustrate guide components that may be directly welded or attached to mesh material of an article.
Figure 15B:
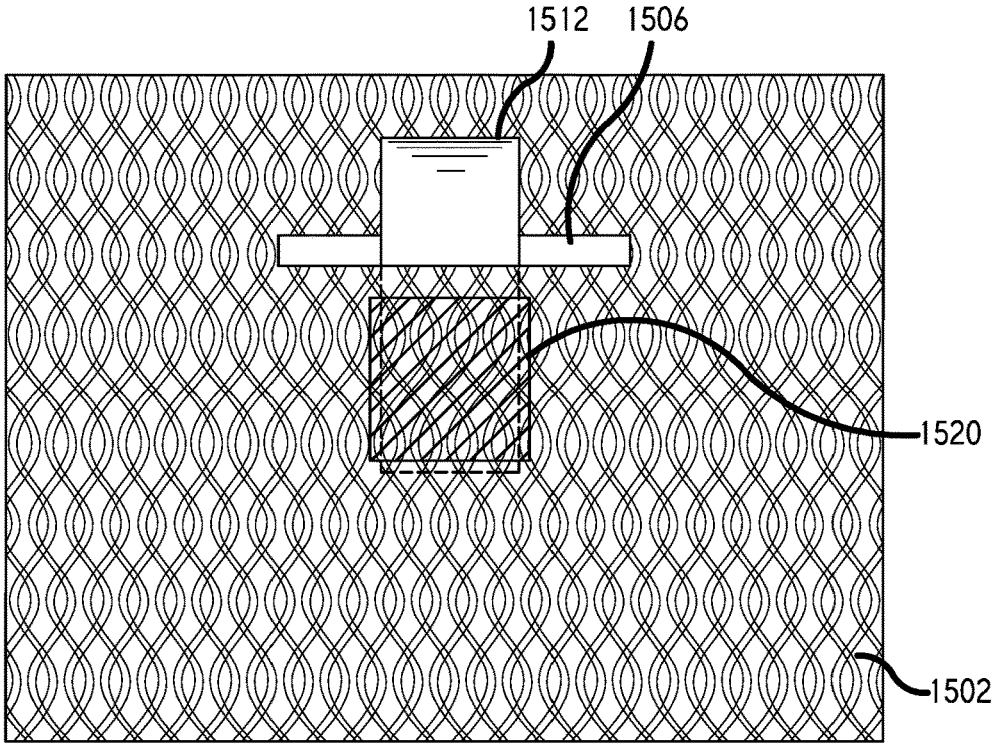

Referring now to FIGS. 15A-B, illustrated are embodiments of guide components 1510 that may be directly welded or attached to mesh material of an article, such as a shoe. FIG. 15A illustrates a guide component 1510 that includes a guide member 1512 that is attached to an attachment member 1514. The attachment member typically has a surface area that is larger than the guide member 1512. The attachment member 1514 attaches to the mesh 1502 of the article and helps to distribute any load or force that is imposed on the guide member 1512 due to tensioning of a lace (not shown). Similar to other embodiments, the guide member 1512 is folded over to form a loop through which the lace is inserted, and the guide member 1512 is attached to the attachment member 1514.

The attachment member 1514 is coupled to the mesh 1502. The attachment member 1514 is typically welded (e.g., heat welded, sonic welded, RF welded, and the like) to the mesh material 1502, although various other forms of attachment are possible, such as adhesive bonding and the like. When the attachment member 1514 is welded to the mesh 1502, a weld area is formed, which is illustrated by the cross-hatch section 1520 of FIG. 15A (hereinafter weld area 1520). The weld makes the weld area 1520 significantly more hard or rigid in comparison with the non-welded mesh 1502. The weld area 1520 defines a non-stretch area or portion of the mesh 1502, which may be utilized to tension or tighten the article as described herein below.

FIG. 15B illustrates a different embodiment of the guide component 1510. The guide component 1510 is similar to that illustrated in FIG. 15A except that the guide component 1510 does not include an attachment member (i.e., 1514). Rather, the guide component only includes a guide member 1512 that is directly coupled to the mesh 1502. In an exemplary embodiment, the guide member 1512 is coupled to the mesh 1502 via welding, which forms a weld area 1520 that is non-stretchable and may be used to influence the fit or tightening of the article in a desire manner. FIG. 15B also illustrates that the looped end of the guide member 1512 may be positioned through a slit or aperture 1506 so that the looped end is on an opposite side of the mesh 1502 from the remainder of the guide member 1512.

Referring now to FIGS. 16A-E, illustrated are embodiments in which the weld area 1520 is utilized to tighten or tension the mesh 1502 in a desired manner. It is believed that the weld area 1520 affects the mesh 1502 when the weld area 1520 is tensioned by the lace. Specifically, it is believed that when tension is applied to the weld area 1520, the area or portion of the mesh 1502 that is positioned opposite the applied force is distorted or stretched while the portion of the mesh 1502 that is positioned laterally adjacent the weld area 1520 and applied force is not distorted or stretched. As such, when the weld area 1520 is tensioned, most of the tension force is transferred to the mesh 1502 that is positioned opposite the applied force and is not applied to the laterally adjacent mesh. This effect may be exploited to tension a shoe is a unique manner.

Figure 16A:
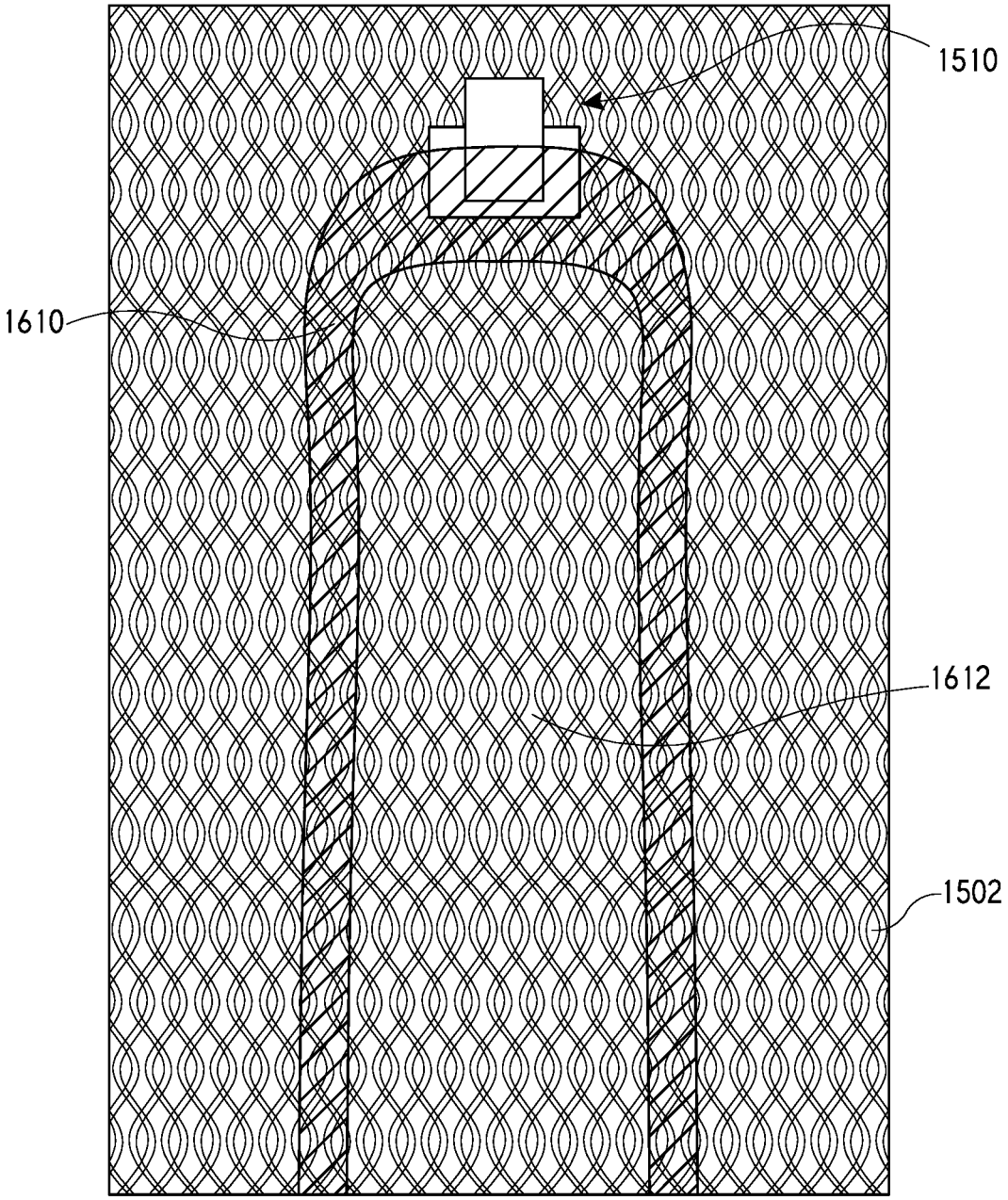
FIGS. 16A-E illustrate embodiments in which a weld area of a guide component is utilized to tighten or tension the mesh of an article in a desired manner.

FIG. 16A illustrates a guide component 1510 that is welded to the mesh 1502 of an article, such as a shoe. A weld area 1610 is formed on the mesh 1502 in the shape of an elongated U. The weld area 1610 forms an isolated zone or region 1612 between opposing sides of the elongated U in which the mesh 1502 is not welded together. The weld area 1610 may extend to the bottom of the mesh 1502 or may terminate proximally therefrom as desired. It is believed that the weld area 1610 will cause tensioning and/or stretching of the isolated zone 1612 when the guide member 1510 is tensioned. The portion of the mesh 1502 that is positioned laterally outside the weld area 1610 will experience significantly less tensioning or stretch than the isolated zone 1612 and thus, the weld area 1610 functions similar to a dividing member that divides the mesh 1502 into a tensionable portion and a non-tensionable portion. In such embodiments, the weld area 1610 and isolated zone 1612 will function similar to an independent panel when the lace is tensioned.

Figure 16B:
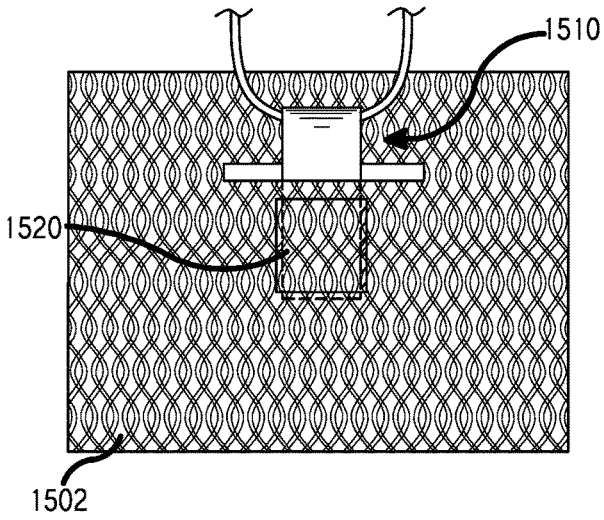
Figure 16C:
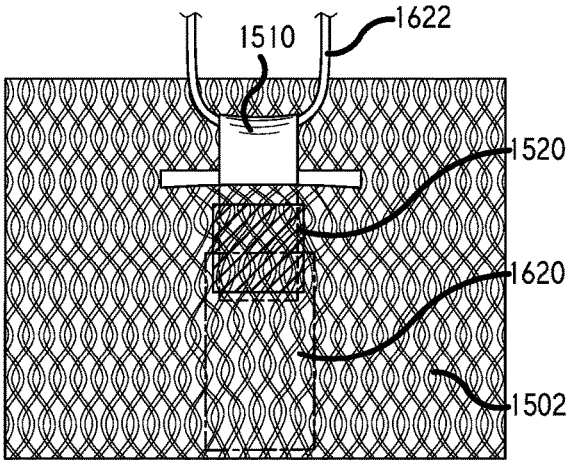
Figure 16D:
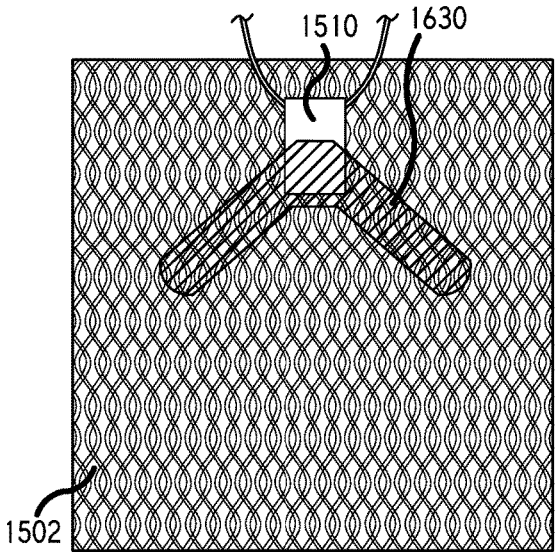
Figure 16E:
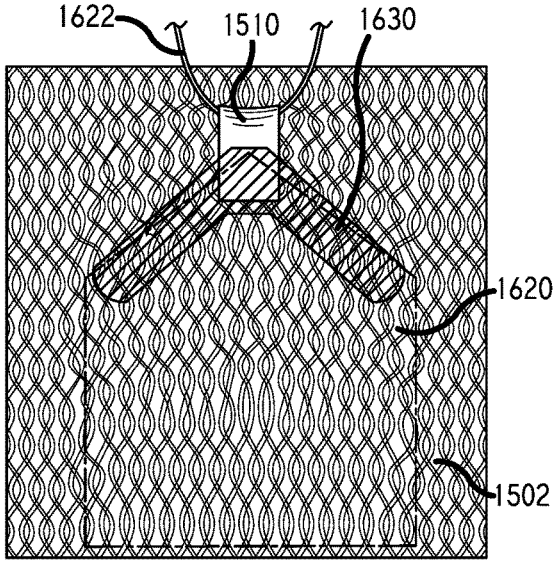

FIG. 16B illustrates another embodiment in which the guide component 1510 is welded to the mesh 1502 via a weld that forms a weld area 1520. The weld area 1520 is similar in size and shape to the guide member 1510. As shown in FIG. 16C, tensioning of the guide component 1510, via lace 1622, tensions a zone or portion 1620 of the mesh 1502 that is positioned immediately opposite the weld area 1520. FIG. 16D illustrates yet another embodiment of a guide component 1510 that is welded to mesh 1502 in a manner that defines a V-shaped weld area 1630. As shown in FIG. 16E, it is believed that tensioning of the guide component 1510 via the lace 1622 will tension a zone or portion 1620 of the mesh that is positioned immediately opposite the weld area 1630. The tensioned zone or portion 1620 may extend downward through the mesh from the opposite ends or arms of the weld area 1630. The mesh material 1502 that is positioned outside the tensioned zone or portion 1620 may be significantly less tensioned or stretched than the mesh 1502 positioned within the tensioned zone or portion 1620. As such, the weld area 1630 may be utilized to uniquely tension the mesh material 1502 in a desired manner.

It should be realized that the configurations of FIGS. 16A-E are illustrative only and are not intended to limit the concept to any one particular configuration. Rather, a person of skill will readily recognize that various other weld area configurations may be formed to tension the mesh material in a desired manner. Stated differently, the mesh 1502 may be uniquely tensioned by forming a desired weld area 1520 when attaching the guide member 1510, which will causes desired portions of the mesh 1502 to be selectively tensioned.

Figure 17:
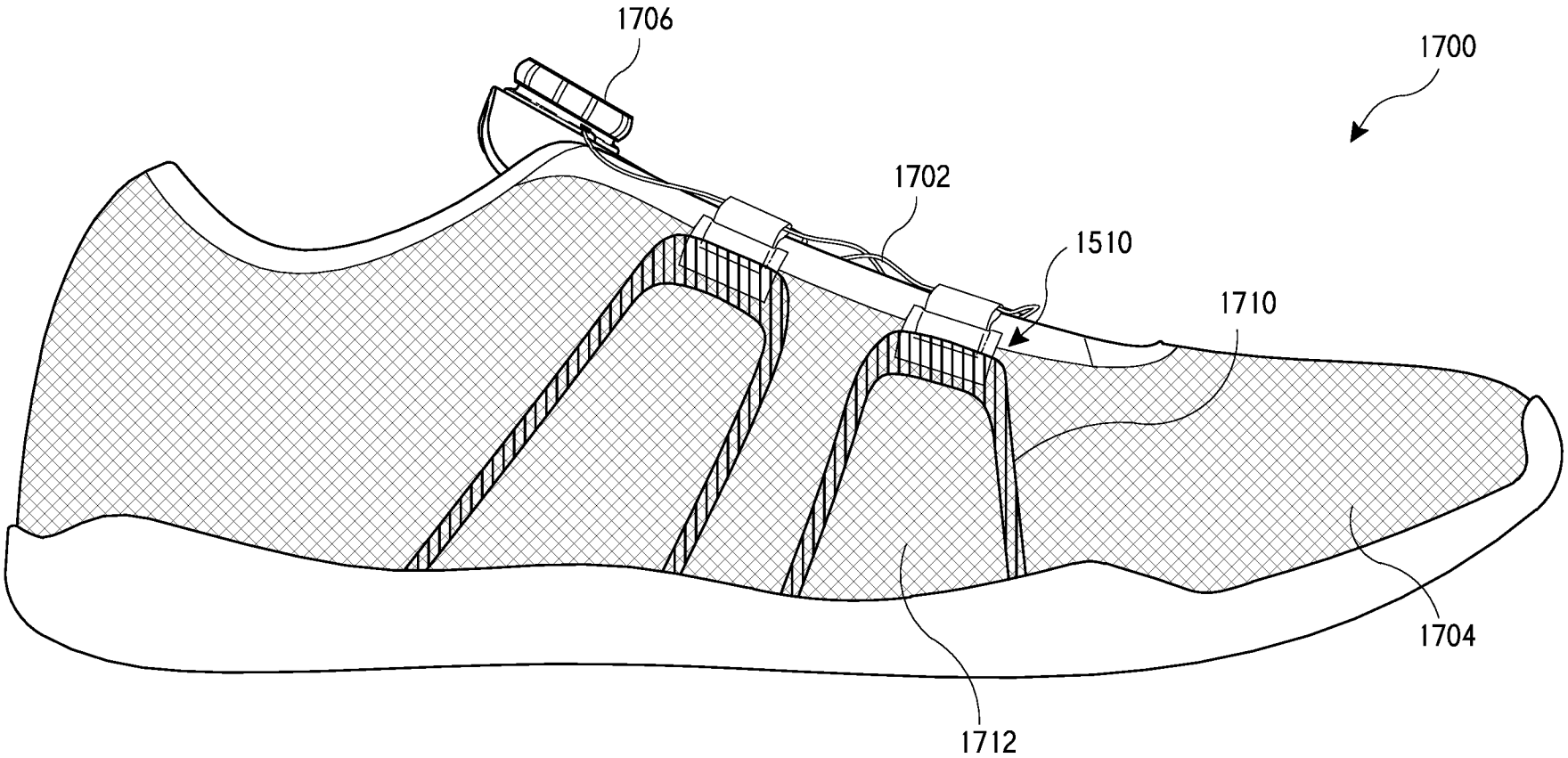
FIG. 17 illustrates several guide components coupled with mesh material of a shoe.

FIG. 17 illustrates several guide components 1510 coupled with mesh material 1704 of a shoe 1700. Specifically, two guide components 1510 are illustrated as coupled with one side of the shoe 1700. Each guide component 1510 is welded to the mesh 1704 to form an elongated U-shaped weld area 1710 that defines an isolated region 1712 as previously described. The configuration of FIG. 17 results in relatively independent tensioning or stretching of each isolated zone 1712, which pulls or wraps the mesh 1704 around and about the foot in a more form fitting manner. The isolated zones 1712 may be similar in function to independent straps that would be pulled tightly around the user's foot.

Each guide component 1510 is operationally coupled with a tension member or lace 1702, which is in turn operationally coupled with a reel based tightening mechanism 1706. Operation of the tightening mechanism 1706 (i.e., rotational winding of a knob component) causes the lace 1702 to be tensioned, which in turn tension each of the guide components 1510 and mesh material 1502 in the isolated zones 1712.

Figure 18A:
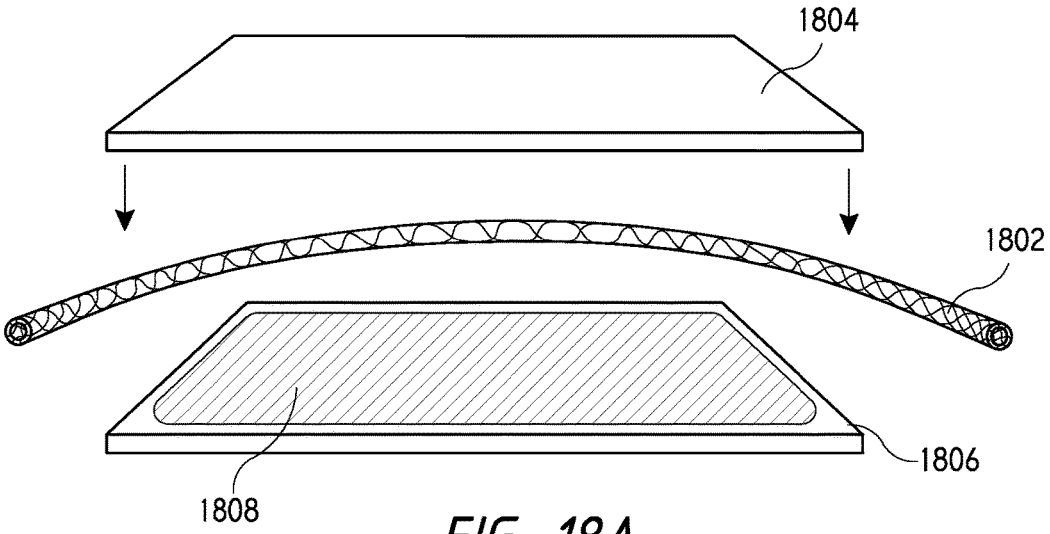
FIGS. 18A-C illustrate a guide component that is formed via coupling a guide member between two material layers.
Figure 18B:
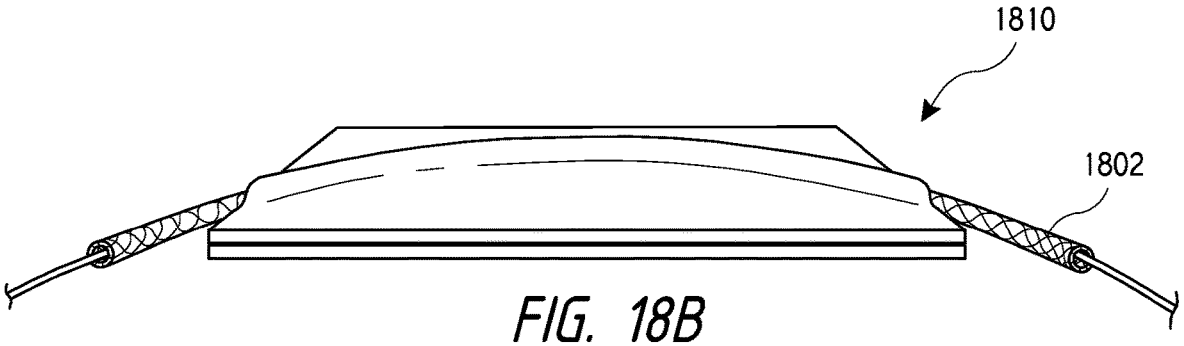
Figure 18C:
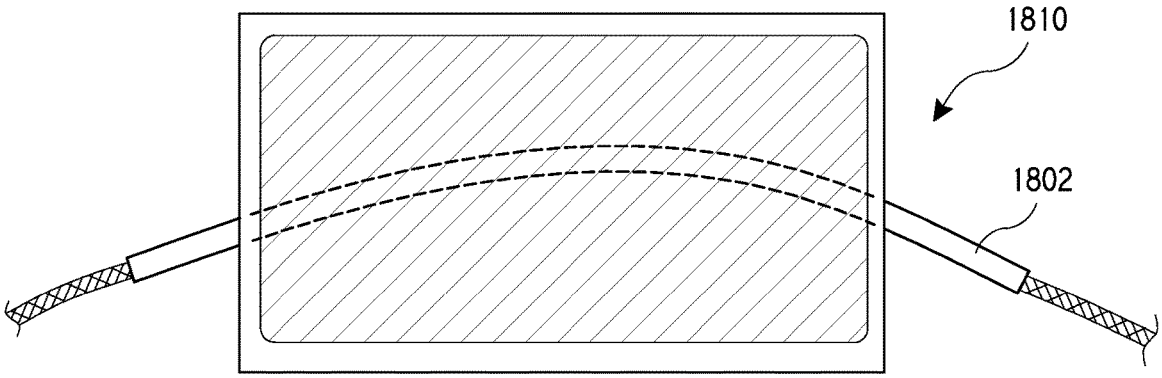

Referring now to FIGS. 18A-C, illustrated is an embodiment of a guide component 1810 that is formed via coupling a guide member 1802 between two material layers. The guide member 1802 is a tube section having a lumen through which a lace is inserted. The guide member is positioned between an upper material layer 1804 and a lower material layer 1806. The guide member 1802 is usually bent or curved so as to guide or route the lace along a desired radius or curvature. In a specific embodiment, the guide member 1802 may be formed of a woven sheath material.

The upper material layer 1804 is attached to the lower material layer 1806 so that the guide member 1802 is fixedly positioned there between. The upper material layer 1804 and the lower material layer 1806 may be coupled together via adhesive bonding, stitching, and the like. In an exemplary embodiment, the upper material layer 1804 and the lower material layer 1806 are coupled via welding (e.g., heat, sonic, RF, and the like). Once formed, the guide component 1810 may attached to an article, such as a shoe, to form a lace path and to guide or route a tension member or lace along the lace path.

Figure 19:
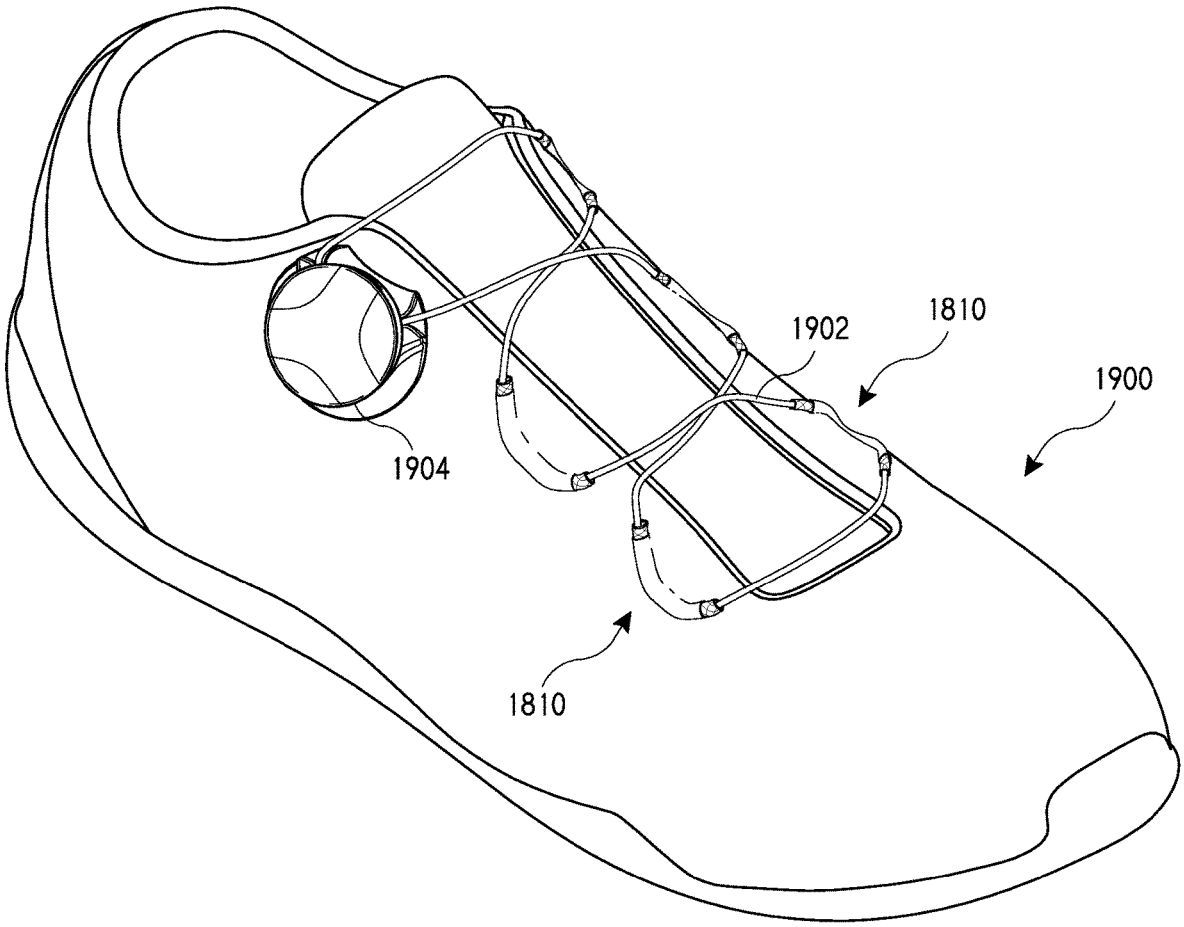
FIG. 19 illustrates the guide components of FIGS. 18A-C attached to shoe.

FIG. 19 illustrates a plurality of the guide components 1810 of FIGS. 18A-C attached to shoe 1900. The guide components 1810 form a lace path about a tongue of the shoe 1900. The lace 1902 is routed or guided along the lace path via the guide components 1810. The lace 1902 is operatically coupled with a reel based tightening mechanism 1904 in a manner that effects tensioning of the lace 1902 when the tightening mechanism 1904 is operated.

Referring now to FIGS. 20A-D, illustrated is an embodiment of a transition component 2000 that may be attached to a shoe or article to provide a transition between portions of the shoe, such as between the shoe's upper and the tongue, and/or conceal or hide a guide that is positioned under the transition component 2000. The transition component 2000 includes a proximal portion 2004 that is attached to the shoe's upper 2002 near a distal edge of the upper 2002. The proximal end 2004 of the transition component 2000 may be stitched 2003, adhesively bonded, welded, or otherwise coupled with the upper 2002. In some embodiments, the proximal end 2004 may be folded at or near the coupling point with the upper 2002.

The transition component 2000 also includes a distal end 2020 that is positioned on an opposite side of the upper 2002. The transition component 2000 may be folded 2010 between the proximal end 2004 and the distal end 2020 (hereinafter folded end 2010). In some embodiments, the folded end 2010 may be coupled together via stitching 2012, adhesive bonding, welding, and the like. The distal end 2020 is positioned under the upper 2002 so as to partially or fully cover a lace guide 2006 that is positioned under and coupled to the upper 2002. The stitching 2012, or other coupling, may help maintain the distal end 2020 in position under the upper 2002 and over the lace guide 2006. The lace guide 2006 includes a looped end 2008 through which a lace or tension member is inserted. In some embodiments, the distal end 2020 of the transition component 2000 is uncoupled or unattached from the upper 2002 so that the distal end 2020 is free floating under the upper 2002.

Figure 20A:
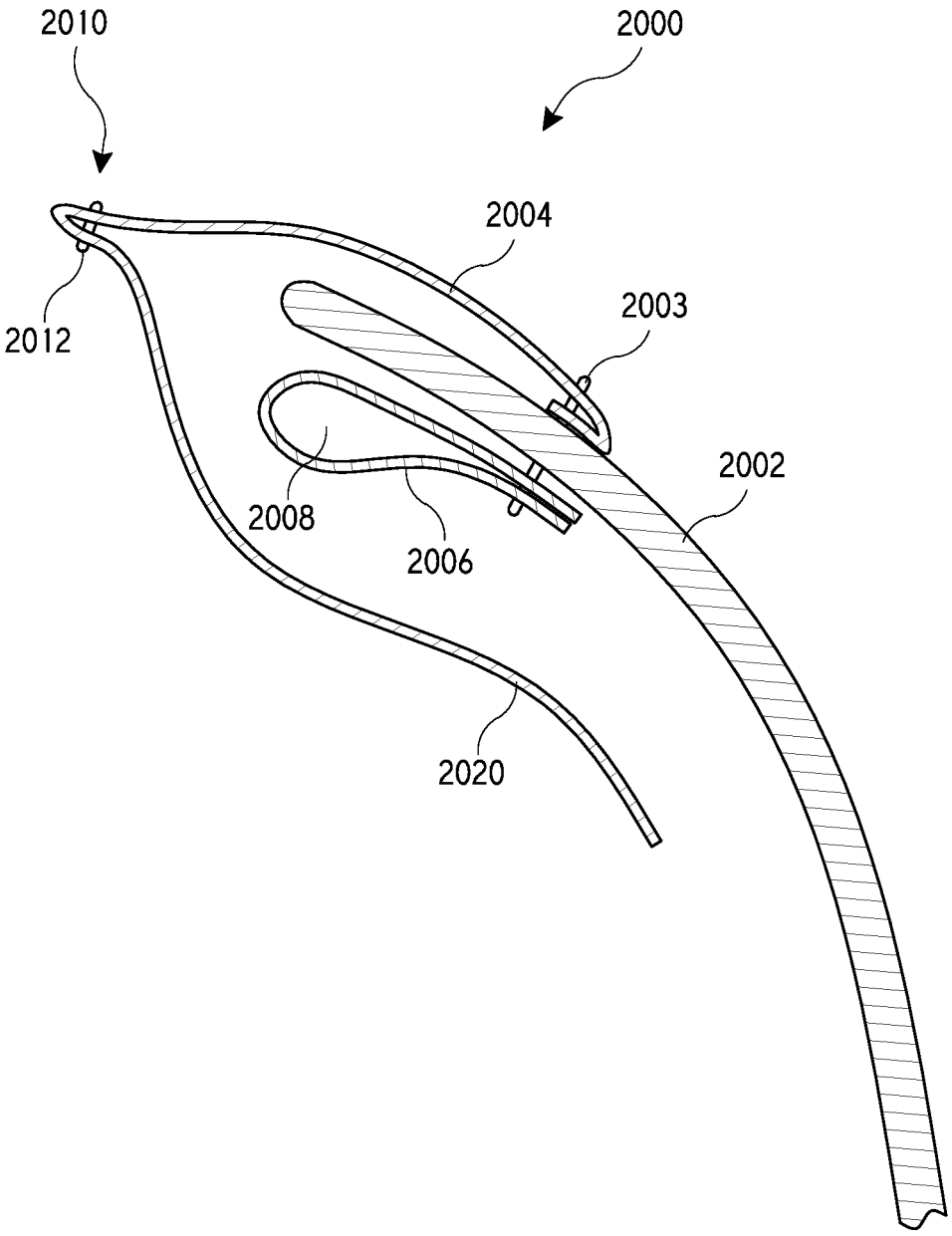
FIGS. 20A-D illustrate a transition component that may be attached to an article to provide a transition between portions of the article and/or to conceal a guide positioned under the transition component.
Figure 20B:
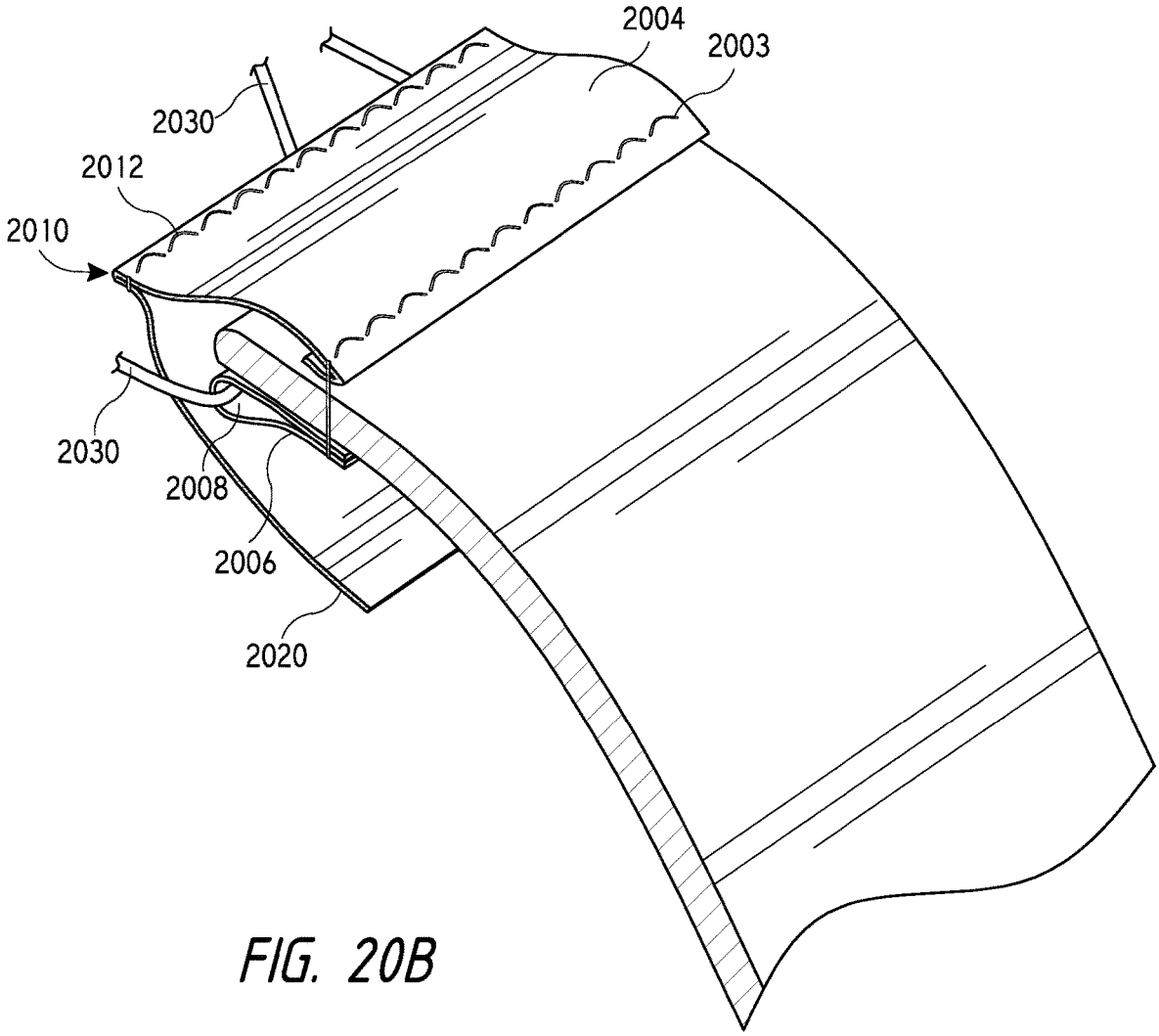
Figure 20C:
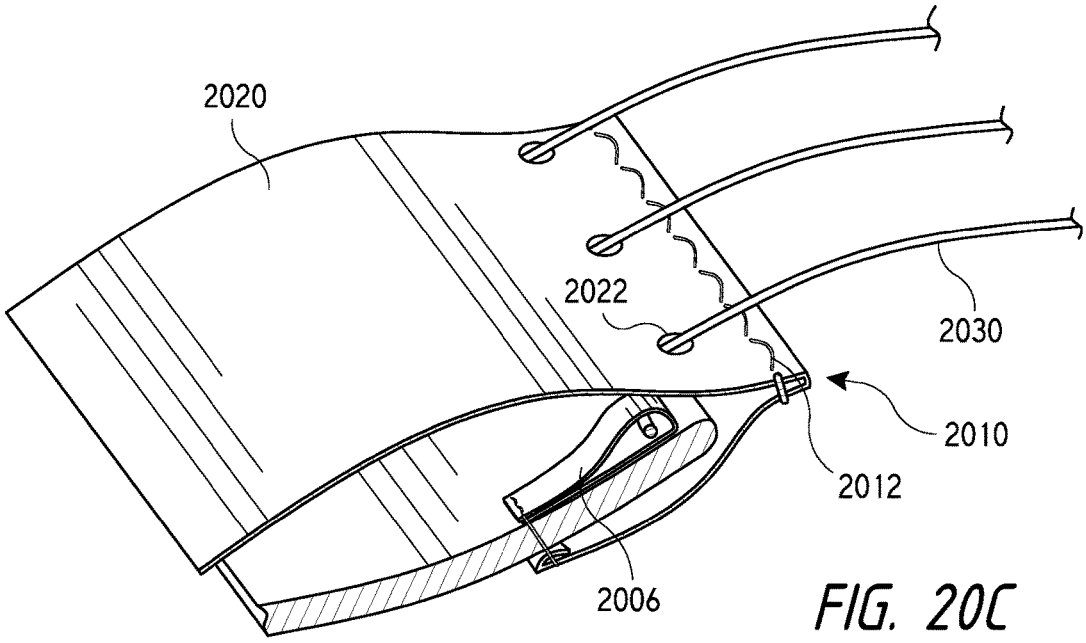

FIG. 20B illustrates a perspective view of the transition component 2000 coupled to the upper 2002. FIG. 20B illustrates a lace 2030 positioned through the looped end 2008 of the guide member 2006. FIG. 20C illustrates a bottom perspective view of the transition component 2000. As illustrated, the transition component 2000 includes lace ports 2022 that are positioned near the folded end 2010. The lace 2030 is inserted through the lace ports 2022 so as to be accessible to the guide members 2006 positioned under the transition component 2000.

Figure 20D:
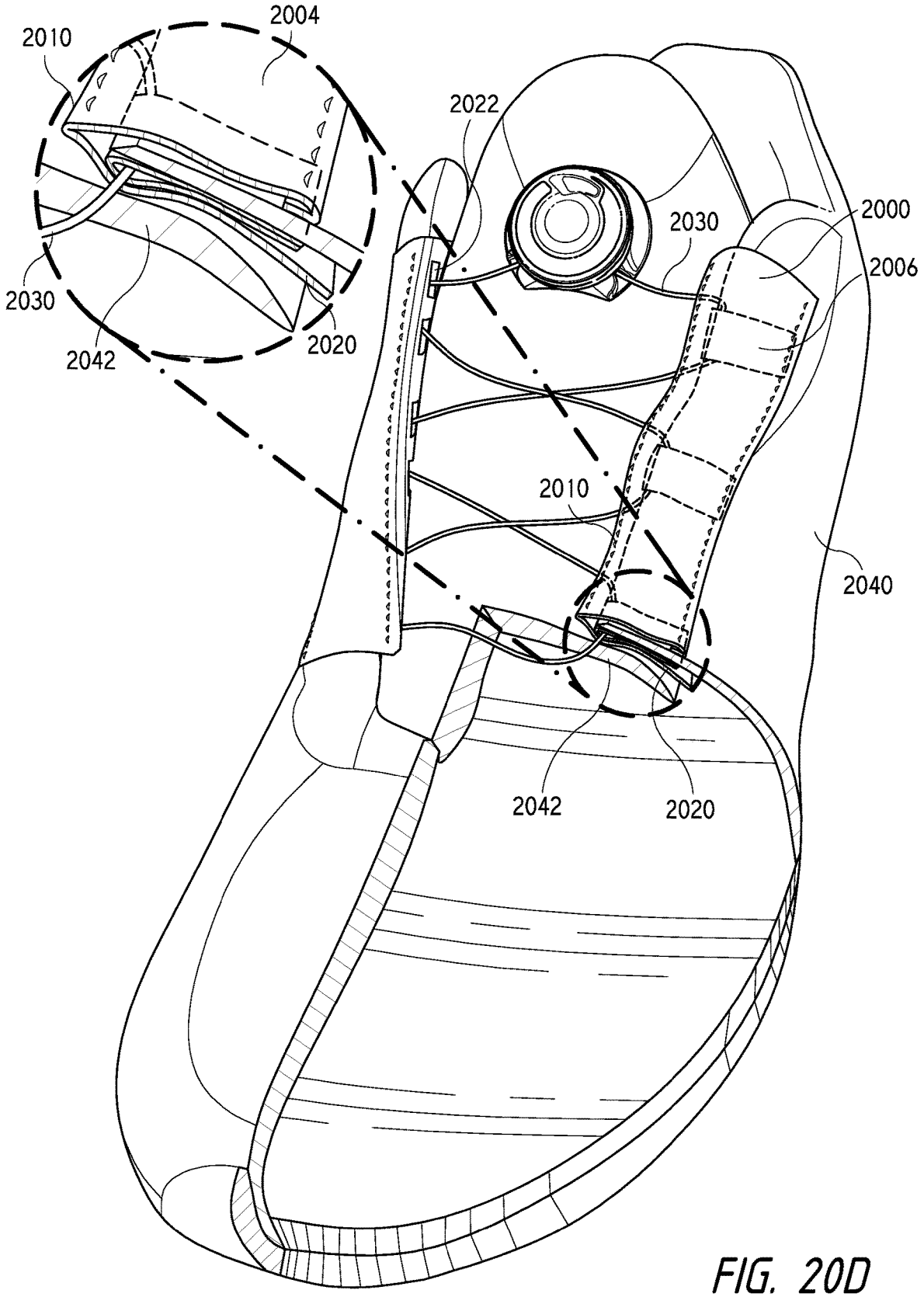

FIG. 20D illustrates the transition component 2000 coupled with a shoe 2040. The transition component 2000 is coupled with opposing uppers of the shoe and is positioned to traverse along the opposing eyestays of the shoe. As illustrated in the detailed view, the distal end 2020 of the transition component 2000 is positioned between the guide member 2006 and the shoe's tongue 2042. The transition component 2000 hides or conceals the guide member 2006 that is positioned under the transition component 2000. The concealment of the guide member 2006 may provide a smooth, seamless, uniform, or otherwise appealing look or appearance to the upper. The transition component 2000 may also provide a relatively smooth transition between the guide member 2006 and the tongue 2042, thereby reducing frictional engagement between the lace 2030 and the tongue 2042 and/or decreasing wear between these components.

The transition is achieved due to the lace 2030 being routed within the transition component 2000 and out of the lace ports 2022 rather than experiencing an abrupt transition from the guide members 2006 to the tongue 2042. The transition component 2000 may be made of a low friction material to further effect a smooth transition between the guide member 2006 and tongue 2042. The transition component 2000 may also conceal the guide member 2006 from view, thereby providing a sleek appearance of the upper that may be desired. The transition component 2000 of FIGS. 20A-D is especially useful in instances where the looped end of the guide member 2006 is positioned inward of the eyestay edge in which the lace may be pinched between the tongue 2042 and an inner surface of the upper 2002.

Figure 21A:
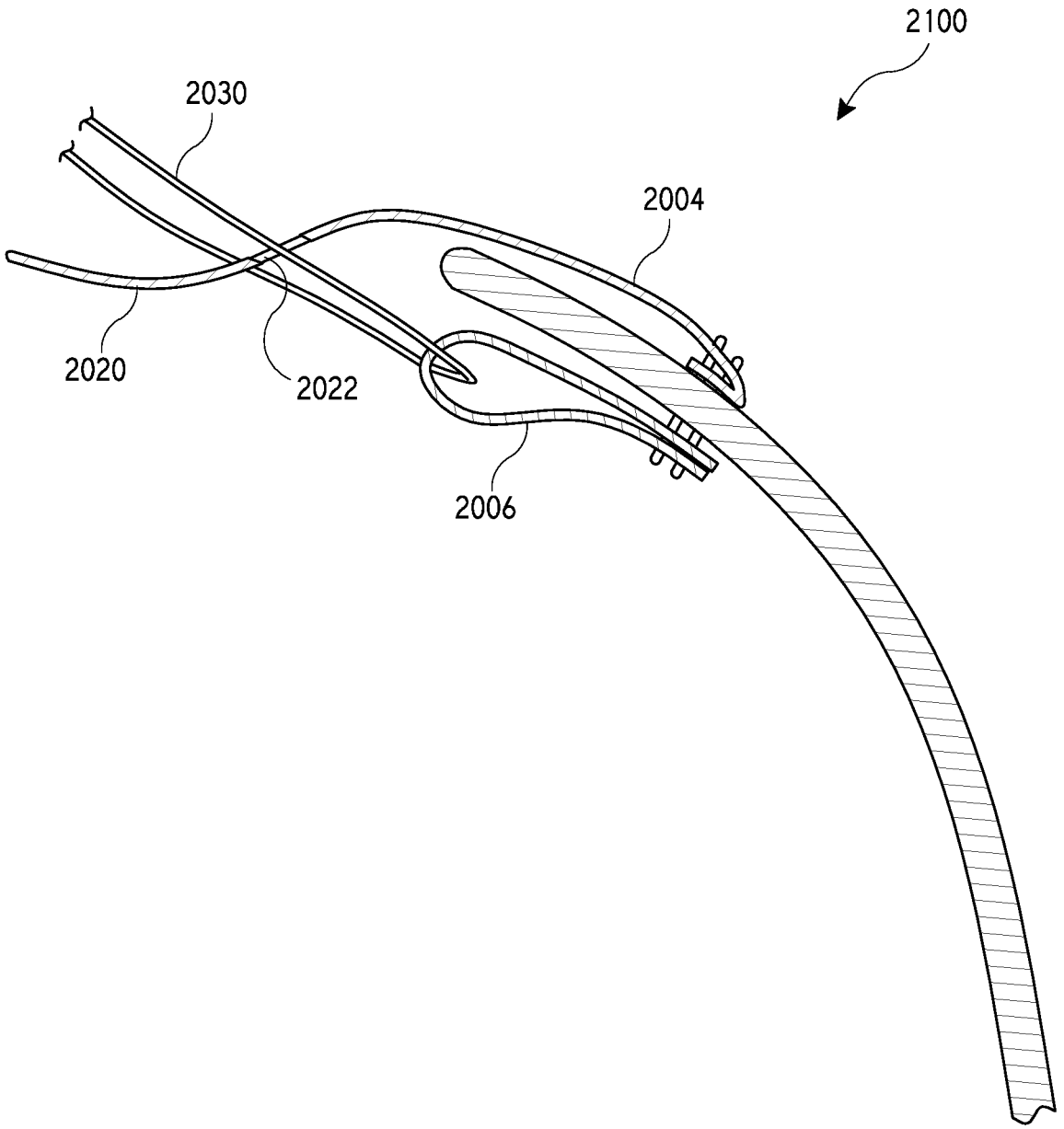
FIGS. 21A-B illustrate another embodiment of a transition component that may be used to hide or conceal a guide member and/or provide a relatively smooth transition between portions of an article.
Figure 21B:
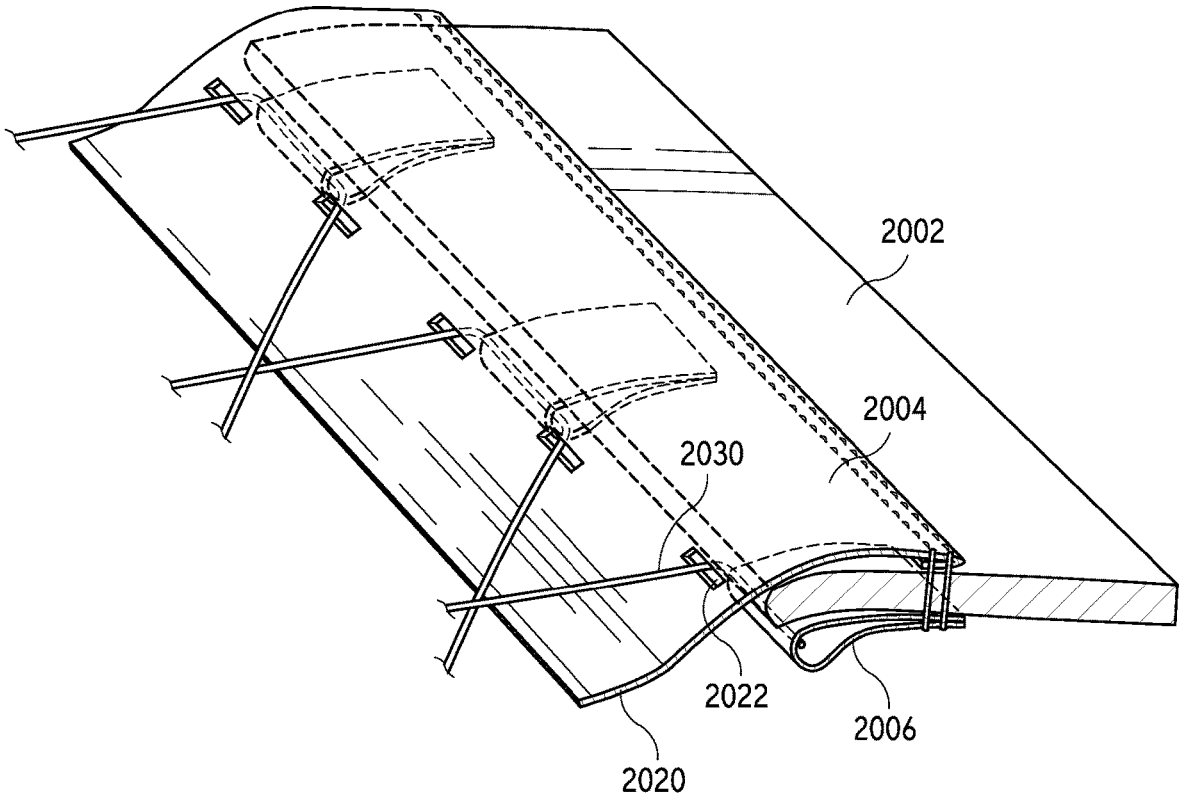

Referring now to FIGS. 21A-B, illustrated is another embodiment of a transition component 2100. The transition component 2100 is similar to that illustrated in FIGS. 20A-D in that the transition component 2100 includes a proximal end 2004 and a distal end 2020, The proximal end 2004 is coupled to the upper 2002 as previously described. The transition component 2100 also include lace ports 2022 through which the lace 2030 is routed. Unlike the transition component 2000 of FIGS. 20A-D, the transition component 2100 of FIGS. 21A-B does not include a folded end 2010. Rather, the distal end 2020 extends laterally outward from the upper 2002. When attached to a shoe (not shown), the distal end 2020 of the transition component 2100 would lie atop the shoe's tongue. The lace 2030 would slide atop the transition component 2100 and enter the lace ports 2022 to access the guide member 2006, which may be positioned under the upper 2002 as illustrated, or atop the upper 2002 as desired. The transition component 2100 of FIGS. 21A-B is especially useful in instances where the looped end of the guide member 2006 is positioned at or near the eyestay edge.

Figure 22A:
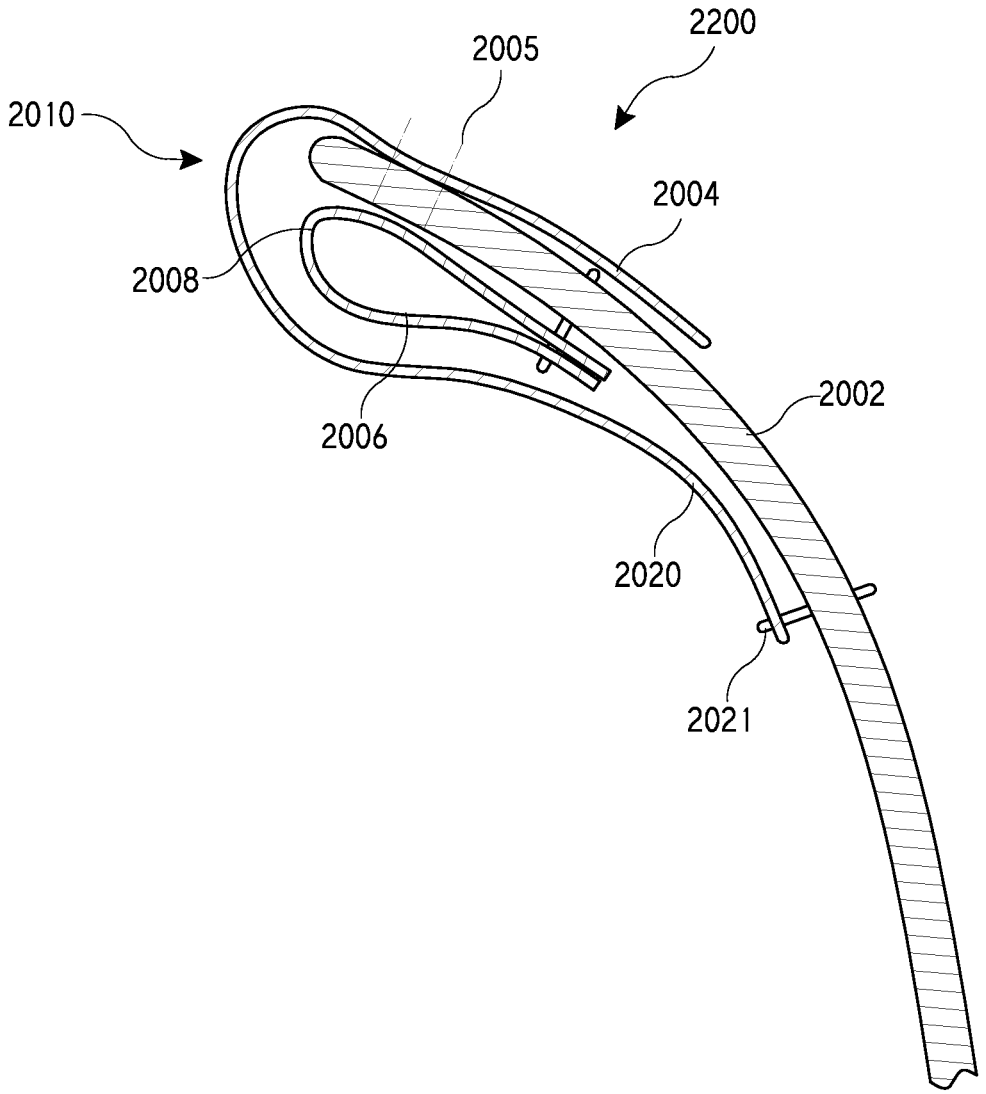
FIGS. 22A-C illustrate another embodiment of a transition component that may be used to hide or conceal a guide member and/or provide a relatively smooth transition between portions of an article.
Figure 22B:
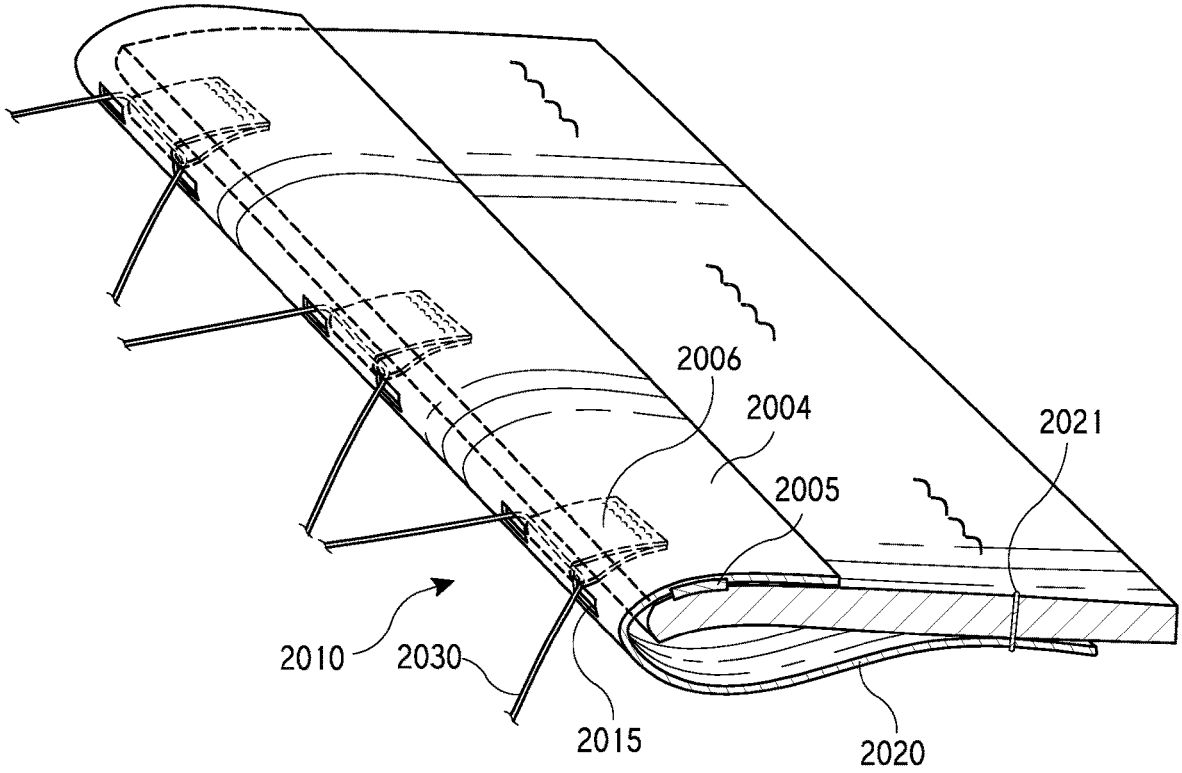
Figure 22C:
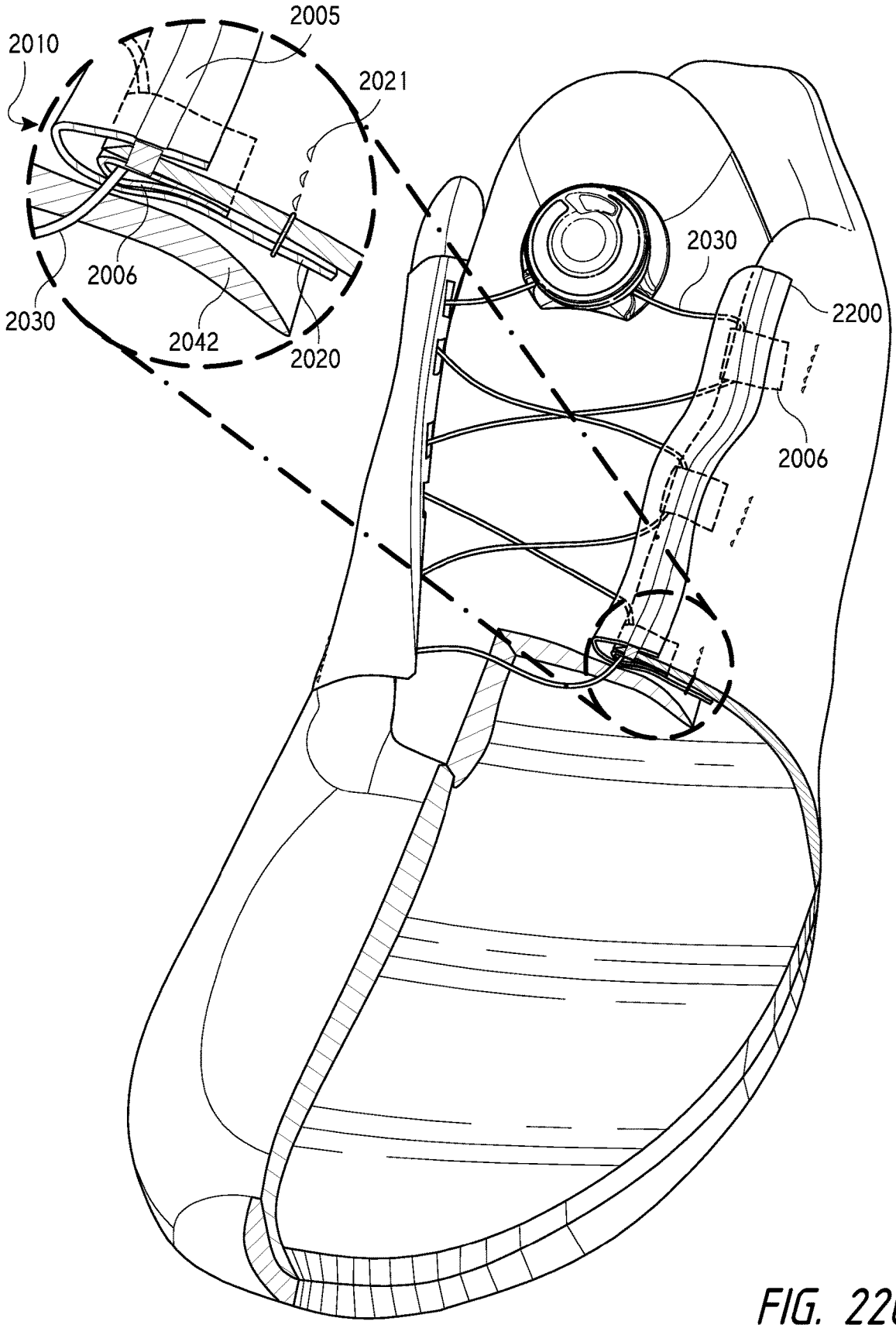

Referring now to FIGS. 22A-C, illustrated is another transition component 2200 that may be used to hide or conceal a guide member and/or provide a relatively smooth transition between portions of a shoe. As illustrated in FIG. 22A, the transition component 2200 is similar to the transition component 2000 of FIGS. 20A-D in that the transition component 2200 includes a proximal end 2004, a distal end 2020, and a folded or looped end 2010 that is positioned between the proximal end 2004 and the distal end 2020. The proximal end 2004 and the distal end 2020 are both attached to the upper 2002 so that the guide member 2006 is fully enclosed within the transition component 2200. The folded end 2010 may not be stitched or otherwise coupled together. The stitching or coupling of the folded end 2010 may be unnecessary since the distal end 2020 is coupled with the inner surface of the upper 2002 and, thus, does not need to be held or maintained in position by the coupled folded end 2010. The distal end 2020 may be attached to the inner surface of the upper 2002 via stitching 2021, adhesive bonding, welding, and the like. In some instances, a coupling 2005 may attach the proximal end 2004 to the upper 2002 near an edge of the upper.

FIG. 22B illustrates a perspective view of the transition component 2200. FIG. 22B illustrates that lace ports 2015 are formed in the folded end 2010 of the transition component 2200. The lace ports 2015 provide a more direct or linear access to the guide member 2006. FIG. 22C illustrates the transition component 2200 attached to a shoe. The detailed view illustrates the distal end 2020 positioned between the shoe's tongue 2042 and the guide member 2006. The stitched 2021, or otherwise coupled, distal end 2020 ensures that the distal end 2020 remains positioned between the tongue 2042 and the guide member 2006. The transition component 2200 hides or conceals the guide member 2006 and/or provides a smooth transition between the tongue 2042 and the guide member 2006 and may be ideally suited for configurations that require more direct lace access to the guide members 2006.

Figure 23A:
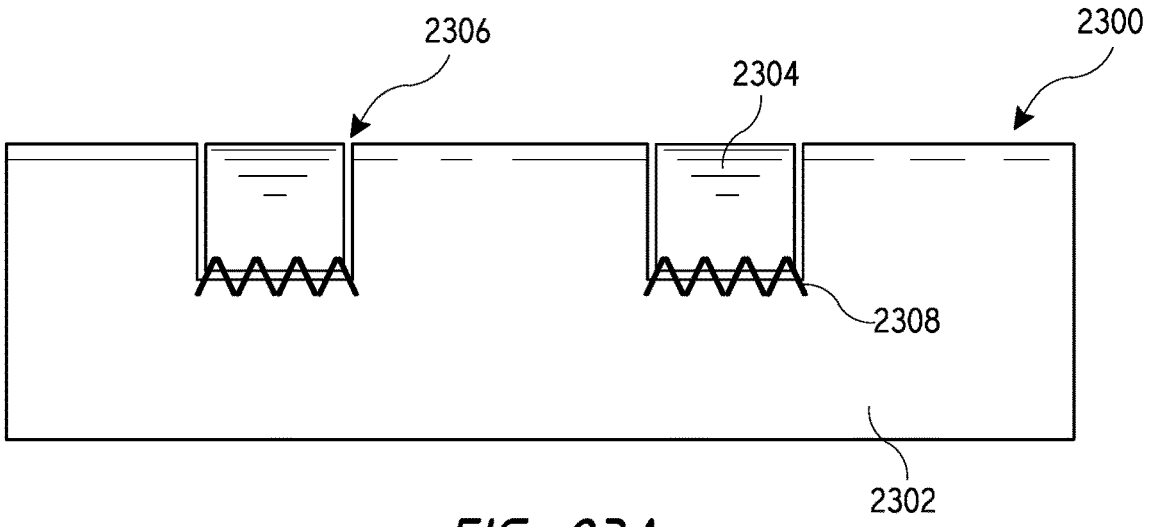
FIGS. 23A-D illustrate another guide member that may be used to route or guide a tension member about an article.
Figure 23B:
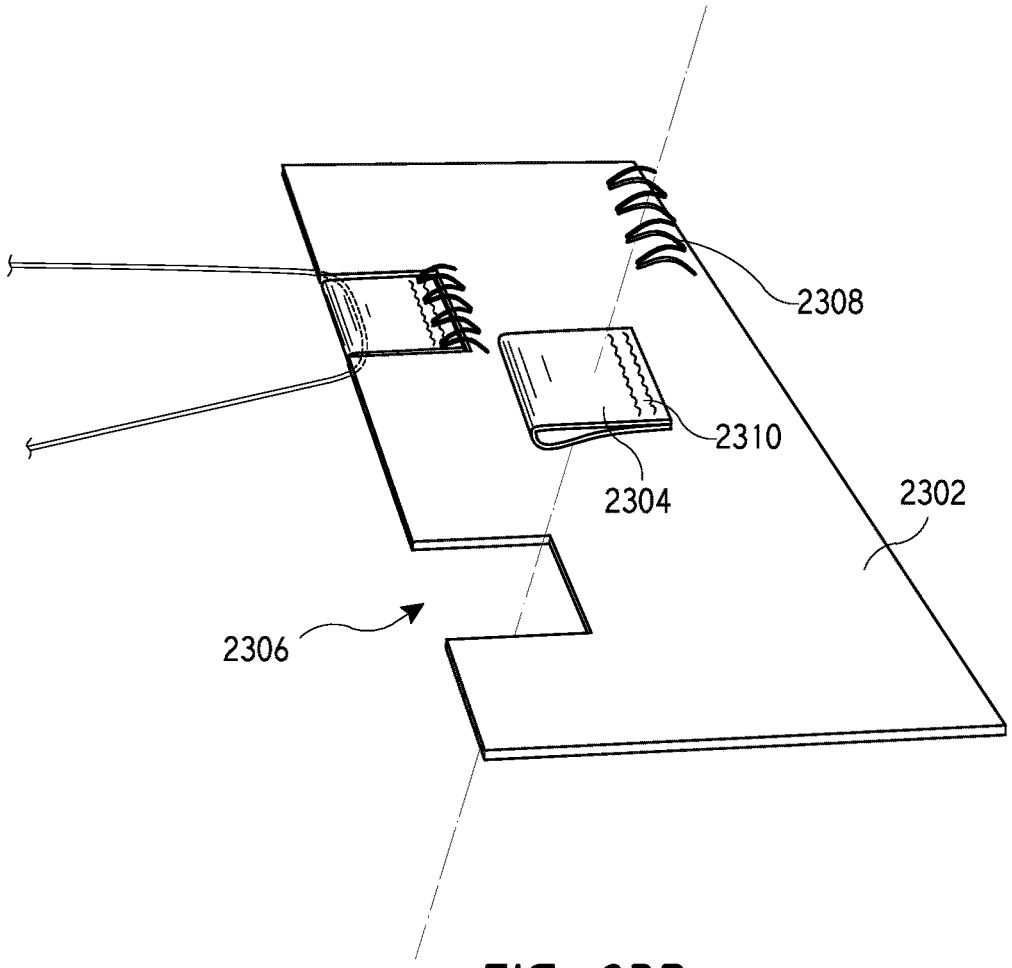

Referring now to FIGS. 23A-D, illustrated is another guide member or component 2300 that may be used to route or guide a lace or tension member about a shoe. FIGS. 23A-B illustrate that the guide member 2300 is formed by positioning a looped or folded material strip 2304 (hereinafter material guide 2304) within a window or cut away portion 2306 of a material body 2302. The window 2306 may be cut into the material body 2302 so that the size and shape of the window 2306 corresponds to the size and shape of the material guide 2304. A proximal edge of the material guide 2304 is coupled with an inner edge of the material body 2302 via stitching 2308, adhesive bonding, welding, and the like. In some instances, the proximal end of the material guide 2304 may have a temporary coupling 2310 in order to maintain the material guide 2304 in the folded or looped configuration. The material guide 2304 may be positioned within the window 2306 and coupled with the material body 2304 so that a distal edge of the material guide 2304 is aligned with a distal end of the material body 2302 as illustrated. The material body 2302 may include multiple guides that are positioned longitudinally along or about the material body as illustrated. The positioning of the material guide 2304 within the window 2306 reduces the overall thickness of the guide member 2300 since the material guide 2404 is not positioned atop of material body 2302.

Figure 23C:
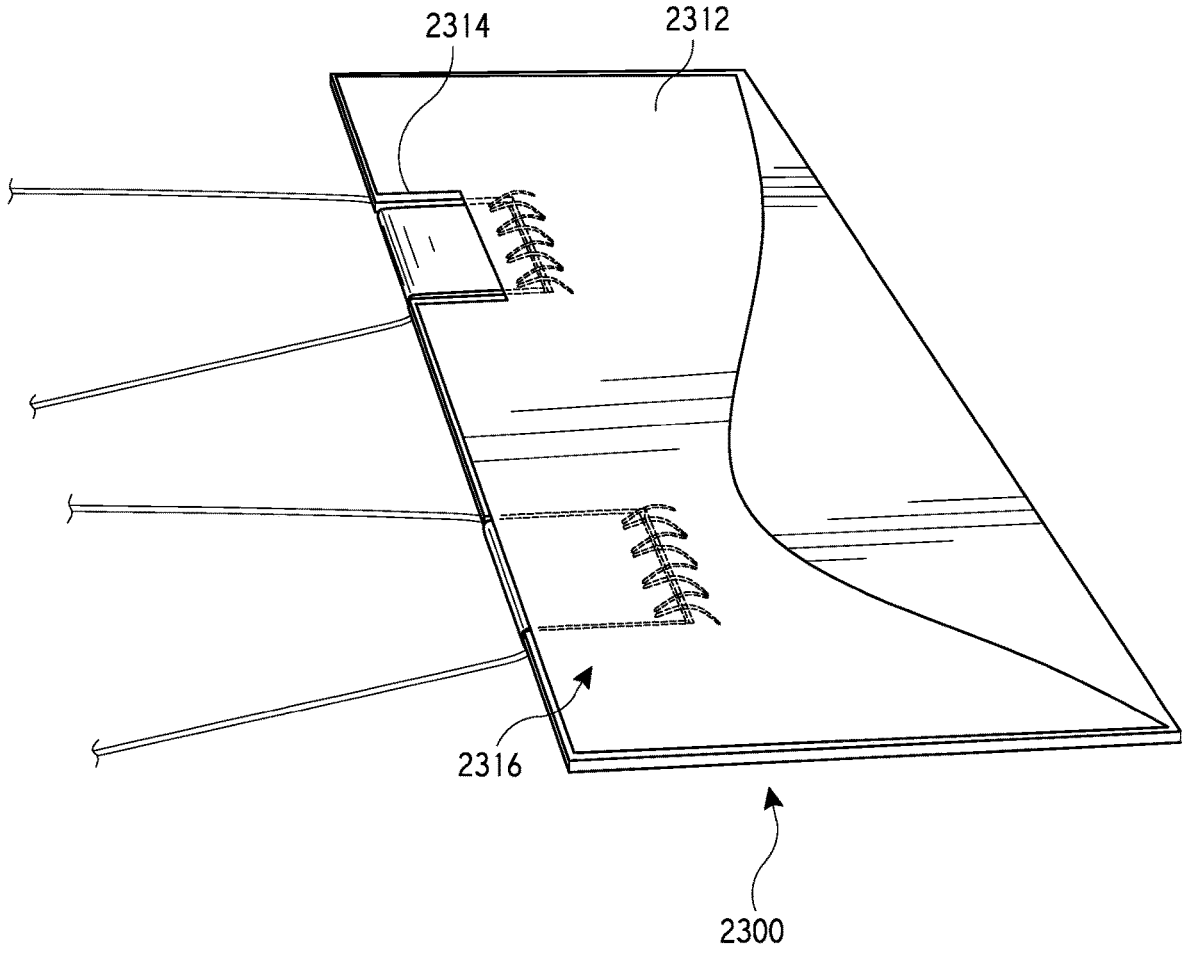

FIG. 23C illustrates a cover material 2312 that is positioned over the guide member 2300 and material guides 2304. The cover material 2312 hides or conceals the material guides 2304 so that they are not visible from the exterior of the cover material 2312. The cover material 2312 may also reinforce the coupling of the material guides 2304 and the material body 2304. The cover material 2312 may partially cover 2314 the guides or may fully cover 2316 the guides as desired.

Figure 23D:
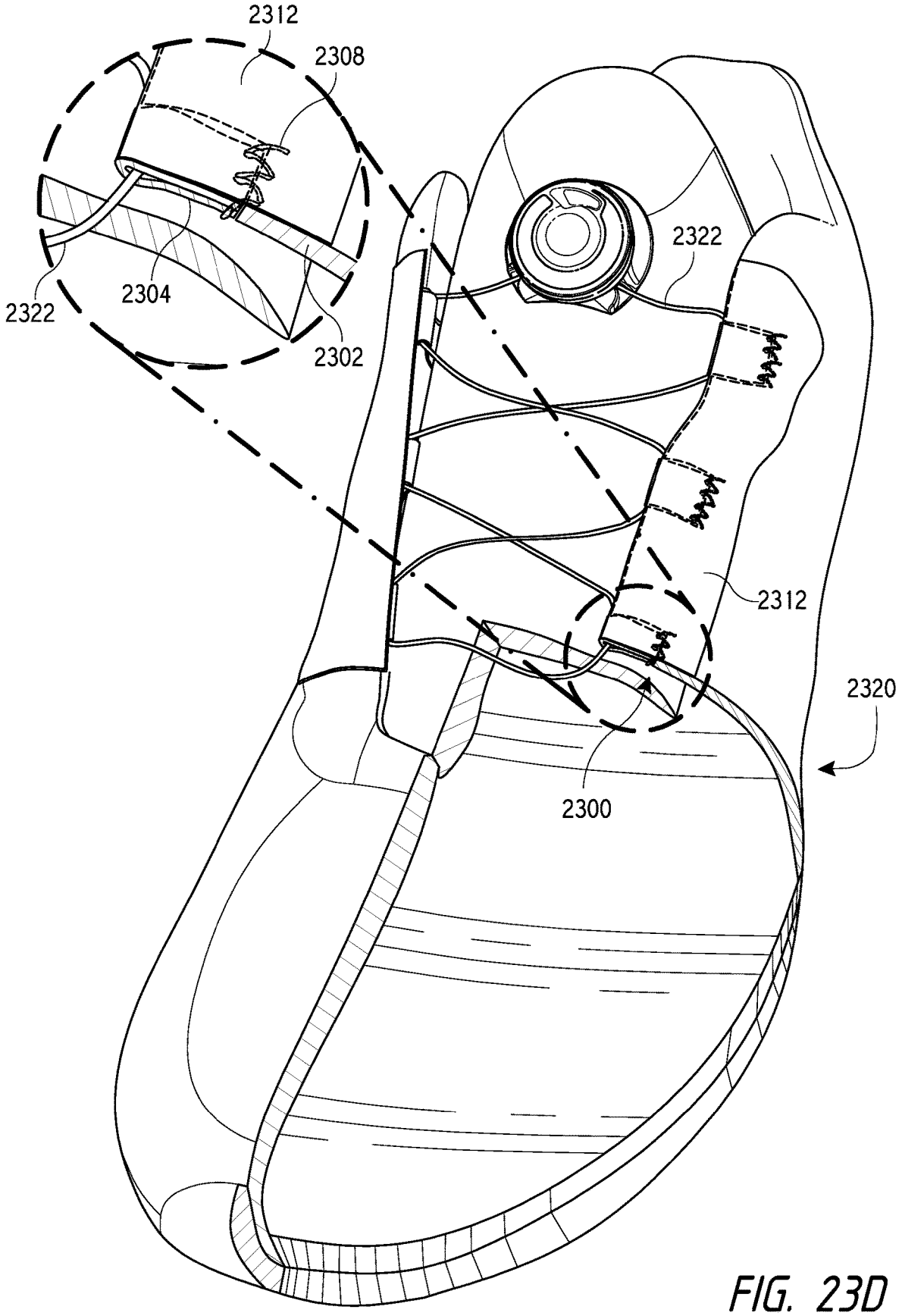

FIG. 23D illustrates the guide member 2300 attached to an upper of a shoe 2320. In some instances, the shoe's upper functions as the material body 2302 and the material guides 2304 are positioned within windows 2306 that are formed in the upper. The cover material 2312 may then be positioned atop the upper and material guides 2304 and attached to the upper to cover and conceal the material guides 2304. In other embodiments, the material body 2302 is attached to the upper material of the shoe 2320.

The guide member 2300 is positioned along opposing eyestays of the shoe 2320 so that the guide members 2304 are able to guide or route a lace 2322 along a path across the shoe's tongue. The individual guide members 2304 are hidden or concealed from view via the cover material 2312 that is positioned atop the guide member 2300. In some instances, the cover material 2312 may wrap around the shoe's eyestay and be attached to the outer and inner surfaces of the upper.

Figure 24A:
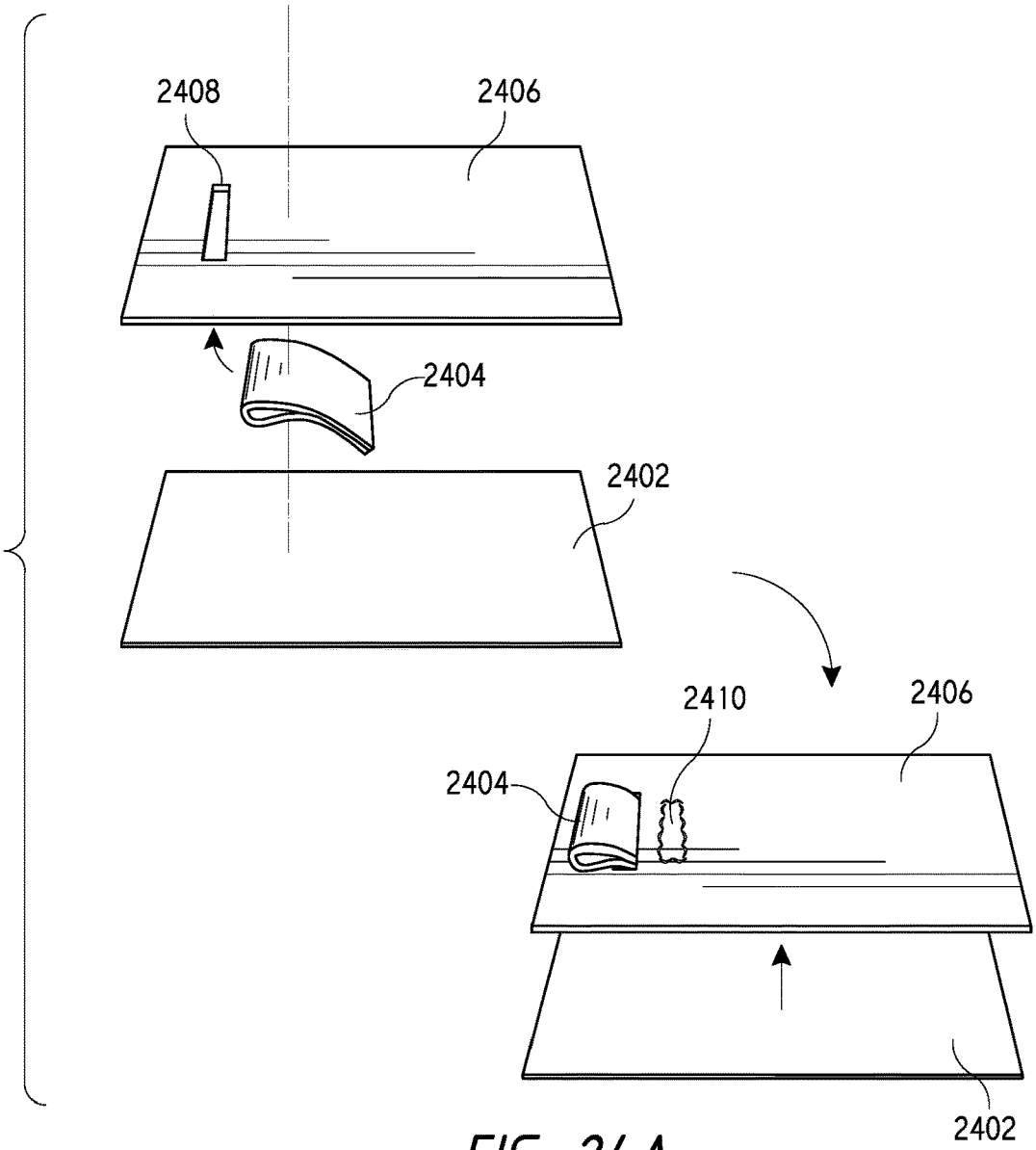
FIGS. 24A-B illustrate another guide member that may be used to route or guide a tension member about an article.
Figure 24B:
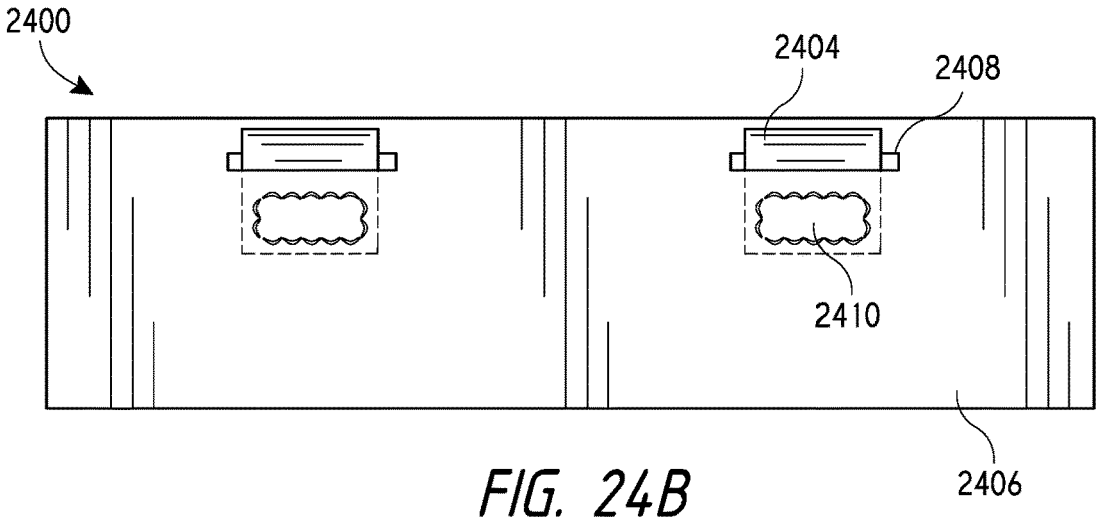

Referring now to FIGS. 24A-B, illustrated is another embodiment of a guide member 2400 that may be used to route or guide a lace about a path. The guide member 2400 includes an outer material body 2402 and an inner material body 2406 with a looped or folded material guide 2404 disposed there between. The material guide 2404 is positioned with respect to the inner material body 2406 so that a proximal end of the material guide 2404 is disposed between the inner material body 2406 and the outer material body 2402 and so that a distal end of the material guide 2404 protrudes through a slot or channel 2408 in the inner material body 2406. The protrusion of the material guide 2404 through the slot 2408 allows a lace (not shown) to access and be guided or routed by a looped end of the material guide 2404. In some embodiments, the material guide 2404 may be attached 2410 to the inner material body 2406 prior to coupling the inner material body 2406 and the outer material body 2402.

The distal end of the material guide 2404 may be recessed from the distal end of the inner material body 2406 as illustrated. This arrangement may enable the material guide 2404 to be fully concealed or hidden from view when the guide member 2400 is coupled with a shoe. In use, the guide member 2400 may be attached to a shoe so that the outer material body 2402 is positioned on an inner surface of the shoe's upper. In this arrangement, the inner material body 2406 would face the interior of the shoe and the material guide 2404 would be hidden or concealed from the exterior of the shoe via the outer material body 2402. In some embodiments, the outer material body 2402 may be the upper material of the shoe and the inner material body 2406 and material guide 2404 may be attached directly to the upper. In other embodiments, the guide member 2400 may be arranged so that the material guide 2404 faces outward of the shoe and is visible from the shoe's exterior.

Figure 25A:
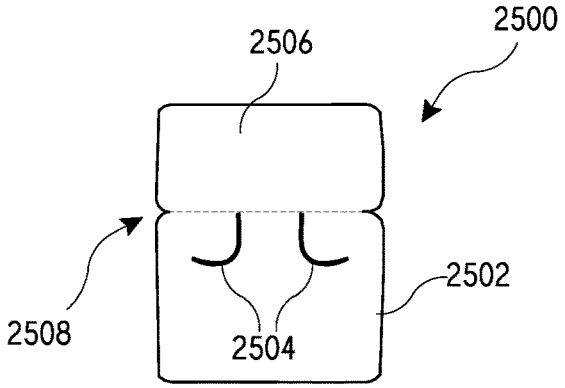
FIGS. 25A-D illustrate cover members that may be positioned over a lace guide to hide or conceal the lace guide and/or to reinforce the coupling of the lace guide with an article.

Referring now to FIGS. 25A-D, illustrated are embodiments of cover members that may be positioned over a lace guide to hide or conceal the lace guide and/or to reinforce the coupling of the lace guide with a shoe. FIG. 25A illustrates a cover member 2500 having a lower body 2502 and an upper body 2506. The upper body 2506 is configured to be folded about a fold line 2508 in coupling the cover member 2500 over a lace guide and with a shoe as described in greater detail below. In some instance, the cover member 2500 may be slightly indented on opposing sides of the cover member 2500 at the fold line 2508. In some instances, the material of the cover member 2500 may be designed to aid in folding the cover member 2500 about the fold line 2508. For example, the material may be slightly thinner and/or creased along the fold line 2508 to aid in folded the upper body 2506 about the lower body 2502. The lower body 2502 includes a pair of cuts 2504 in the material. The cuts 2504 have an arcuate or curved shape and are designed to enable opposing ends of the lace guide to protrude from within the cover member 2500.

Figure 25B:
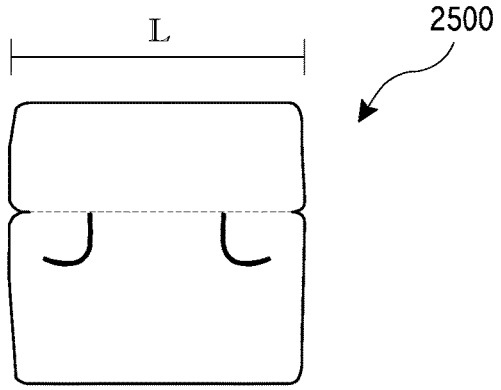

FIG. 25B illustrates another embodiment of a cover member 2500' that has an nearly identical configuration to the cover member 2500 of FIG. 25A except that the cover member 2500' has a longer lateral length L than the cover member 2500 of FIG. 25A. The cover member 2500' of FIG. 25B may be employed in instances where the lace guide has a longer lateral length in comparison with other lace guides.

Figure 25C:
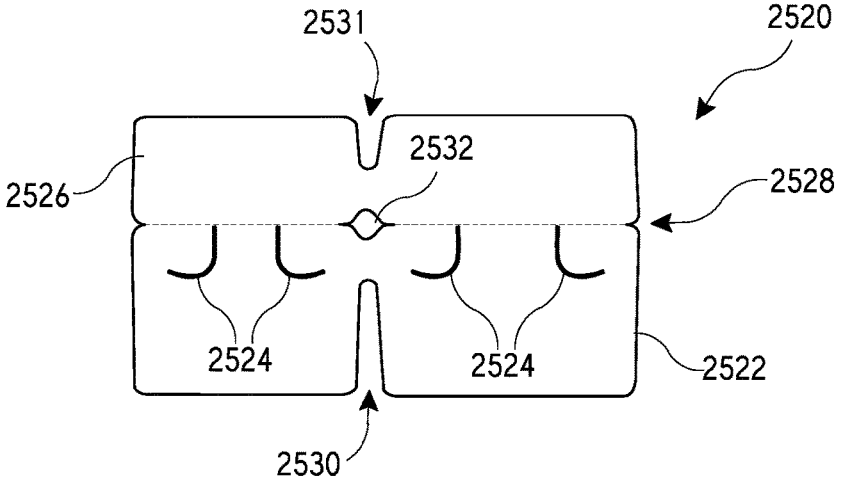

FIG. 25C illustrates a cover member 2520 that include multiple lower body members 2522 and upper body members 2526. The cover member 2520 may be employed when it is desired to cover multiple lace guides with the same cover member. As with the previous embodiment, the cover member 2520 of FIG. 25C is configured so that the upper body members 2526 fold in half about the lower body member 2522 along the fold line 2528. The cover member 2520 may be indented on opposing sides along the fold line 2528 and/or include a relief cut 2532 positioned along the fold line 2528 and mid-way along the lateral length. The relief cut 2532 may aid in folding the upper body member 2526 about the lower body member 2522 and/or may allow dirt and debris that is trapped within the cover member 2520 to escape.

In some instances, the cover member 2520 may include additional relief cuts, 2530 and/or 2531, that are positioned between the upper body members 2526 and lower body member 2522 and protrude inward into the respective body members. The relief cuts, 2530 and/or 2531, may provide additional areas where trapped dirt and debris are able to escape from within the cover member 2520. The relief cuts, 2530 and/or 2531, may also demarcate the upper and lower body members.

The lower body member 2522 each include a pair of cuts 2524 in the material that have an arcuate or curved shape. The cuts 2524 correspond to the shape of opposing ends of the lace guide and are used to enable the opposing ends of the lace guide to protrude outward from the cover member 2520. The cuts 2524 of the lower body members 2522 may have a similar lateral spacing between each cut, or the lateral spacing may be varied to accommodate the use of different sized and shaped lace guides. Similarly, the lower and upper body members, 2522 and 2526, may have similar lateral and/or longitudinal lengths or variable lateral and/or longitudinal lengths.

Figure 25D:
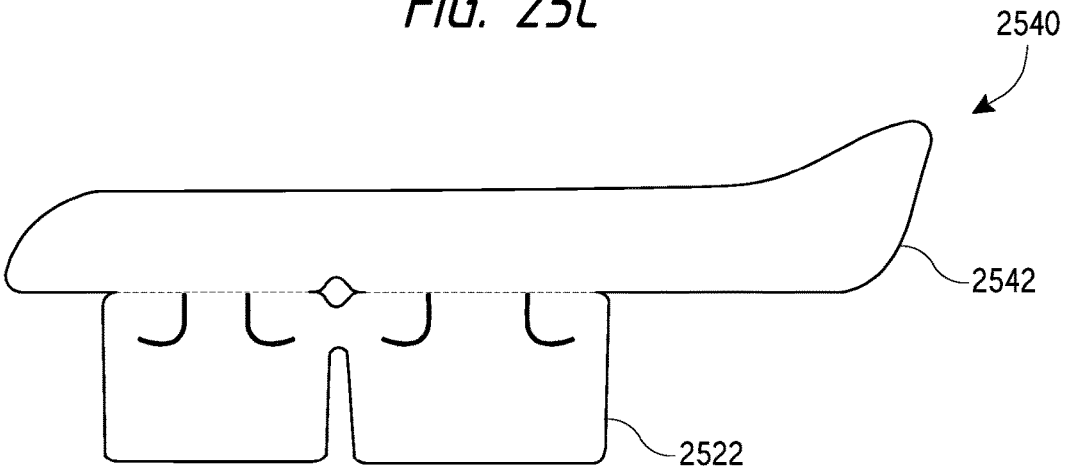

FIG. 25D illustrates a cover member 2540 that includes lower body members 2522 similar to those illustrated in FIG. 25C, but that includes an elongated upper body member 2542. The elongated upper body member 2542 may be employed when it is desirable to cover a large portion of a shoe's upper as illustrated in FIG. 27D. As illustrated, the opposing ends of the elongated upper body member 2542 may have different sizes and/or shapes as desired. The shape and size of the elongated upper body member 2542 may correspond to the shoe's upper and/or be designed to provide a desired visual look.

Figure 26A:
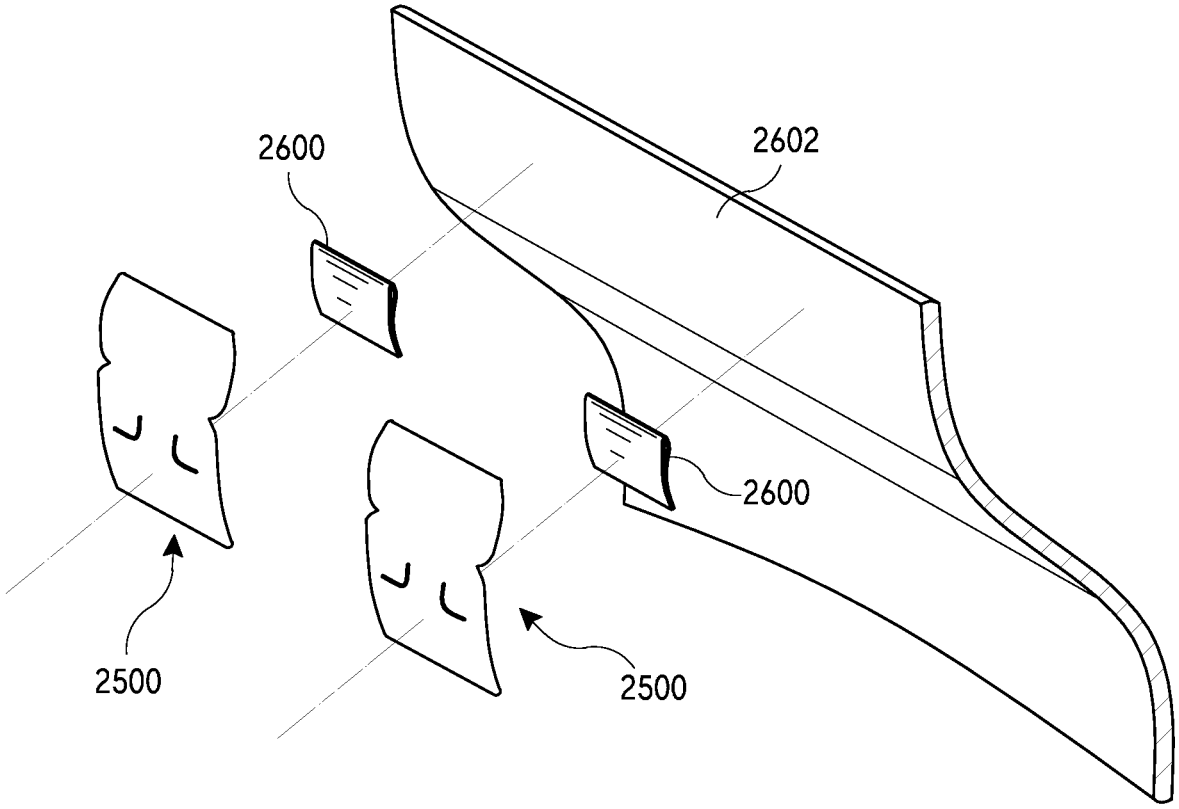
FIGS. 26A-D illustrate a process of attaching the cover member of FIG. 25A to a shoe's upper.
Figure 26B:
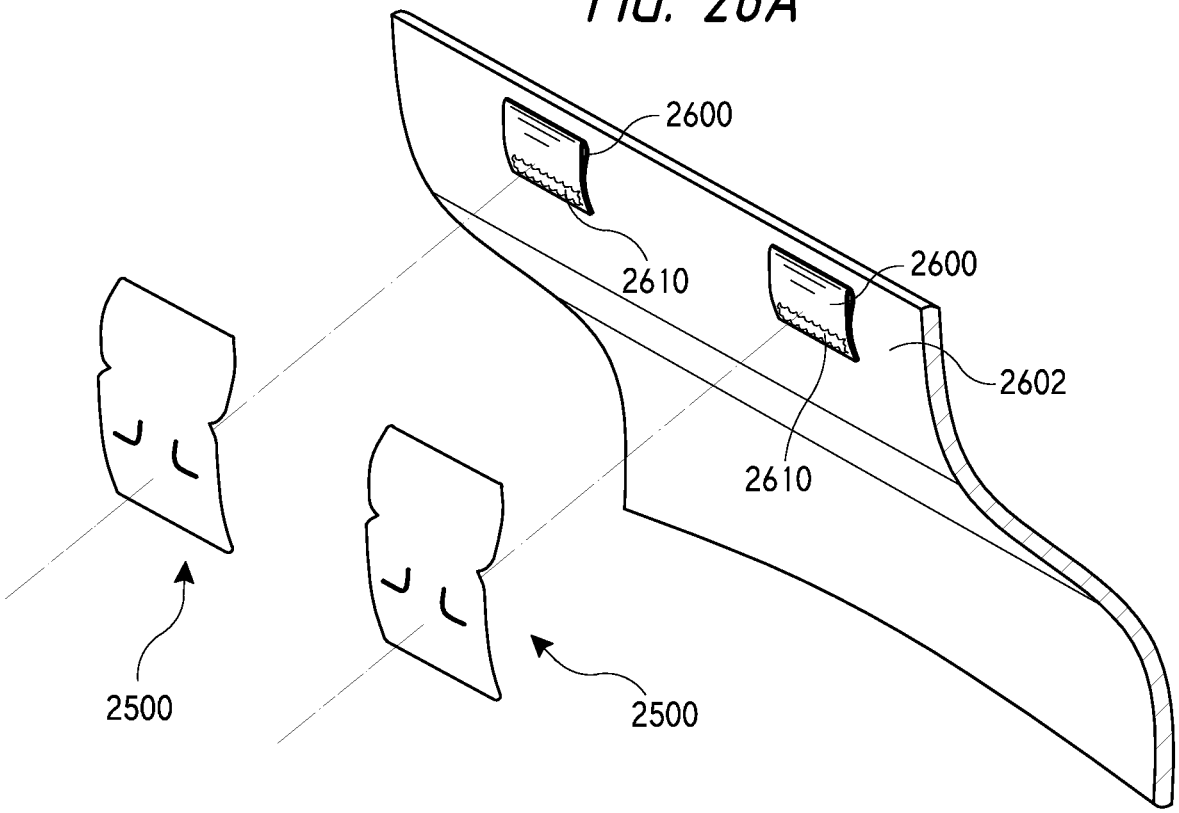

Referring now to FIGS. 26A-D, illustrated is a process of attaching a cover member 2500 to a shoe's upper 2602. FIG. 26A illustrates that a pair of cover members 2500 are provided in an initially unfolded state. The cover members 2500 are aligned with corresponding lace guides 2600 and with an inner surface of the upper 2602. The lace guides 2600 include a folded material that defines a looped end through which a lace may be inserted as described herein. In FIG. 26B, the lace guides 2600 are positioned against the inner surface of the upper 2602 and are coupled therewith 2610 via stitching, adhesive bonding, welding (e.g., RF, sonic, etc.), mechanical fastening, and the like. The lace guides 2600 are typically attached to the upper 2602 so that a distal edge of the lace guides 2600 is recessed or offset from a distal edge of the upper 2602 as illustrated.

Figure 26C:
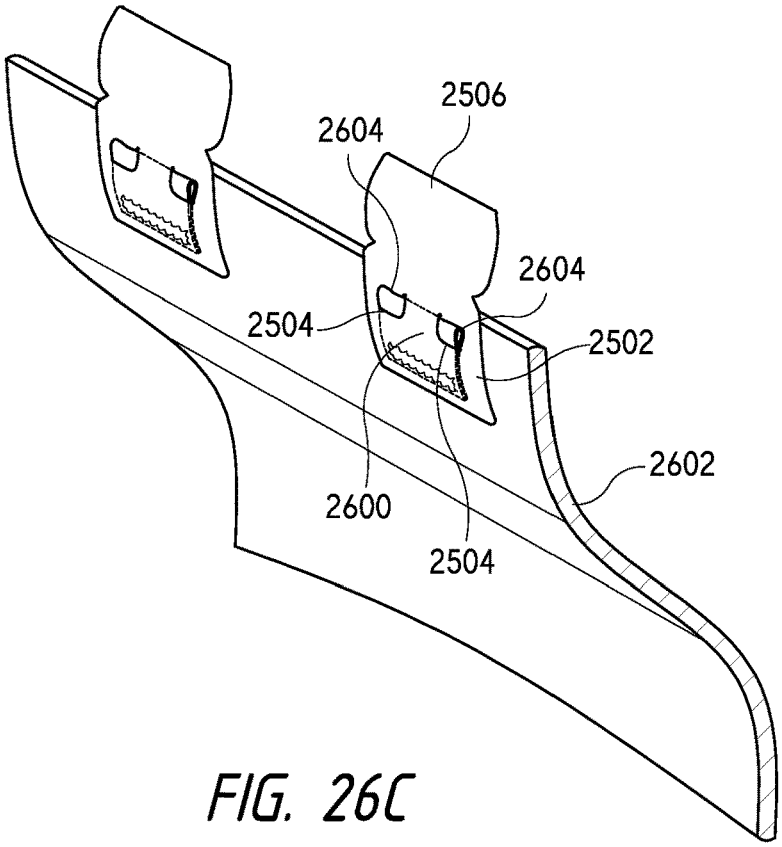

In FIG. 26C, the cover member 2500 is positioned adjacent the lace guide 2600 and upper 2602 so that the lace guide 2600 is disposed between the upper 2602 and the cover member 2500. The cover member 2500 is typically positioned so that it entirely covers the lace guide 2600. The opposing ends 2604 of the lace guide 2600 are then pulled through, or otherwise positioned through, the pair of cuts 2504 in the lower body member 2502 of the cover member 2500 so that the opposing ends 2604 protrude outward from the surface of the cover member 2500. In this manner, the opposing ends 2604 of the lace guide, and the lace lumen or channel disposed there between, are exposed and accessible to the lace. The arcuate or curved shape of the cuts 2504 enables the opposing ends 2604 of the lace guide 2600 to be easily pulled through the cuts 2504.

Figure 26D:
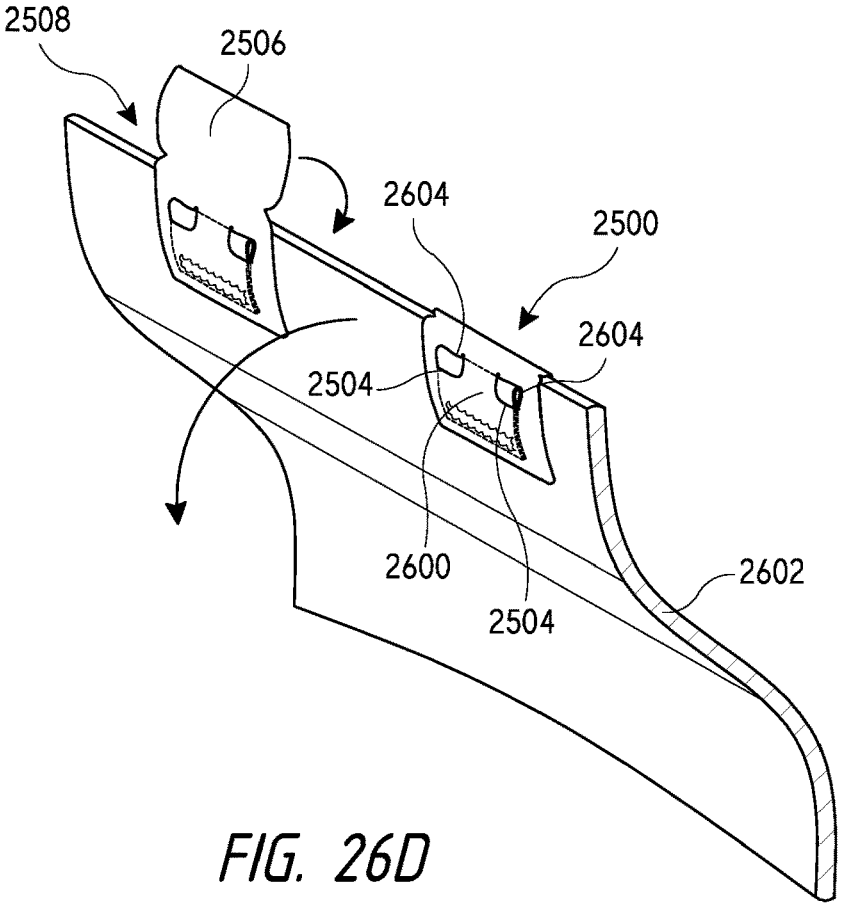

In FIG. 26D, the cover member 2500 is folded along the fold line 2508 over the distal edge of the upper 2602. The cover member 2500 may then be fixedly attached to the upper 2602 with the lace guide 2600 covered and concealed under the cover member 2500. In some embodiments, the lower body member 2502 may be attached to the upper 2602 first and the upper body member 2506 may be subsequently attached to the upper 2602. In other embodiments, the upper and lower body members, 2502 and 2506, may be simultaneously attached to the upper 2602. The cover member 2500 may be positioned so that the lower body member 2502 and lace guide 2600 are positioned on the inside of the shoe, or may be positioned so that these components are on the exterior of the shoe as desired.

Figure 27A:
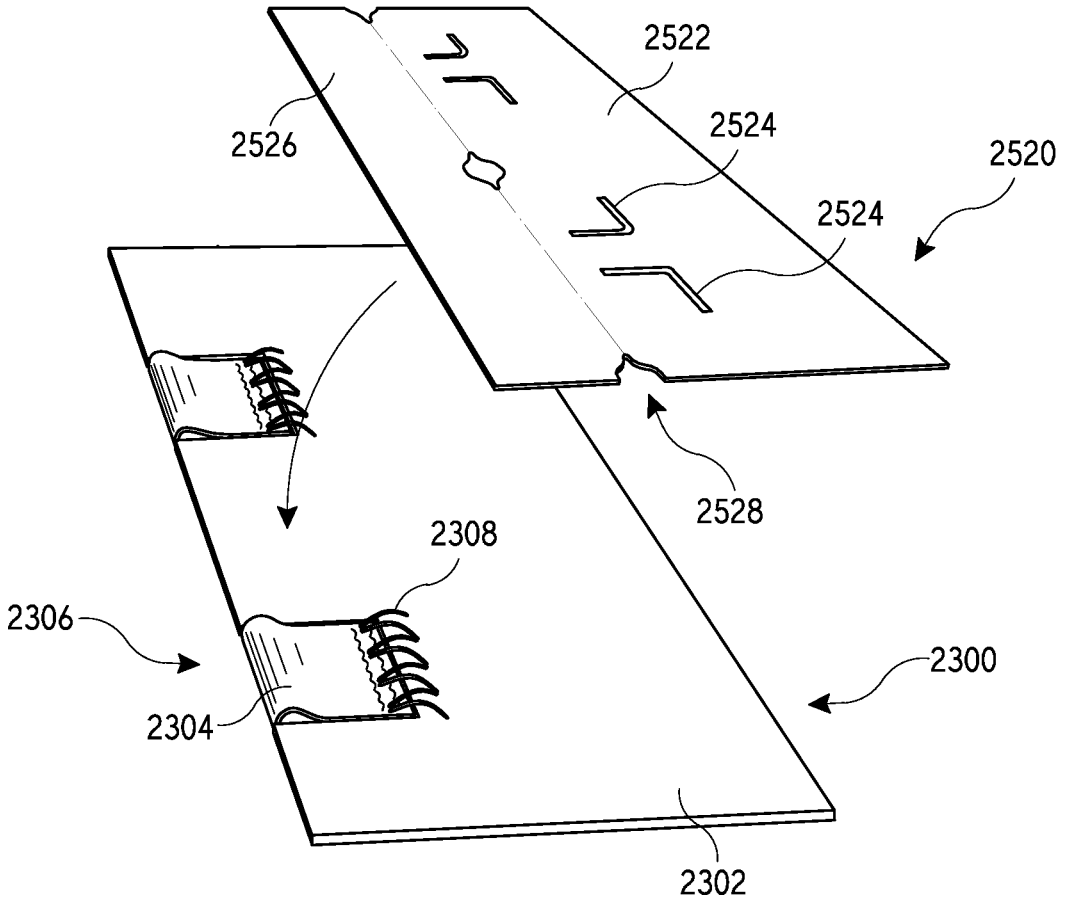
FIGS. 27A-J illustrate various embodiments of tension member guides that may be coupled with an article to direct or route a tension member about a path of the article.
Figure 27B:
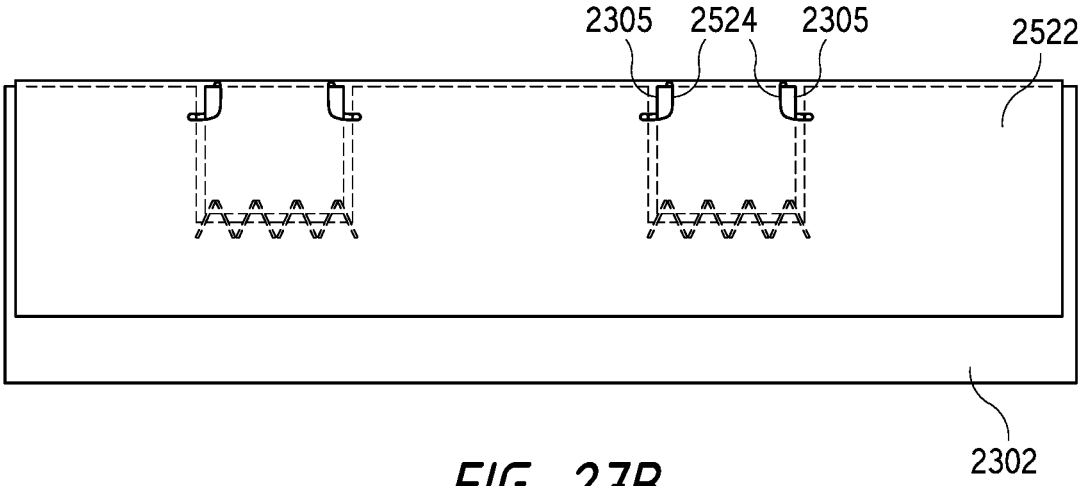

FIGS. 27A-B illustrate the cover member 2520 being employed to cover the guide member 2300 of FIGS. 23A-B. FIG. 27A illustrates the guide member 2300 having a pair of material guides 2304 positioned within corresponding windows 2306 of the material body 2302. The cover member 2520 includes multiple pairs of cuts 2524 that are positioned about the lower body member 2522 so as to correspond to the position of the guide member's material guides 2304. The cover member 2520 is also shaped and sized corresponding to the shape and size of the guide member 2300. As previously described, the upper body member 2526 is configured to fold about or over the lower body member 2522 along fold line 2528.

FIG. 27B illustrates the cover member 2520 positioned over the guide member 2300. The upper body member 2526 of the cover member 2520 is folded about the fold line 2528 and is positioned on an opposite side of the guide member 2300. Opposing sides 2305 of the material guides 2304 are positioned so as to protrude through the corresponding pairs of cuts 2524. As illustrated the material guides 2304 are essentially entirely covered, hidden, and concealed by the cover member 2520.

Figure 27C:
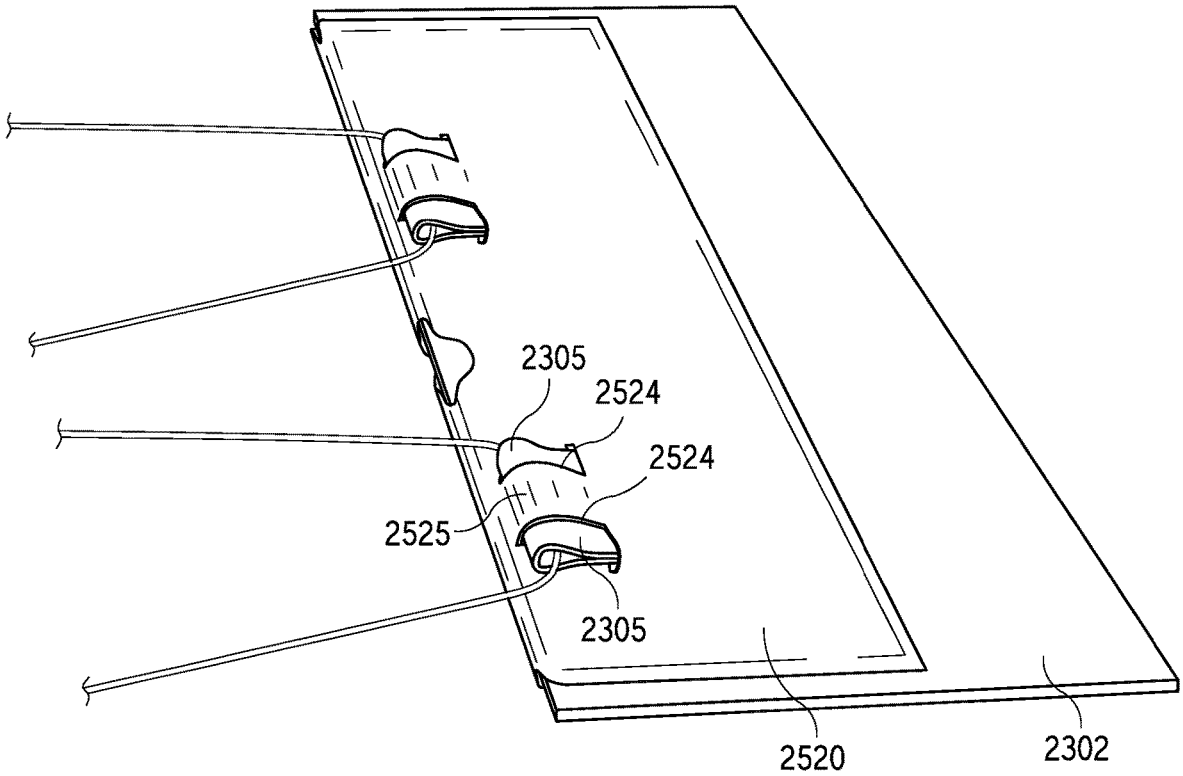
Figure 27D:
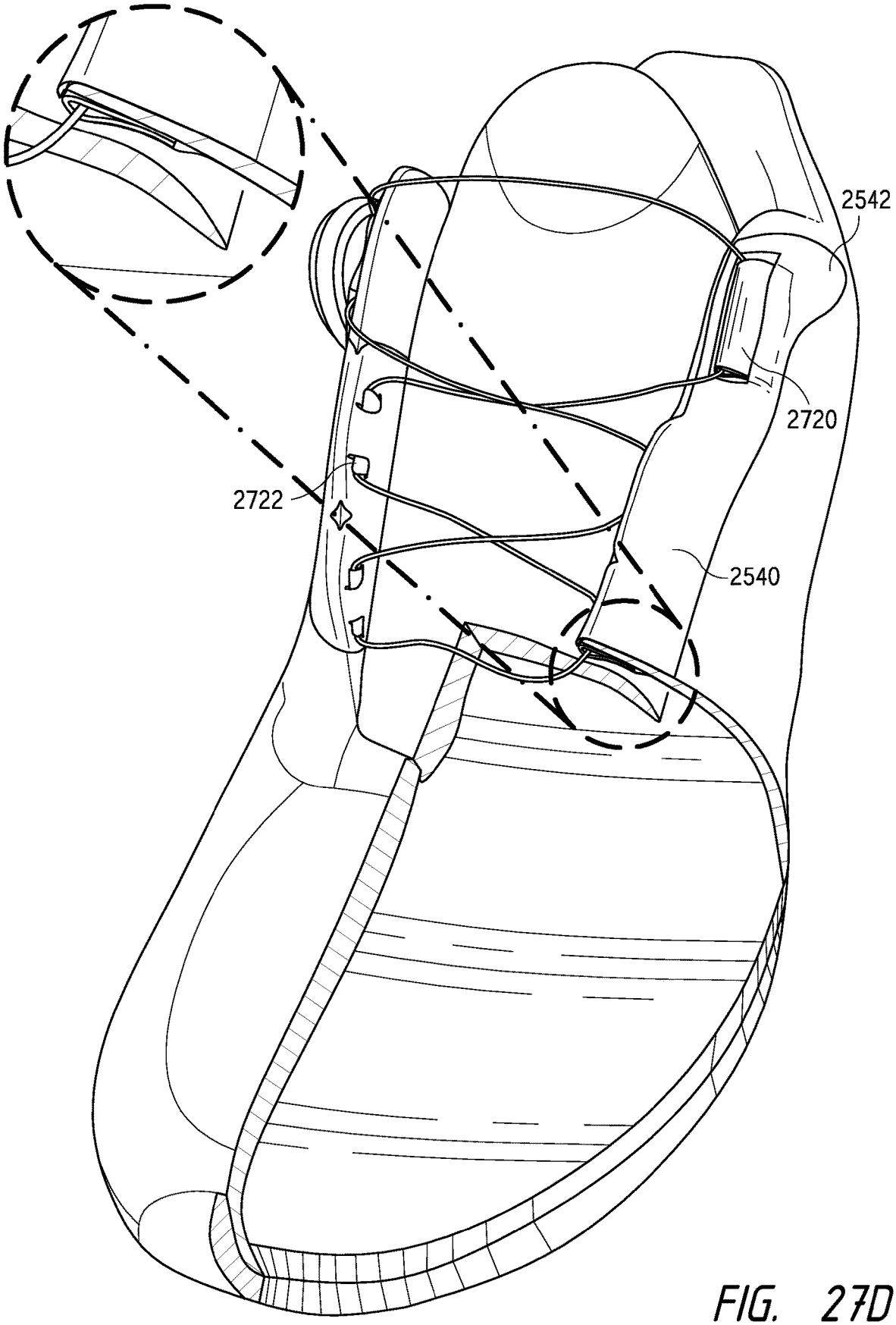

FIG. 27C illustrates a perspective view of the cover member 2520 positioned over the guide member 2300. FIG. 27C illustrates the accessibility of the opposing ends 2305 of the material guides 2304 due to the opposing ends 2305 be inserted through the corresponding pairs of cuts 2524. A lace is inserted through the opposing ends 2305 and through a channel or lumen that is disposed there between. With the opposing ends 2305 inserted through the pairs of cuts 2524, a bridge or strip of material 2525 is formed or defined atop the looped end of the material guides 2304. The cover member 2520 may be used to cover and conceal the material guides 2304 and/or reinforce the attachment of the material guides 2304 with the material body 2302 of the guide member 2300.

FIG. 27D illustrates the cover member 2540 being positioned about a shoe so that the cover member 2540 covers multiple lace guides arranged about the shoe. The cover member 2540 is illustrate with the upper body member 2542 folded about the lower body member. The cover member 2540 cover multiple guides 2722 that are positioned on an inner surface of the shoe's upper. The cover member 2540 also covers one or more lace guides 2720 that are positioned on the exterior surface of the shoe's upper. The cover member 2540 may cover the inner guides 2722 so that only the opposing ends of the inner guides 2722 protrude from the cover member 2540 as shown. In some embodiments, the exterior guide(s) 2720 may protrude through a slot or channel similar to that illustrated in FIGS. 24A-B. The elongated upper body member 2542 may function to both conceal the various guides and provide the shoe with a uniform look or appearance.

Figure 27E:
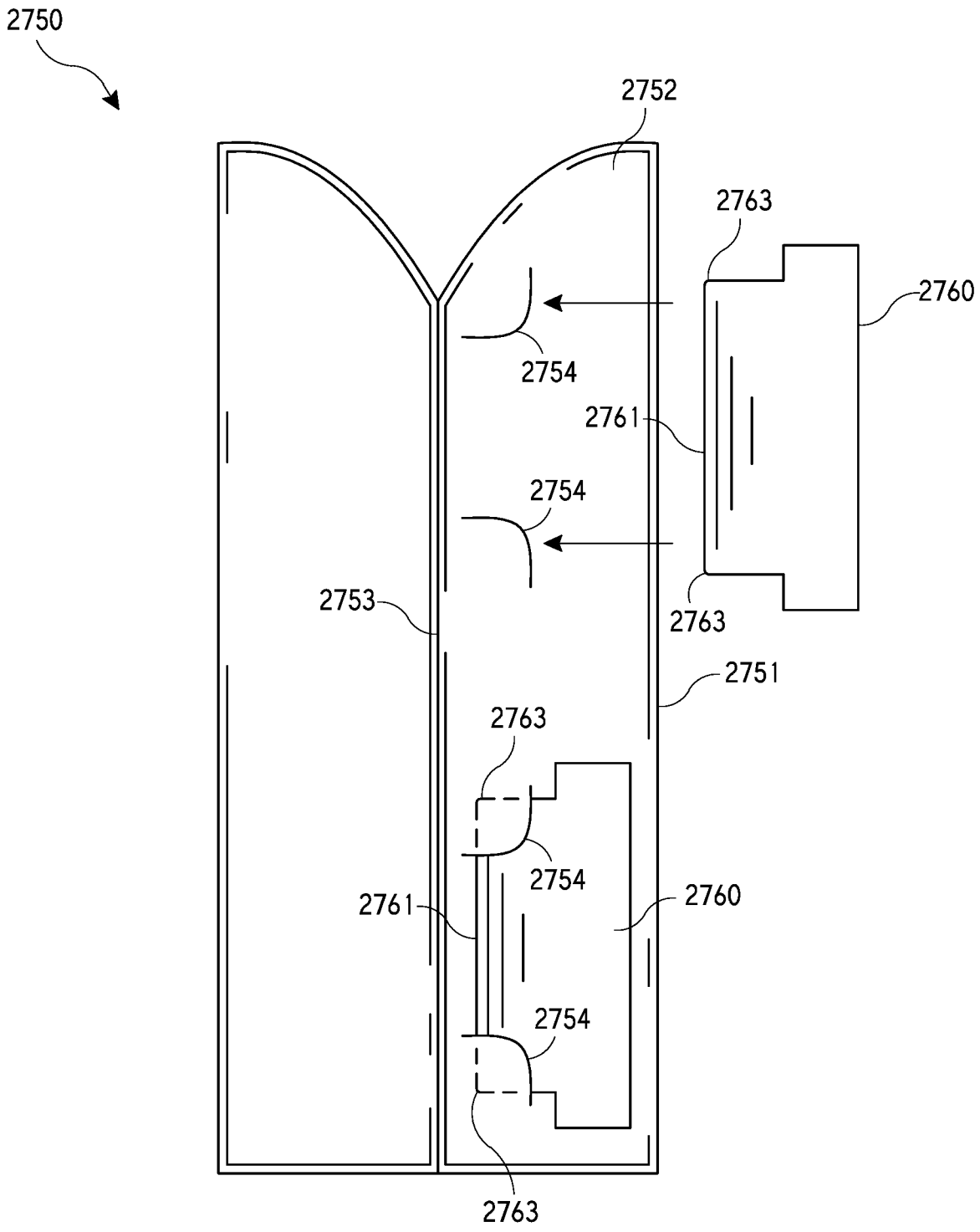
Figure 27F:
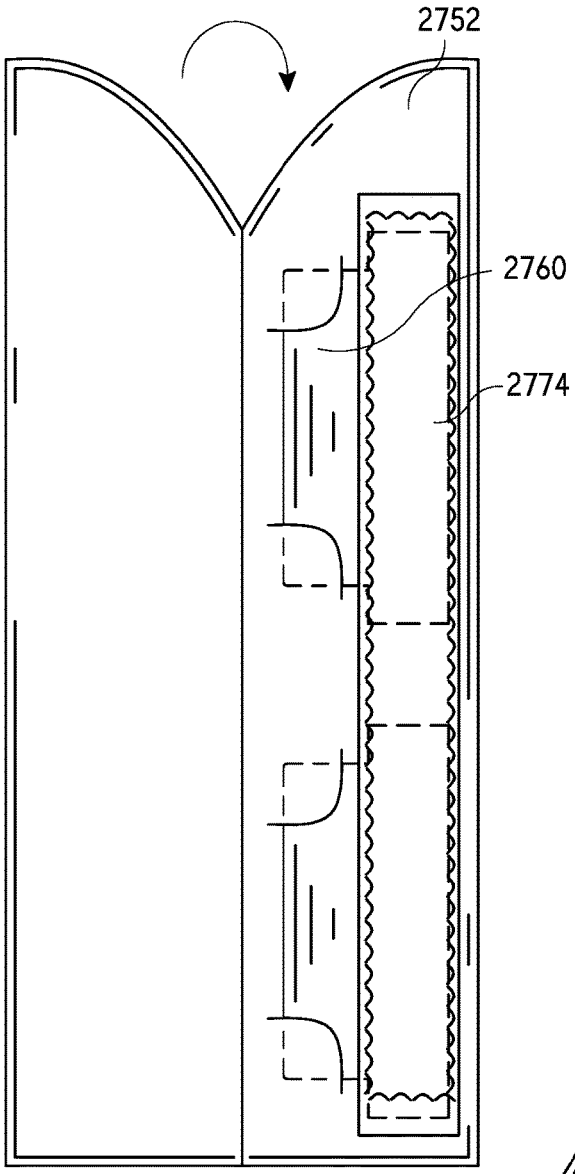
Figure 27G:
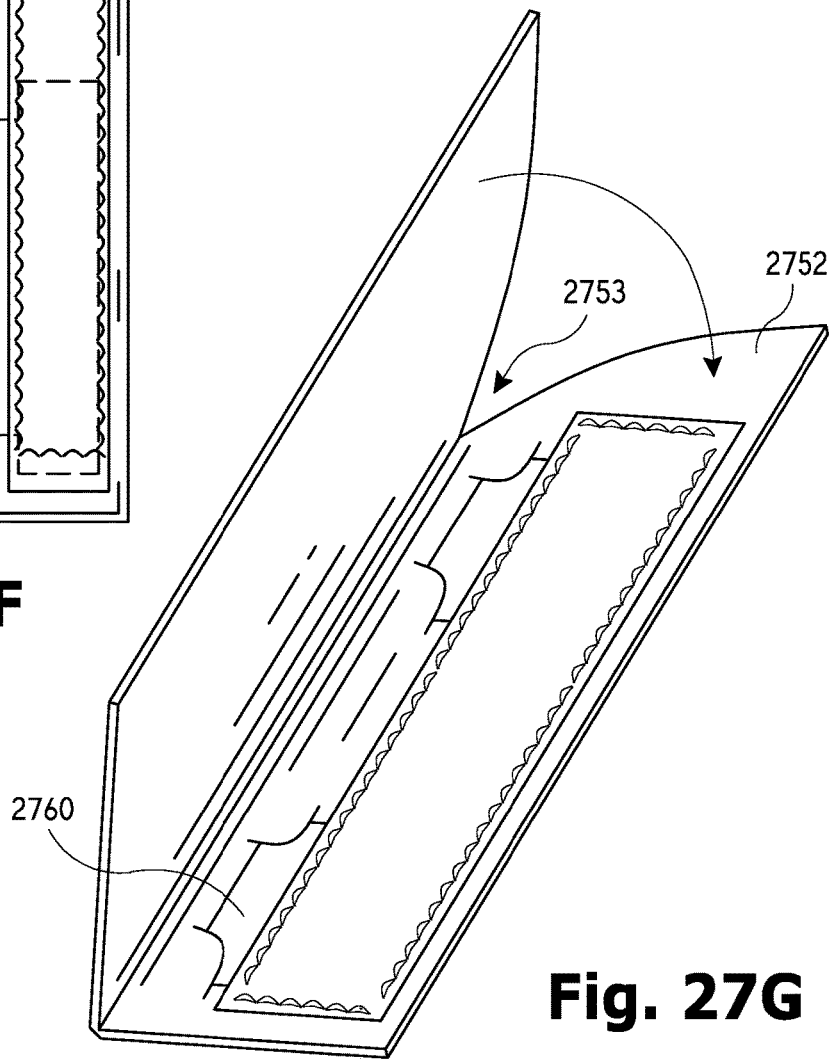
Figure 27H:
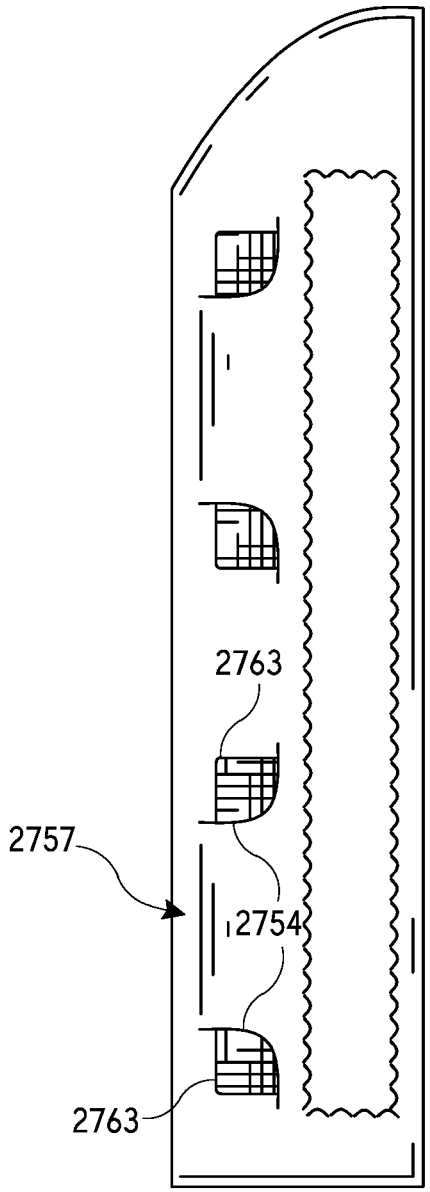
Figure 27I:
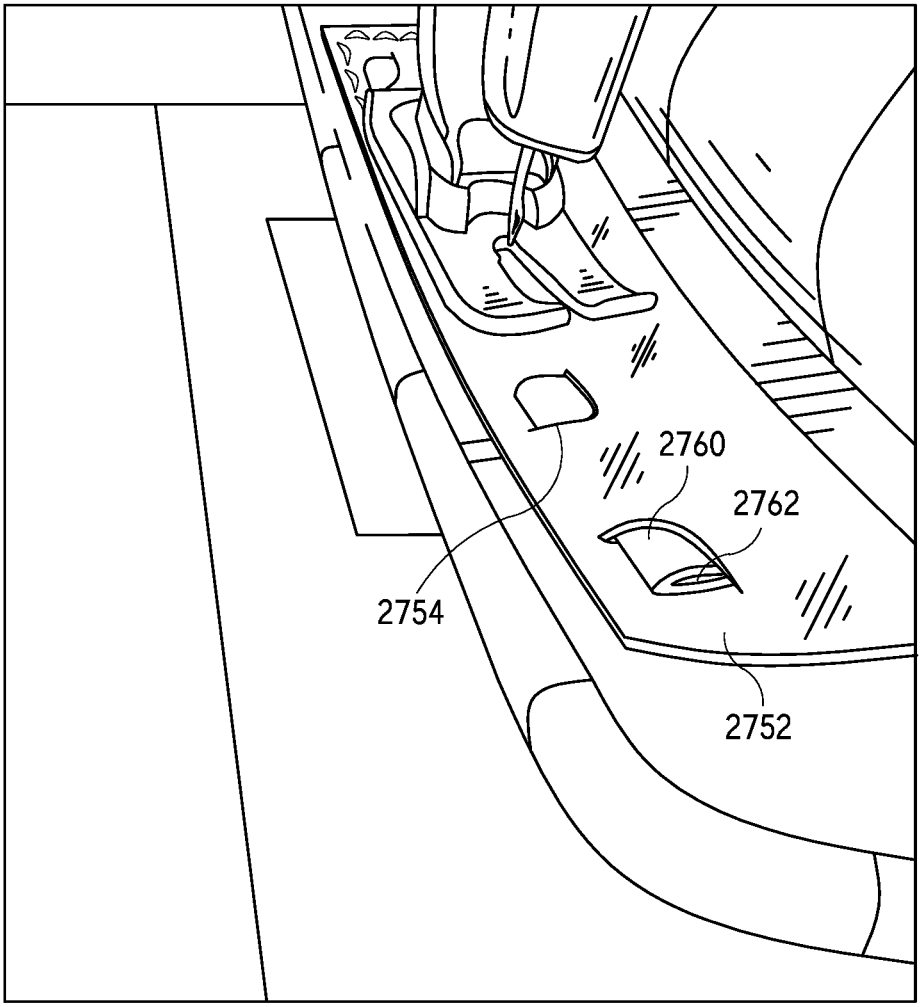
Figure 27J:
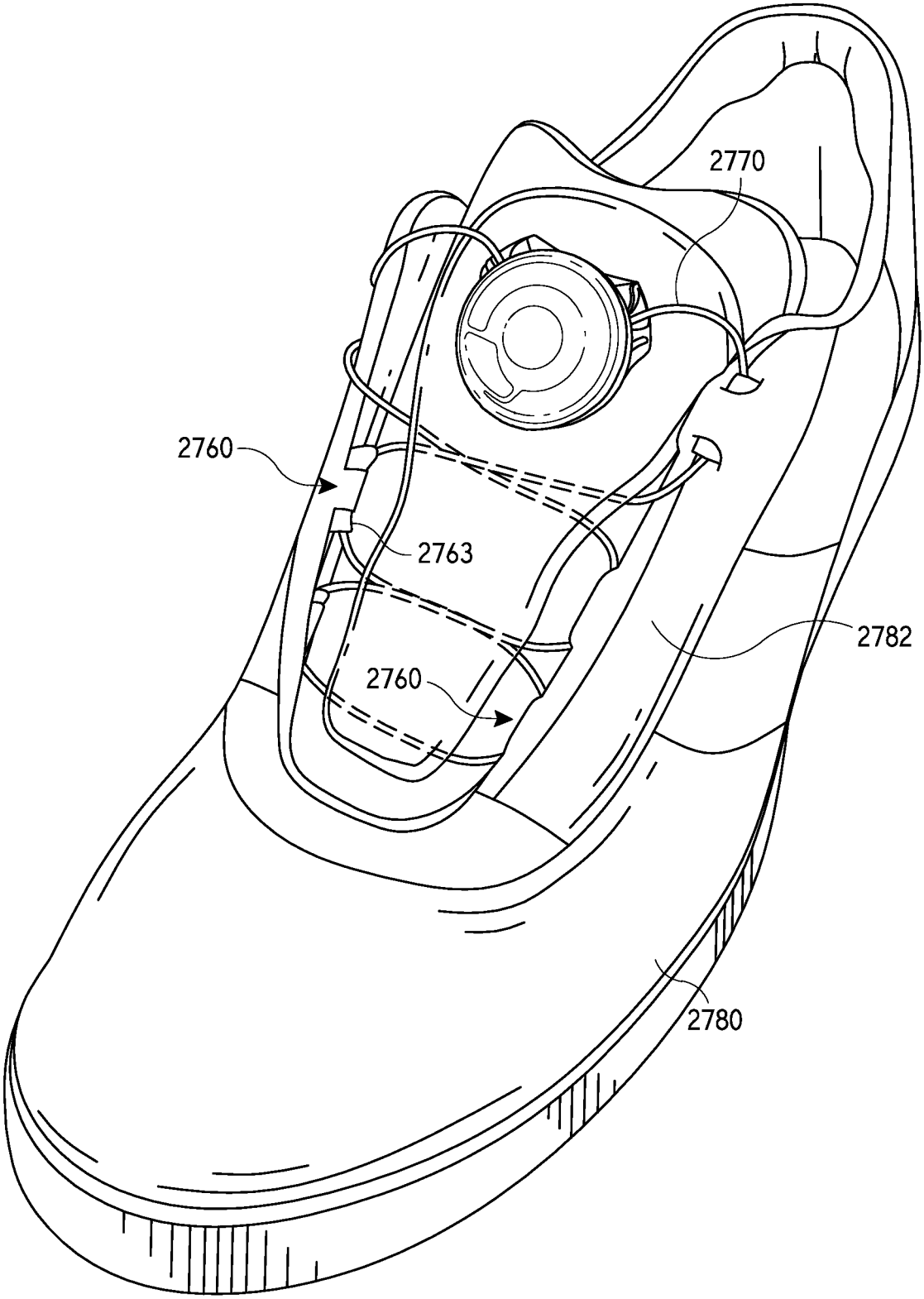

FIGS. 27E-J illustrate an embodiment of a tension member guide 2750 that is similar to that illustrated in FIGS. 27A-D. The tension member guide 2750 is coupleable with an article, such as a shoe or other footwear, and is configured to direct or route a tension member about a path of the article. The tension member guide 2750 includes a main body or cover member 2752 (hereinafter cover member 2752) that includes a first or proximal end 2751 and a second or distal end 2753. The proximal end 2751 or proximal portion may be coupleable with the article, such as a shoe or other footwear. When coupled with the shoe/footwear, the cover member 2752 typically is positioned along an eyestay of the shoe/footwear as shown in FIG. 27J. The distal end 2753 is positioned on an opposite side of the main body from the proximal end 2751 and in some embodiments, the distal end 2753 represents a seam or line upon which the cover member 2752 is folded. The cover member 2752 also includes a pair of slits or incisions 2754 that are positioned near the distal end 2753 of the cover member 2752.

The tension member guide 2750 also includes a guide member 2760 having a longitudinal length and a lateral width. The guide member 2760 is folded along the longitudinal length to form a loop or channel 2762 within which a tension member 2770 is inserted (see FIGS. 27I-J). The folded guide member 2760 is similar to the material guide 2304 previously described. The guide member 2760 may be made of any of the materials described herein, or otherwise known in the art, and is typically made of a low friction material. In a specific embodiment, the guide member 2760 has a two layer construction that includes a low friction inner material and a structurally supportive outer layer as described in various embodiments herein. The cover member 2752 is typically made of a structurally strong and aesthetically pleasing material and may include any of the materials described herein or otherwise known in the art.

The guide member 2760 has a center portion 2761 and two end portions 2763 along its lateral width with the two end portions 2763 being disposed on opposite sides of the center portion 2761. The guide member 2760 is positioned on the cover member 2752 so that each end portion 2763 is inserted through one of the slits or incisions 2754 as illustrated. When the guide member 2760 is positioned on the cover member 2752 in this manner, the two end portions 2763 are positioned on an opposite side of the cover member 2752 from the center portion 2761. In addition, as illustrated in FIG. 27H, a portion of the cover member 2752 that is disposed between the pair of slits or incisions 2754 covers, or is disposed or positioned over, the center portion of the guide member 2760 when the tension member guide 2750 is fully assembled and/or coupled with the article. In FIG. 27H, the reference numeral 2757 identifies the portion of the cover member 2752 that covers the center portion 2761 of the guide member 2760.

As illustrated in FIG. 27E, in some embodiments the guide member 2760 may have wider proximal end than a distal end, which may aid in coupling the guide member 2760 to the proximal end of the cover member 2752. In some embodiment, the tension member guide 2750 may only include a single guide member 2760 that is positioned within the cover member 2752. In other embodiment, the cover member 2752 may include an additional pair of slits or incisions 2754 as illustrated in FIG. 27E. The cover member may similarly include a tertiary pair of slits or incisions, a quaternary pair of slits or incisions, or any other number of slits or incisions that are desired. In such embodiments, the tension member guide 2750 includes an additional guide member 2760 (or tertiary guide member, quaternary guide member, etc.) that is positioned on the cover member 2752 so that opposing end portions 2763 of the additional guide member 2760 are inserted through the additional pair of slits or incisions 2754 as described herein.

As illustrated in FIG. 27J, when the tension member guide 2750 is coupled with a shoe or other footwear 2780, the two end portions 2763 of one or more of the guide members 2760 may be positioned on an interior side of an upper 2782 of the footwear 2780. In some embodiments, when the tension member guide 2750 is coupled with the footwear 2780, the end portions 2763 of one guide member 2760 may be positioned on an exterior surface of the upper 2782 while the end portions 2763 of another guide member 2760 are positioned on an interior surface of the upper 2782.

As illustrated in FIG. 27F, in some embodiments a reinforcement member 2774 is attached to the cover member 2752 and to a proximal end of the guide member 2760. The reinforcement member 2774 may be roughly rectangular in shape and may be attached to the proximal end of the guide member 2760 via heat or RF welded, adhesive bonding, stitching, mechanical fastening, and the like. The reinforcement member 2774 helps prevent separate of the guide member 2760 from the cover member 2752 by reinforcing the coupling or attachment of the guide member 2760 with the cover member 2752.

As illustrated in FIG. 27G, in some embodiments the cover member 2752 is folded along the seam or distal end 2753 and over the guide member 2760. In such embodiments, a majority of the guide member 2760 is sandwiched or disposed between opposing sides of the cover member 2752. As illustrated in FIG. 27I, the cover member 2752 may then be coupled together with the opposing sides covering a majority of the guide member 2760. In coupling the tension member guide 2750 with the footwear 2780, the cover member 2752 may also be folded over an eyestay edge of the footwear 2780. The coupling of the tension member guide 2750 that is illustrated in FIG. 27I may be representative of how the tension member guide 2750 is coupled with the footwear 2780 or another article. In particular, the cover member 2752 may be folded along the seam 2753 and then positioned on the footwear 2780 or other article, after which the cover member 2752 may be coupled together over the guide member 2760 at the same time the tension member guide 2750 is coupled with the footwear 2780 or article. In addition, while FIG. 27I illustrates the tension member guide 2750 and/or cover member 2752 being stitched, in other embodiments the tension member guide 2750 and/or cover member 2752 may be coupled together and/or to the footwear 2780 or article via heat or RF welding, adhesive bonding, mechanical fastening, and the like. In a specific embodiment, a surface or face of the cover member 2752 (typically an inner surface of face that contacts the upper 2782) includes a material that is heat weldable to the footwear 2780. The heat weldable material may be thin polymer material that is positioned on the surface or face of the cover member 2752 to enable the cover member 2752 to be heat welded to the footwear 2780.

A method of coupling a tension member guide 2750 with footwear 2780 includes providing the tension member guide 2750 having a configuration as described herein and coupling the tension member guide 2750 with the footwear 2780 so that the two end portions 2763 are positioned near an eyestay edge of the footwear 2780. The method also typically includes inserting the tension member 2770 through the loop or channel 2762 of the guide member 2760. The method may further include folding the cover member 2752 over the guide member 2760 so that the guide member 2760, other than the two end portions 2763, is positioned between opposing sides of the cover member 2752. In some embodiments, coupling the tension member guide 2750 with the footwear 2780 includes heat welding a surface or face of the cover member 2752 to the footwear 2780. In some embodiments, the tension member 2770 is disposed under the cover member 2752 so that the tension member 2770, or a majority thereof, is not externally visible. In such embodiments, the visibility of the tension member 2770 and guide members 2760 may be minimized or essentially non-existent, which may provide the shoe 2780 with a relatively clean and aesthetically pleasing look.

In some embodiments, it may be beneficial to construct the shoe so that as a reel based tightening mechanism is operated, a more conforming fit of the shoe about the user's foot is achieved. The term "more conforming fit" as used herein implies that the fit of the shoe about the user's foot is increased in respect to conventional shoes in which it is difficult to pull or press portions of the shoe into contact with the user's foot, such as near the arch of the foot. One means of constructing a shoe to achieve an increased fit of the shoe about the foot is via weaving a material in a manner so that as the material is tensioned via a tension member, the weave pattern causes the material to conform to the shape of the user's foot. In particular, the weave may be chosen so that the material bends, flexes, or otherwise moves in a desired manner that may be engineered to conform to a user's foot. The concept of applying a specific material weave to achieve an engineered movement of the material may be applied to various sections of the shoe so that a unique and differing movement of the material is achieved in each of the different sections of the shoe. In this manner, the shoe may be initially shaped to facilitate in donning of the shoe and then various sections of the shoe may uniquely move, bend, flex, or otherwise conform to the user's foot in response to tensioning of a tension member.

Figure 28A:
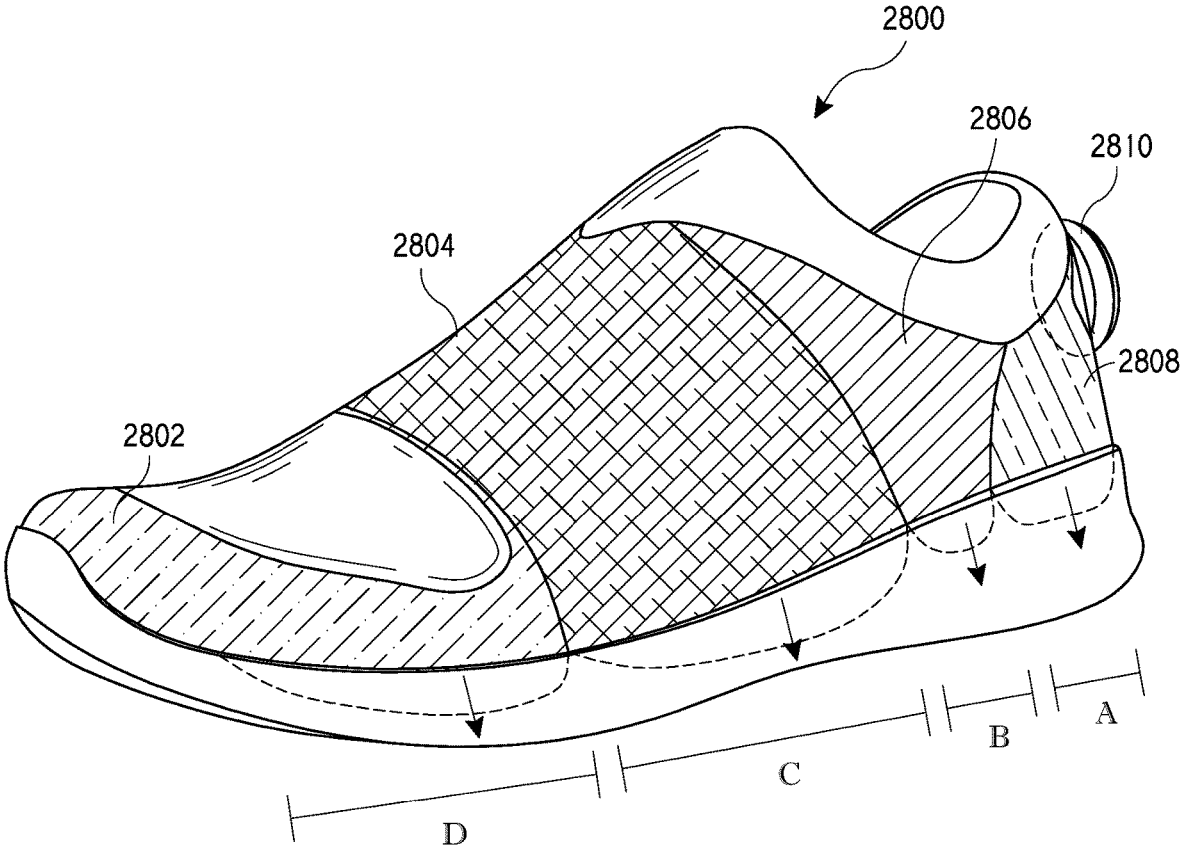
FIGS. 28A-C illustrate a shoe that is knitted or woven in a manner that results in different portions of the shoe bending, flexing, or moving in response to tensioning of a tension member.
Figure 28B:
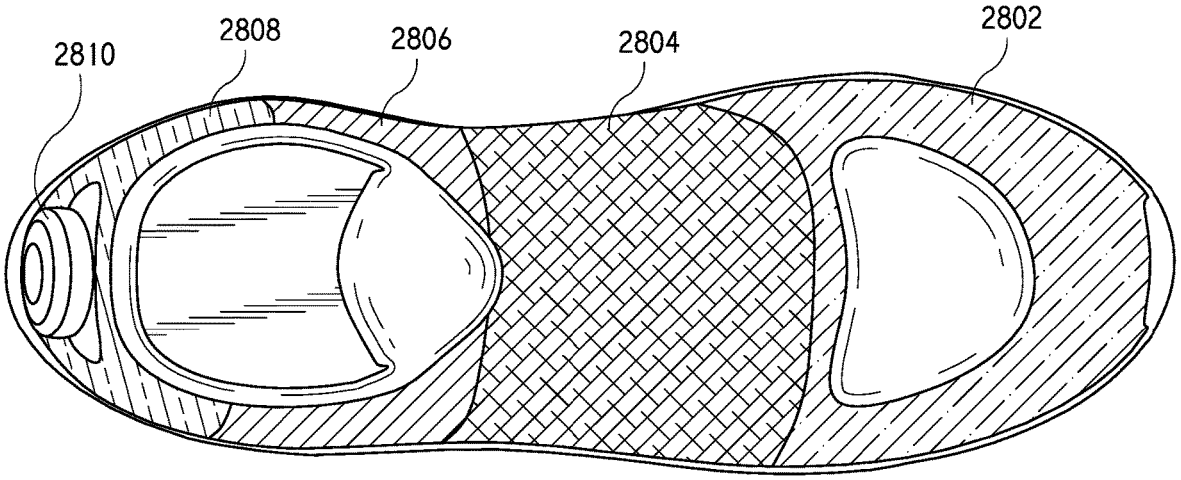
Figure 28C:
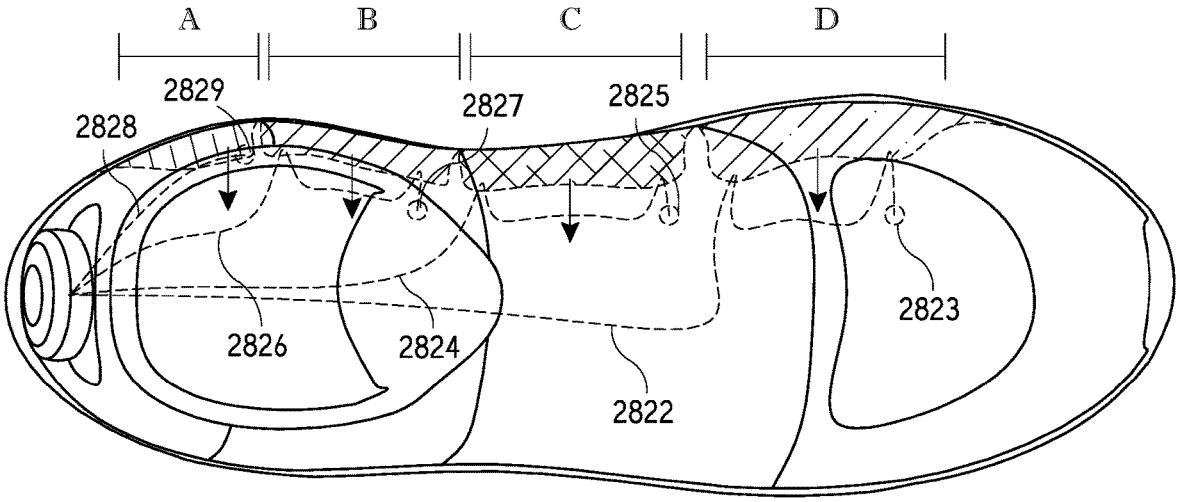

Referring now to FIGS. 28A-C, illustrated is a shoe 2800 or other footwear that is knitted or woven in a manner that results in different portions of the shoe bending, flexing, or moving in differing and unique ways in response to tensioning of a tension member. Specifically, the shoe 2800 includes a first knitted or woven section 2802, a second knitted or woven section 2804, a third knitted or woven section 2806, and a fourth knitted or woven section 2808. In other instances, the shoe 2800 may include more or fewer knitted or woven sections as desired. Each of the knitted or woven sections, 2802-2808, is knitted or woven in a manner so that the stretch, bend, or flex of the knitted or woven material in the respective sections responds to tensioning in a desired and engineered manner. For example, since the first knitted or woven section 2802 is adjacent the toe box, it may be desired to knit or weave the first knitted section 2802 so that a section or zone D of the shoe 2800 is able to experience or achieve a greater amount of flexibility or stretch when tensioned in comparison with the other sections or zones of the shoe 2800. This may allow the toes to move relatively freely and comfortably even when the shoe 2800 is tightened around a user's foot. In contrast, since the third or fourth knitted or woven sections, 2806 and/or 2808, are adjacent the heel, it may be desirable to knit or weave these sections so that the respective sections or zones, B and/or A, experience or achieve less stretch or flexibility and more support when tensioned. Similarly, the second knitted or woven section 2804 may be knit or woven so that as the material is tensioned the section or zone C is pulled into greater contact with the instep and/or arch of the foot. This may provide additional support to the foot and/or a greater sense of comfort and/or increased feeling when wearing the shoe 2800.

The increased support may ensure that the shoe 2800 stays firmly and securely coupled to the user's foot without being uncomfortable. The support and/or comfort that is provided in one or more of these sections may be engineered based on an activity that is being performed, such as participating in a sporting event (e.g., basketball, soccer, track & field, etc.), engaging in an outdoor activity (e.g., hiking, backpacking, cycling, running, etc.), and the like. The knit or weave in each section, 2802-2808, may cause the individual sections to uniquely bend, flex, stretch or move to achieve the desired fit. For example, the second knitted or woven section 2804 may be knit or woven so that in response to tensioning of the material, the section or zone C is pulled inward about the shoe, which would increase the contact of the shoe 2800 with the foot. The first knitted or woven section 2802 may flatten or widen somewhat in response to tensioning of the material so that the toes are not bunched together within the shoe and are able to assume a more natural position in relation to the foot. The fourth knitted or woven section 2808 and the third knitted or wove section 2806 may be constructed so that the material in the section or zone A bends, flexes, stretches, or moves forward toward the toe box while the material in the section or zone B bends, flexes, stretches, or moves backward toward the heel, which may secure the ankle and heel tightly within the shoe 2800. The material of one or both of these zones or sections (i.e., A or B) may likewise be engineered to provide increased support to the ankle when tensioned.

Figure 34A:
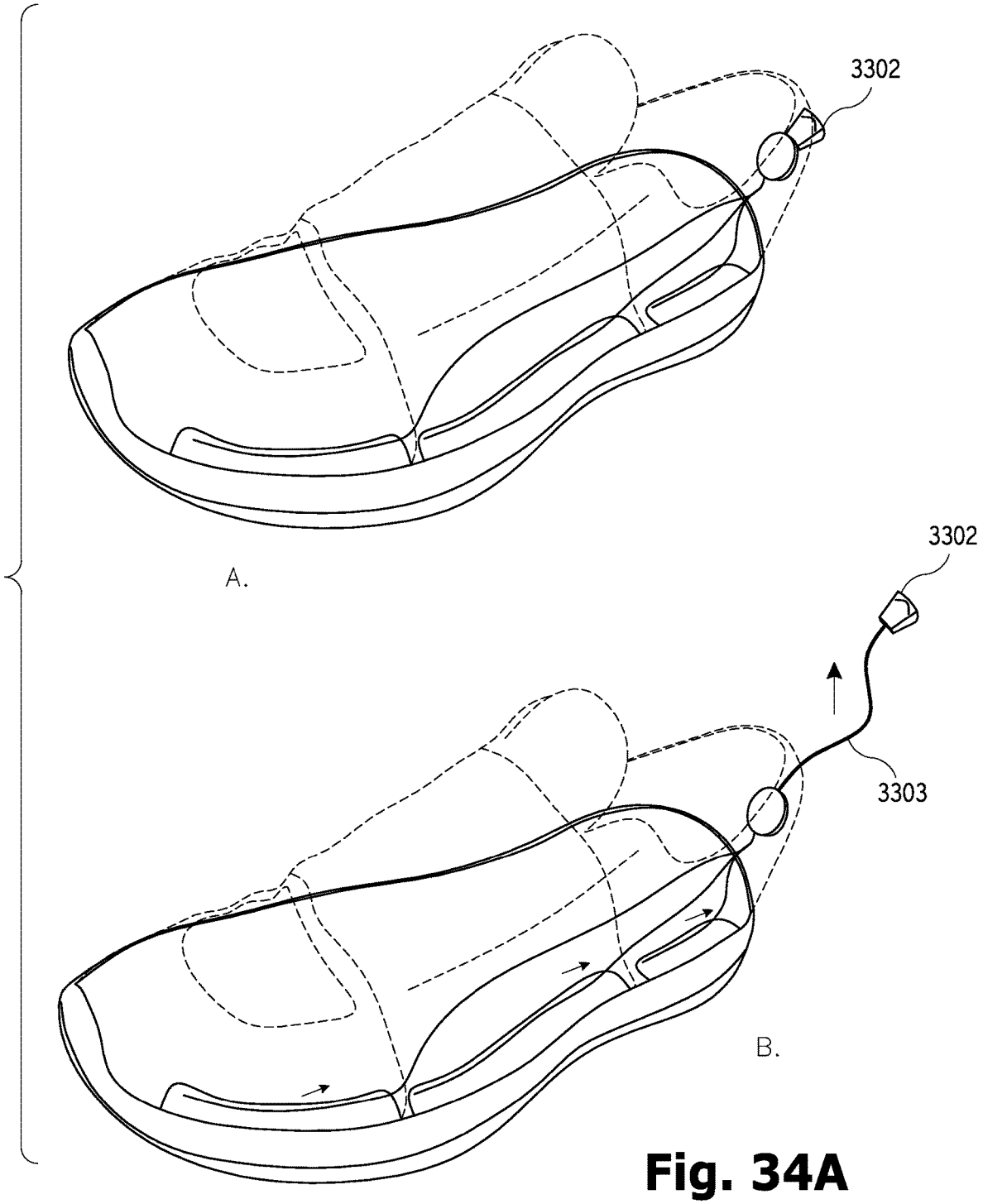
FIGS. 34A-B illustrate alternative tightening mechanisms that may be employed to tension a tension member.
Figure 34B:
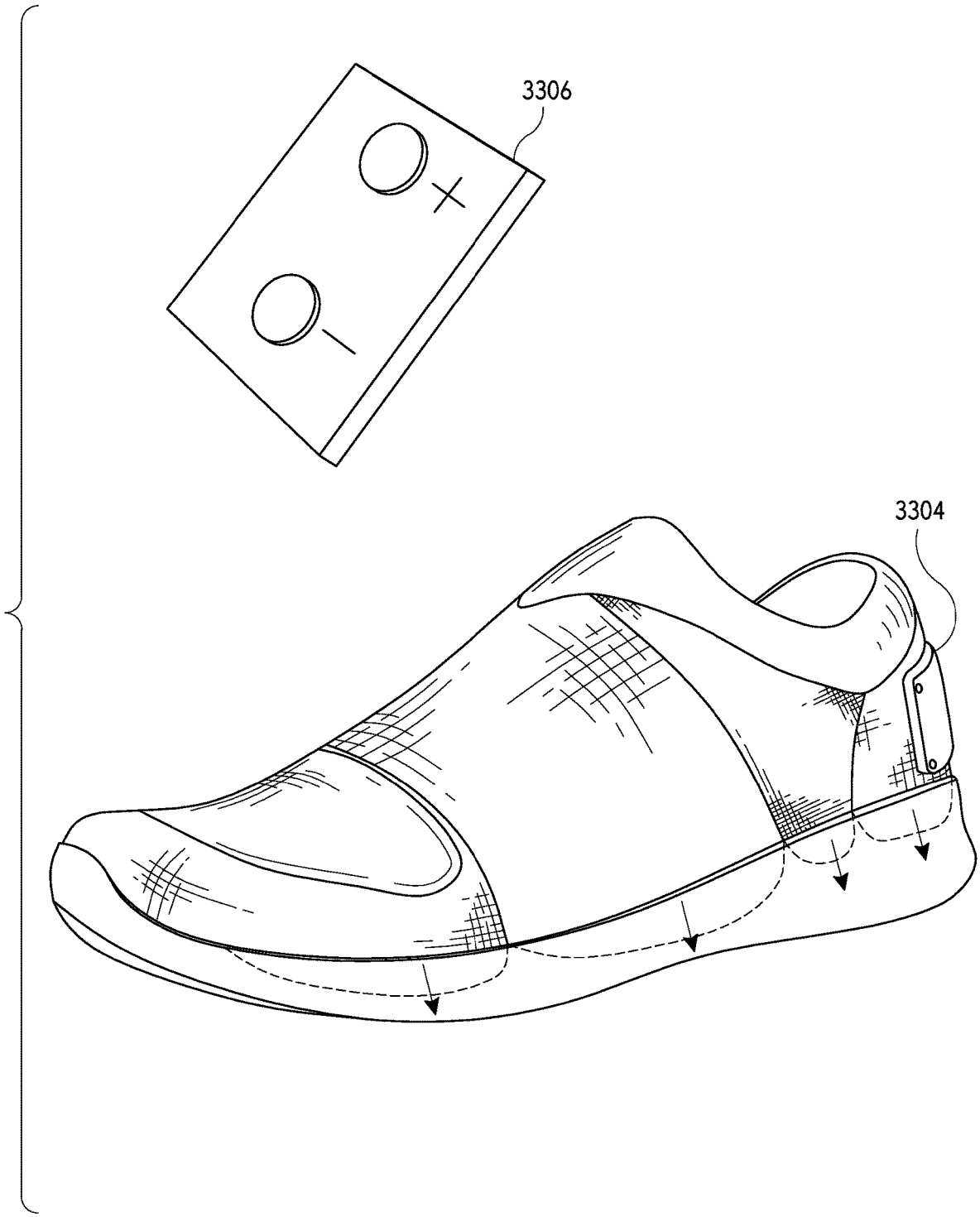

The individual knitted or woven sections, 2802-2808, are each operationally coupled with a tightening device or mechanism, which in a preferred embodiment is a reel based device 2810, although other tightening mechanisms, such as those illustrated in FIGS. 34A-B, may alternatively be employed to tension the individual knitted or woven sections, 2802-2808. In some embodiments, the reel based device 2810 is coupled with the individual knitted or woven sections, 2802-2808, in a manner that allows the individual knitted or woven sections to be relatively independently tensioned. For example, as illustrated in FIG. 28C, the individual knitted sections, 2802-2808, may be independently coupled with the reel based device 2810 so that operation of the reel based device 2810 independently, and more commonly differentially, tensions the respective sections. Specifically, the first knitted or woven section 2802 is coupled with the reel based device 2810 via a first tension member or lace 2822. The second knitted or woven section 2804 is coupled with the reel based device 2810 via a second tension member or lace 2824 while the third knitted or woven section 2806 and the fourth knitted section 2808 are each coupled with the reel based device 2810 via a third tension member or lace 2826 and a fourth tension member or lace 2828, respectively. The first, second, third, and fourth tension members, 2822-2828, are independent from one another and are directly coupled with the reel based device 2810. Operation of the reel based device 2810 causes the independent tension members, 2822-2828, to be tensioned, which independently tensions the respective knitted sections, 2802-2808. In turn, the respective knitted or woven sections, 2802-2808, are knitted or woven in a manner so that tensioning of the respective sections causes a different fit, tension, or support to be provided to the underlying foot.

In the illustrated embodiment of FIG. 28C, each of the independent tension members, 2822-2828, has a distal end that terminates or is fixedly secured to the shoe 2800. For example, the first tension member or lace 2822 has a distal end 2823 that is fixed to the shoe 2800 while the second tension member or lace 2824, the third tension member or lace 2826, and the fourth tension member or lace 2828 each have a respective distal end (i.e., 2825, 2827, and 2829) that are fixed to the shoe 2800. The respective tension members, 2822-2828, may be looped or secured with one or more portions of the knitted or woven sections, 2802-2808, to attached to respective tension member to a respective knitted or woven section. FIGS. 33A-E illustrate various means in which a tension member may be attached to a knitted or woven section.

Figure 29A:
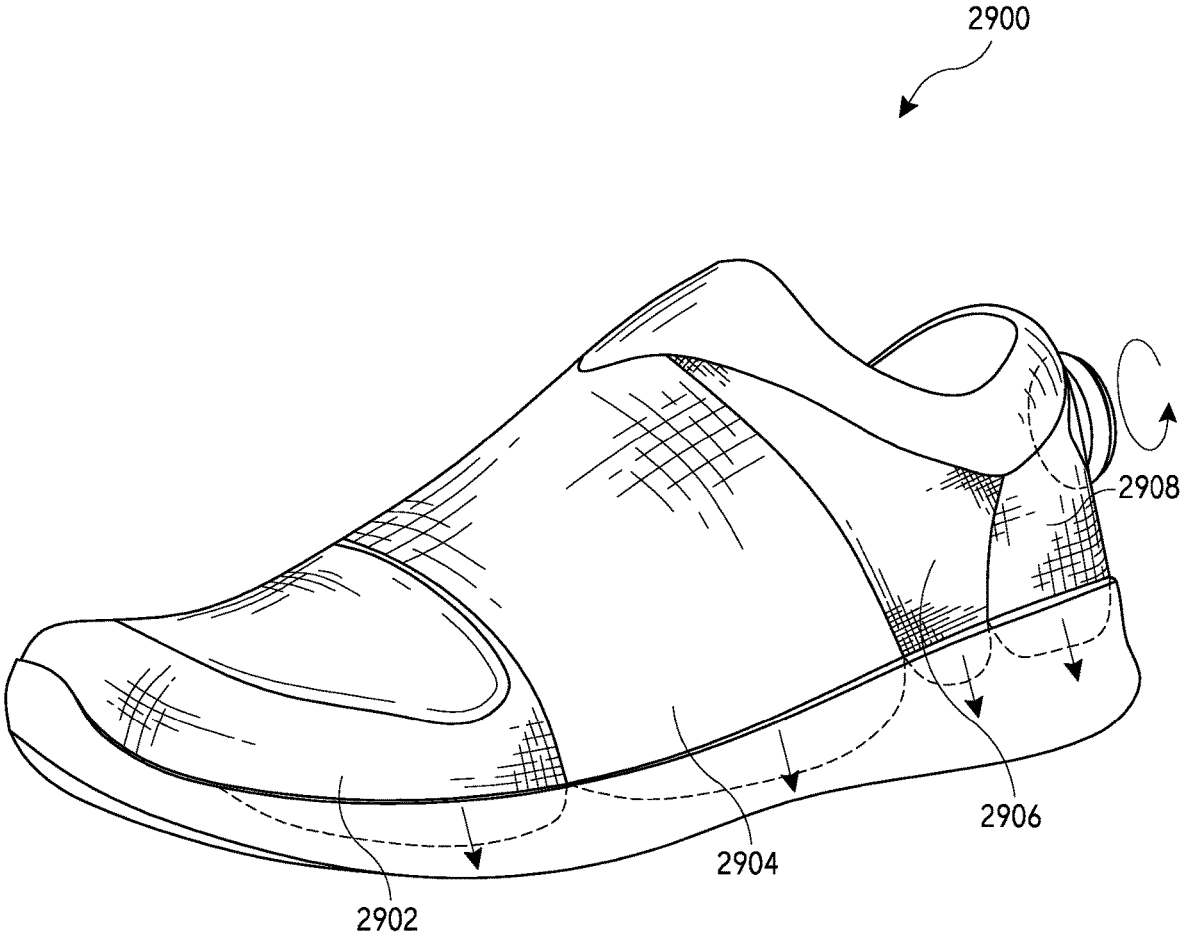
FIGS. 29A-B illustrate embodiments of knitted or woven sections of a shoe that may be employed to achieve a desired and conforming fit of the shoe.
Figure 29B:
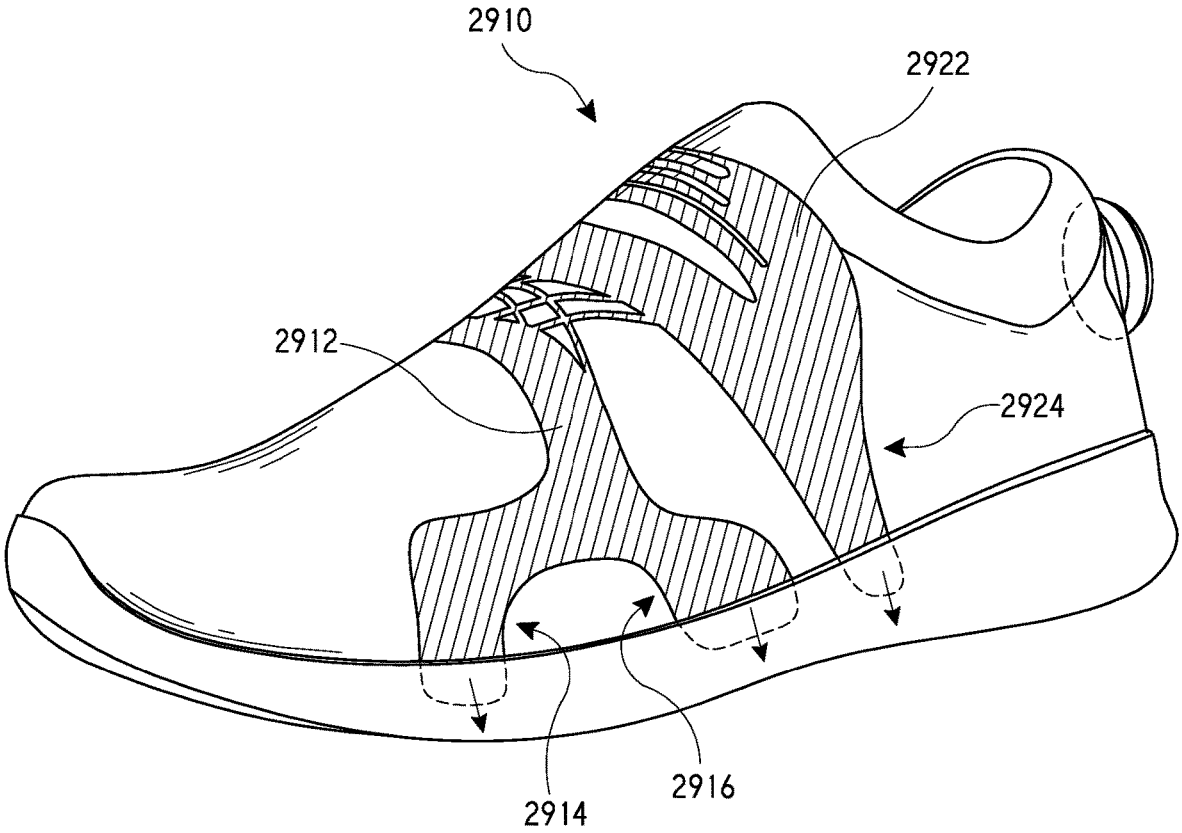

Referring now to FIGS. 29A-B, illustrated are other embodiments of sections that may be used to achieve a desired and conforming fit of a shoe. In FIG. 29A, a shoe 2900 may include multiple sections or zones, 2902-2908, that are configured to uniquely and differentially stretch, bend, flex, or otherwise move in response to tensioning of said sections or zones. The illustrated sections or zones, 2902-2908, are similar to those of FIG. 28A, but the material that is employed within the sections or zones, 2902-2908, may be different than the knitted or woven material of FIG. 28A. For example, an elastic or stretchable material as known in the art may be used and may be oriented or arranged about the shoe 2900 so that a desired stretching, bending, or movement of the material is achieved when the material is tensioned. The orientation and/or arrangement of the sections or zones, 2902-2908, may be engineered to provide a desired degree of support and/or comfort when the shoe 2900 is tensioned.

FIG. 29B illustrates an embodiment of a shoe 2910 in which only a portion of the shoe 2910 includes a material that is designed to bend, flex, stretch, or move in response to tensioning of the material. The material may be oriented or arranged about a portion or section of the shoe in which an engineered fit is desired in response to tensioning of the material. For example, the material may be arranged about the instep of the shoe 2910 to provide an increased contact between the shoe 2910 and the foot, such as pulling the medial side of the shoe's upper into engagement with the arch of the foot. In other embodiments, the material may be arranged around the collar of the shoe 2910 to provide an increased constriction of the collar about the ankle. The material may include a knitted or woven material, an elastic non-knitted or woven material, other materials, or some combination thereof.

In the illustrated embodiment, the shoe 2910 includes a first section 2912 that is positioned near an upper end of the toe box and a second section 2922 that is positioned near the shoe's collar. The first section 2912 and the second section 2922 both extend over the throat or instep of the shoe 2910 to the sole, although in some embodiments either or both the first section 2912 or the second section 2922 may terminate short of the sole. In the illustrated embodiment, the first section 2912 and the second section 2922 both extend into the sole of the shoe. The first section 2912 and/or the second section 2922 may extend into the sole on the lateral side and/or medial side as desired. The second section 2922 includes a tapered or narrow section 2924 near the sole, which may focus the tension and/or conformance of the shoe in this region. The tapered or narrow section 2924 is operationally coupled with a tension member (not shown). In contrast, the first section 2912 widens and includes a first finger or projection 2914 and a second finger or projection 2916 near the shoe's sole. The widened section may distribute the tension and/or conformance of the shoe across a wider area. The first finger or projection 2914 and/or the second finger or projection 2916 may be operationally attached to a tension member (not shown) as desired. In some embodiments, the arrangement of the narrow and wide sections may be reversed from that illustrated in FIG. 29B. The first section 2912 and/or the second section 2922 may be loosely attached or coupled together as illustrated, or may be entirely detached from one another.

Referring now to FIGS. 30A-31D, illustrated are various means in which a material section may be attached to a reel based device. The term "material section" as used in relation to FIGS. 30A-31D refers to the end of the knitted or woven sections, elastic sections, etc. described above and illustrated in FIGS. 28A-29B. In some embodiments, the material section may be attached to a tension member that is directly coupled with the reel based device whereas in other embodiments the material section may be attached to a tension member that is indirectly coupled with the reel based device. The illustrated attachment means may be employed for any embodiment described herein in which the reel based device is employed to simultaneously tension multiple sections or portions of the shoe. In most of the embodiments, a distal end of the material section is positioned within the sole of the shoe and the tension member is attached or coupled with the material section within the shoe's sole. The tension member is likewise typically routed to the reel based device within the sole of the shoe and thus, the distal end of the material section and the tension member are typically hidden from external view. In other embodiments, however, the distal end of the material section and/or the tension member may be positioned and/or routed in a location other than within the shoe's sole.

Figure 30A:
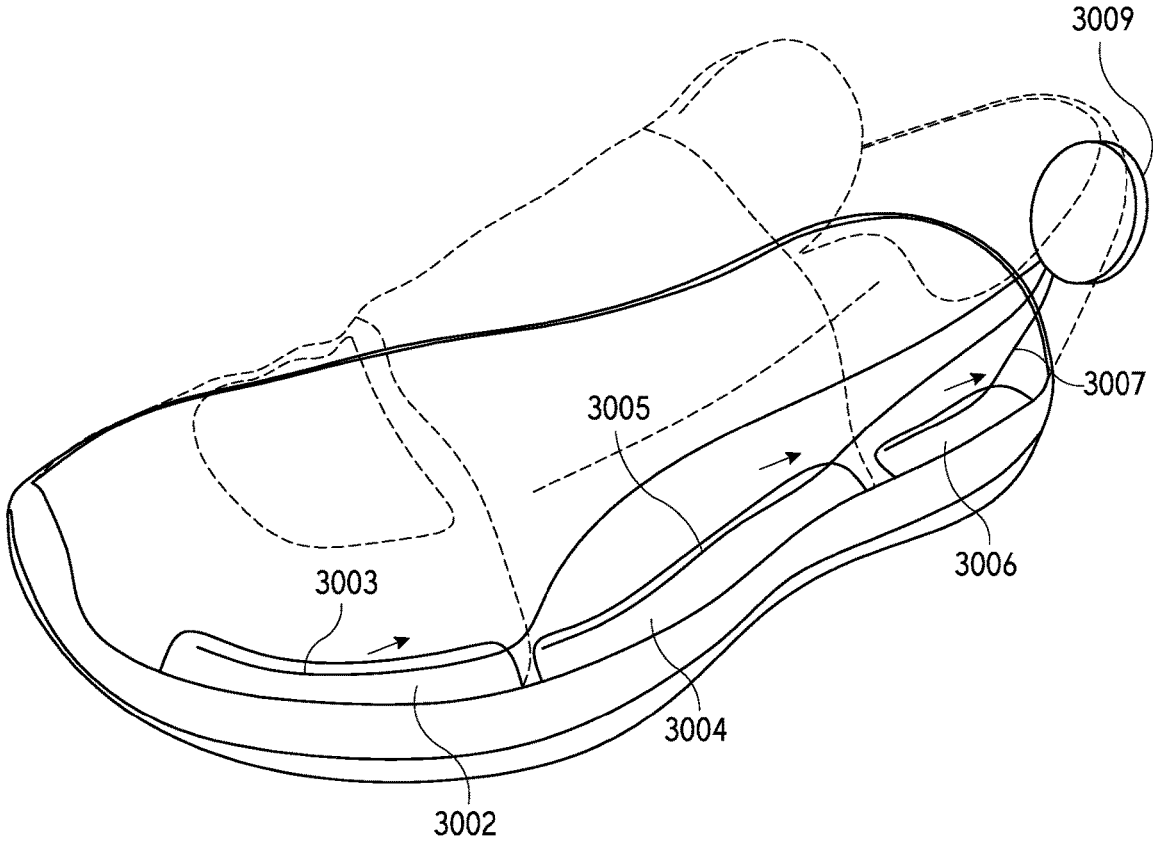
FIGS. 30A-D illustrate various methods of attaching a knitted or woven section of material to a reel based tensioning device.

In FIG. 30A, a first material section 3002 is attached to a first tension member 3003 while a second material section 3004 is attached to a second tension member 3005 and a third material section 3006 is attached to a third tension member 3007. Each of the tension members (3003, 3005, and 3007) is routed to a reel based device 3009 and directly attached thereto. Accordingly, operation of the reel based device 3009 simultaneously and directly tensions each of the tension members (3003, 3005, and 3007), which in turn directly tensions the respective material sections (3002, 3004, and 3006). In this manner, operation of the reel based device 3009 directly tensions the respective material sections.

Figure 30B:
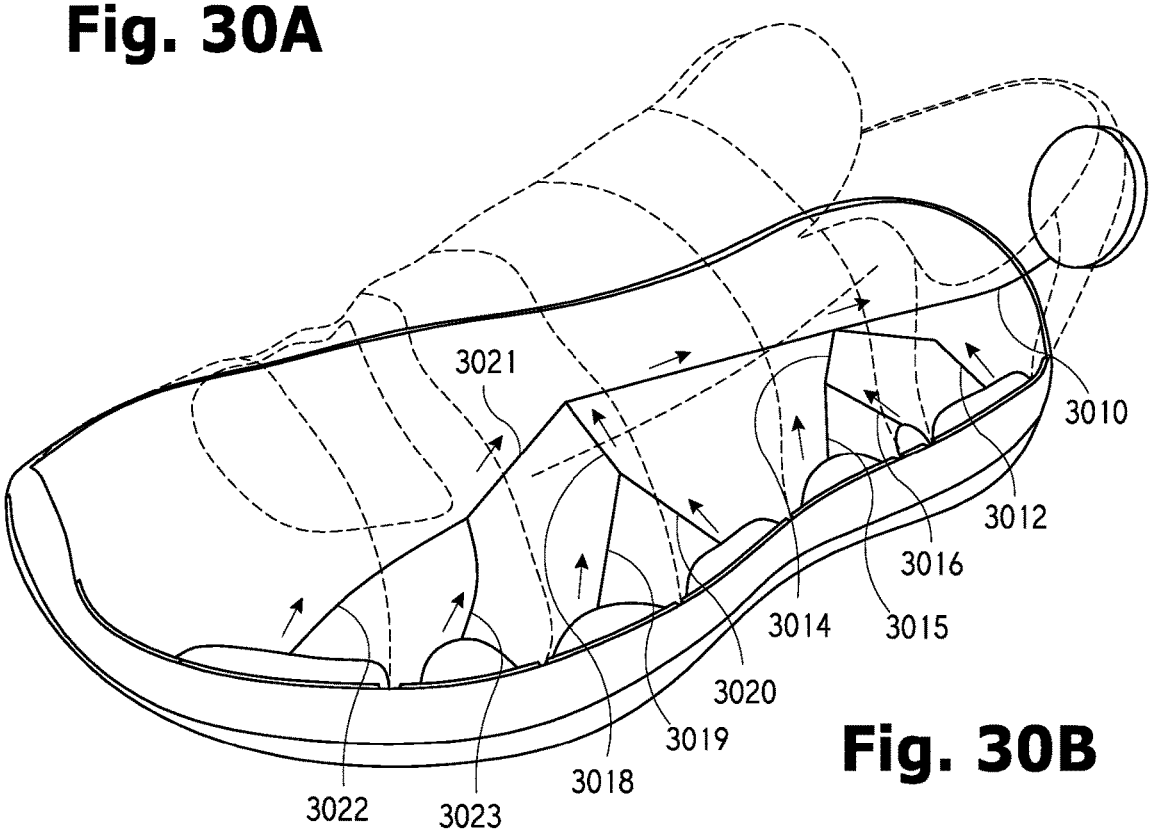

In FIG. 30B, a single tension member 3010 is employed to tension each of the material sections. The single tension member 3010 is operationally coupled with the reel based device and with each of the material sections of the shoe. To attach the single tension member 3010 with each of the material sections, the tension member 3010 branches off into smaller sub-sections that are routed to the respective material sections. For example, as illustrated in FIG. 30B, the single tension member 3010 branches off into a first sub-section 3012, a second sub-section 3014, a third sub-section 3018, and a fourth sub-section 3021, although more or fewer sub-sections may be employed as desired. The first sub-section 3012 is routed and attached to a material section as illustrated while the second sub-section 3014, third sub-section 3018, and fourth sub-section 3021 are each further branched or divided into secondary sub-sections. Specifically, the second sub-section 3014 is further divided or branched into secondary sub-section 3015 and secondary sub-section 3016, which are each routed and attached to a material section as illustrated. The third sub-section 3018 is further divided or branched into secondary sub-section 3019 and secondary sub-section 3020, which are each routed and attached to a material section as illustrated, and the fourth sub-section 3021 is further divided or branched into secondary sub-section 3022 and secondary sub-section 3023, which are each routed and attached to a material section as illustrated. In some instances, the secondary sub-sections may be further divided or branched into tertiary sub-sections, which are routed and attached to material sections or further divided and branched as needed. In some embodiments, the single tension member 3010 may include a bundle of tension members that are each partitioned or separated to form the various sub-sections, secondary sub-sections, tertiary sub-sections, and the like. The divided or branched tension member allows a single tension member 3010 to be attached to the reel based device and employed to simultaneously tension each material section. This configuration may render it more feasible to attach the various material sections by minimizing or preventing issues associated with multiple tension members being attached to the reel based device, such as tangling of the various tension members.

Figure 30C:
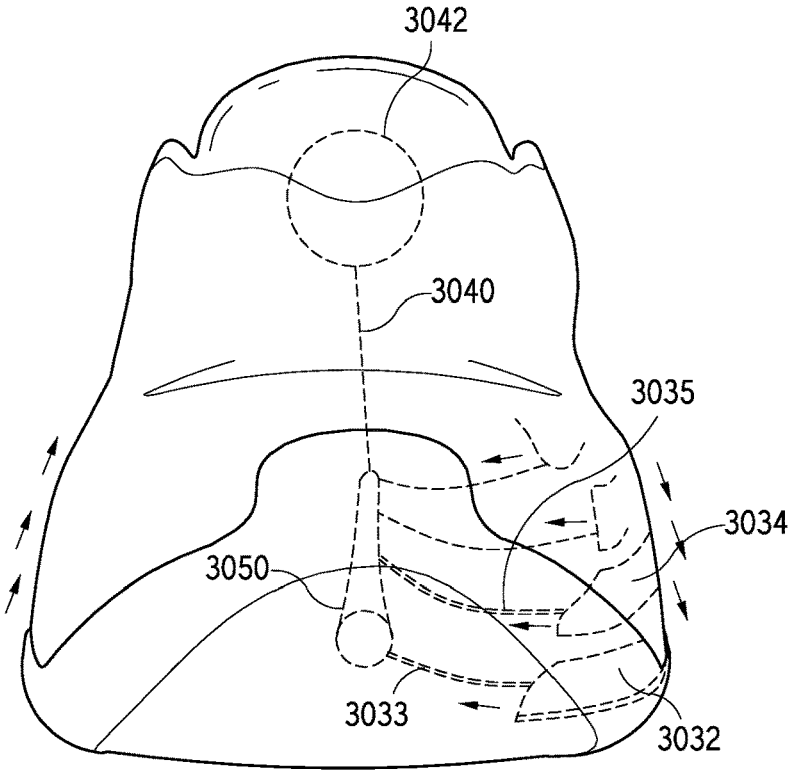
Figure 30D:
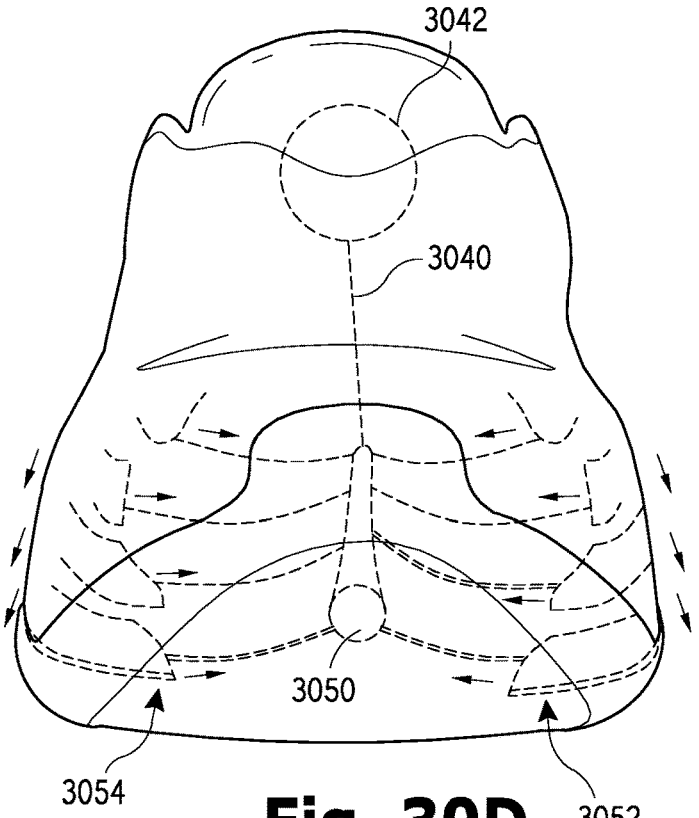

FIGS. 30C-30D illustrate embodiments in which a material section is indirectly attached to a reel based device. In FIG. 30C, each material section (e.g., 3032, 3034, etc.) is attached to a respective tension member (e.g., 3033, 3035, etc.), which connects to a centrally positioned tensioning rod or member 3050. The tension tensioning rod/member 3050 is in turn attached to a second tension member 3040 that is operationally attached to a reel based device 3042. The tensioning rod/member 3050 is positioned within the sole of the shoe so that as the second tension member 3040 is tensioned via the reel based device 3042, the tensioning rod/member 3050 slides toward the heel of the shoe, which causes the tension members (e.g., 3033, 3035, etc.) to tension the respective material sections (3032, 3034, etc.) to which they are attached. The tension members (e.g., 3033, 3035, etc.) tension the respective material sections (3032, 3034, etc.) by pulling the material sections inward toward the tensioning rod/member 3050. In this manner, the material sections (3032, 3034, etc.) are indirectly tensioned by the reel based device 3042 due to sliding of the tensioning rod/member 3050 within the sole of the shoe. FIG. 30C illustrates an embodiment in which only a single side of the shoe includes material sections that are operationally attached to the tensioning rod/member 3050. FIG. 30D illustrates an embodiment in which both sides of the shoe (e.g., 3052 and 3054) include material sections that are operationally attached to the tensioning rod/member 3050. The coupling of both sides of the shoe to the tensioning rod/member 3050 as illustrated in FIG. 30D may balance forces that are exerted on the tensioning rod/member 3050, which may render the configuration more feasible.

Figure 31A:
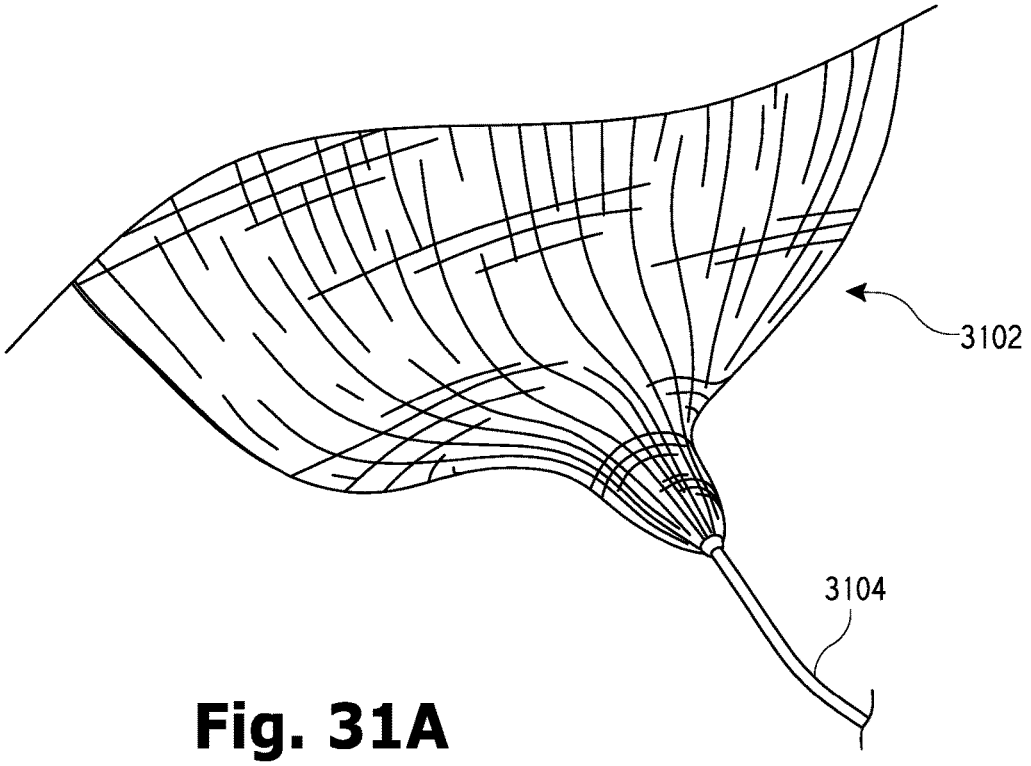
FIGS. 31A-D illustrate various methods of attaching a knitted or woven section of material to a tension member and/or reel based tensioning device.

FIG. 31A illustrates one embodiment of coupling or attaching a material section 3102 with a tension member 3104. In the illustrated embodiment, the material section 3102 is formed of various individual fibers or threads, which is common when the material section 3102 is constructed of a knitted or woven material. The individual fibers or threads that form the material section 3102 are bundle, woven, or threaded together to form the tension member 3104. Thus, the tension member 3104 is not a separate and distinct component that is attached to the material section 3102, but is instead formed from the same fibers or threads of the material section 3102 so that the material section 3102 and tension member 3104 are integral or different forms of the same material. Stated differently, the tension member 3104 is a cord or rope like material and the material section 3102 is the unwoven or unthreaded fibers or yarns of the tension member 3104. Coupling the material section 3102 and tension member 3104 in this manner may eliminate or minimize breakage between the material section 3102 and tension member 3104 and/or increase the responsiveness of the material section 3102 due to tensioning of the tension member 3102.

Figure 31B:
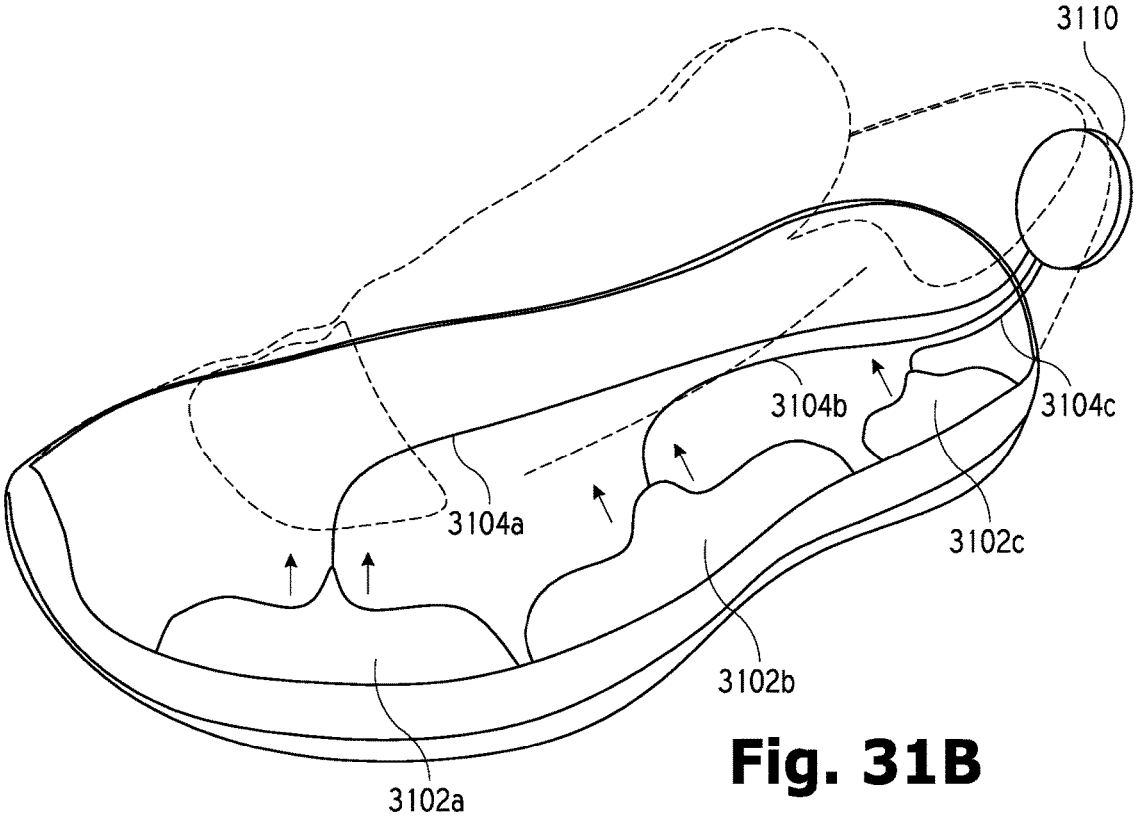
Figure 31C:
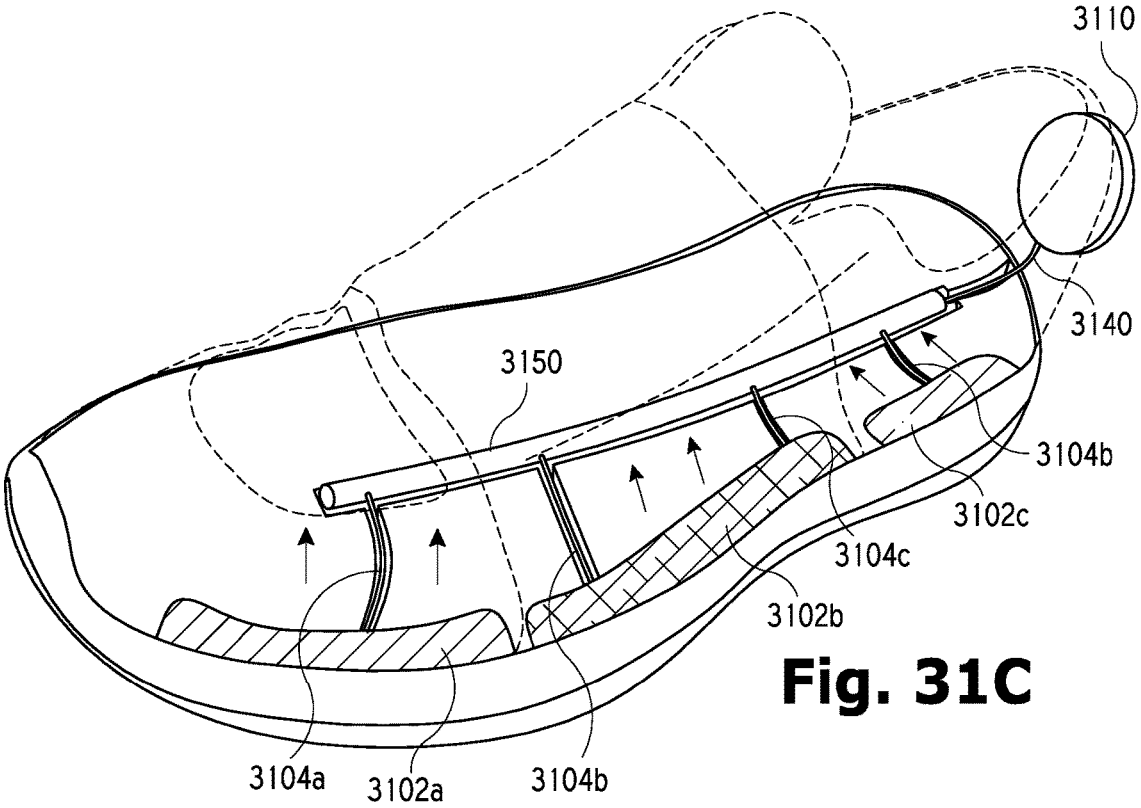
Figure 31D:
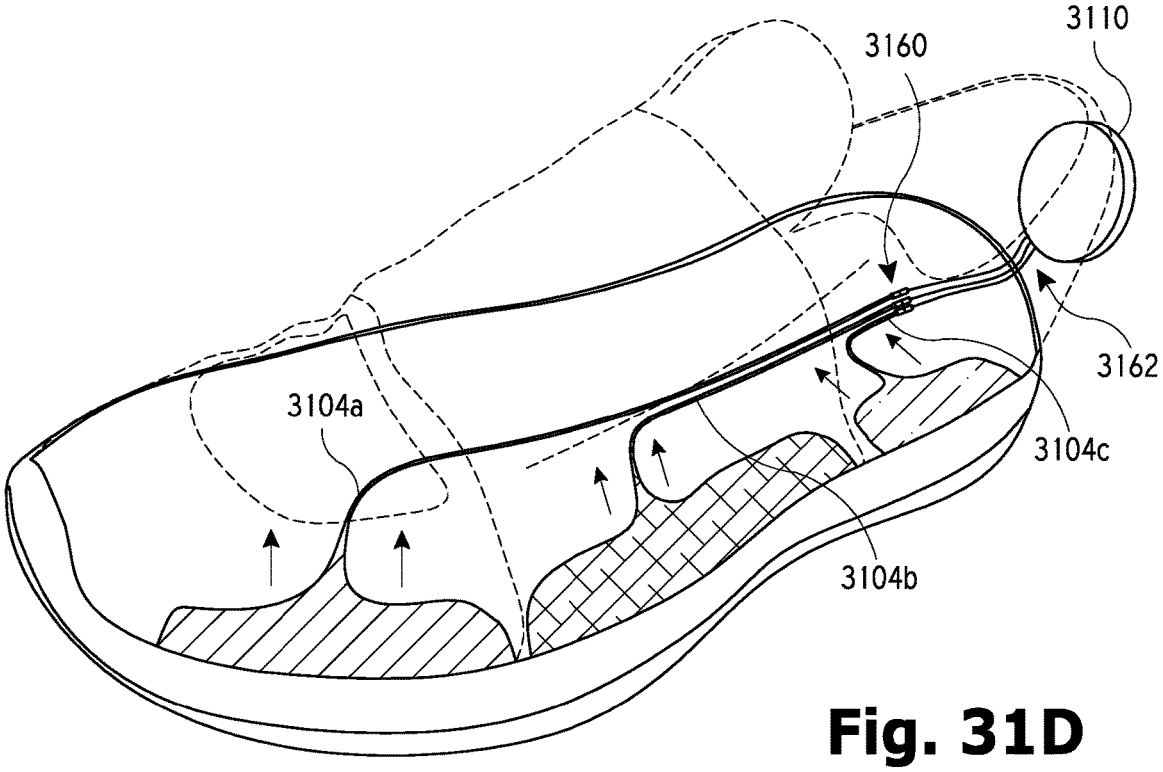

FIGS. 31B-31D illustrate various means in which the material section 3102 and tension member 3104 may be operationally coupled with a reel based device 3110. In FIG. 31B multiple tension members (i.e., 3104*a*, 3104*b*, and 3104*c*) that are each individually attached to respective material sections (i.e., 3102*a*, 3102*b*, and 3102*c*) are directly coupled with the reel based device 3110. As such, operation of the reel based device simultaneously and directly tensions each of the tension members (i.e., 3104*a*, 3104*b*, and 3104*c*), which in turn tensions the respective material sections (i.e., 3102*a*, 3102*b*, and 3102*c*). In FIG. 31C, the multiple tension members (i.e., 3104*a*, 3104*b*, 3104*c*, and 3104*d*) are each directly attached to a tension rod/member 3150, which is in turn operationally coupled with the reel based device 3110 via a second tension member 3140. As such, the respective material sections (i.e., 3102*a*, 3102*b*, and 3102*c*) are indirectly tensioned by the reel based device 3110. A second material section 3102*b* is illustrated as being coupled with two tension members, 3104*b* and 3104*c*, which configuration may be employed in any of the embodiments as desired.

FIG. 31D illustrates an embodiment that is similar to FIG. 31B, except that the multiple tension members (i.e., 3104*a*, 3104*b*, and 3104*c*) are each individual coupled with secondary tension members 3162 via coupling components 3160. The coupling components 3160 may be ferrules, clamps, locks, or any other device or component that is useful for attached a cord, cable, thread, rope, or yarn to another cord, cable, thread, rope, or yarn. The secondary tension members 3162 are in turn attached to the reel based device 3110. The use of the secondary tension members 3162 may allow thicker tension members (i.e., 3104*a*, 3104*b*, and 3104*c*) to be used without requiring the thicker tension members (i.e., 3104*a*, 3104*b*, and 3104*c*) to be directly attached to the reel based device 3110. Rather, the thinner secondary tension members 3162 are attached to the reel based device 3110, which may facilitate in coupling of the tension members (i.e., 3104*a*, 3104*b*, and 3104*c*) with the reel based device 3110 easier and/or facilitate in operation of the reel based device 3110. In some embodiment, the coupling component(s) 3160 may attach the tension members (i.e., 3104*a*, 3104*b*, and 3104*c*) to a single secondary tension member 3162.

Figure 32:
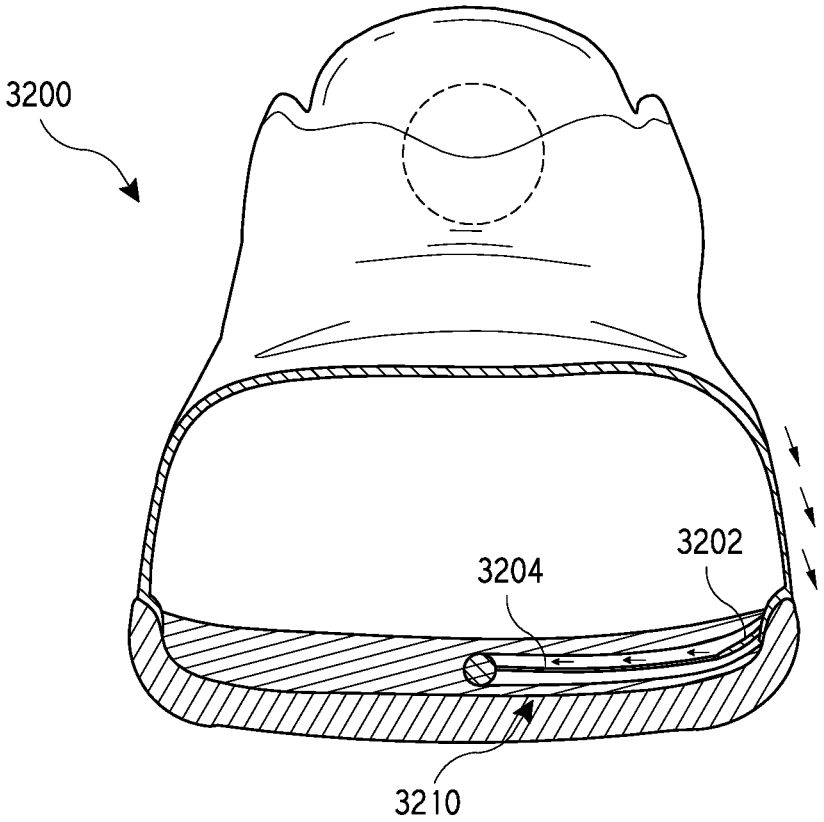
FIG. 32 illustrates a front cross section of a shoe, in which a distal end of a knitted or woven material section and a tension member are disposed within a sole of the shoe.

Referring now to FIG. 32, illustrated is a front cross section of a shoe 3200, which shows a distal end of a material section 3202 and tension member 3204 disposed within a sole of the shoe 3200. Specifically, the material section 3202 and tension member 3204 are positioned within a channel 3210 that is formed in the sole of the shoe 3200. The material section 3202 and tension member 3204 are able to slide or move within the channel 3210, which allows the material section 3202, both within the channel 3210 and exterior to the sole, to be tensioned in response to tensioning of the tension member 3202. As described herein, the tension member 3202 may be directly attached to a reel based device or indirectly attached to the reel based device via some intermediate component, such as the tension rod/member.

Figure 33A:
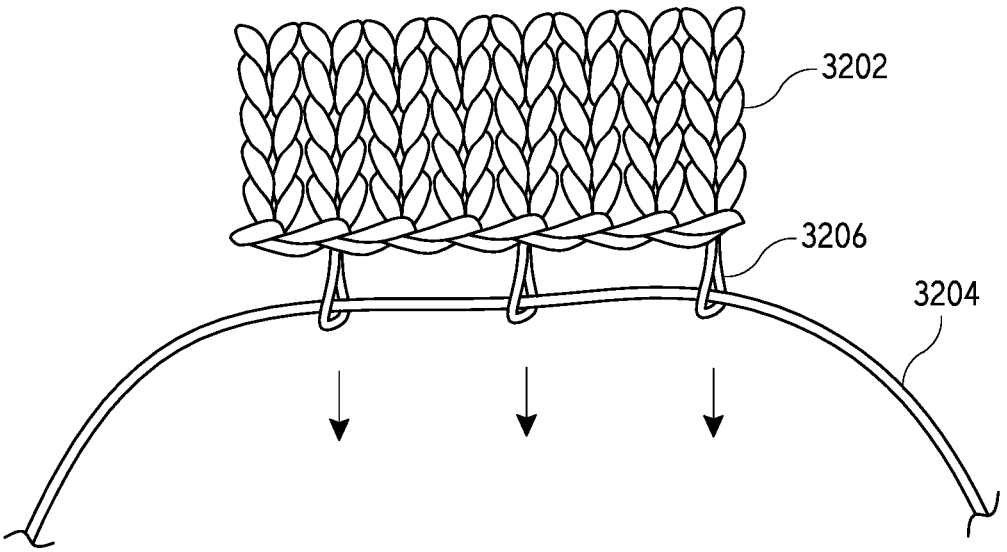
FIGS. 33A-E illustrate various embodiments of attaching a knitted or woven material section to a tension member.
Figure 33B:
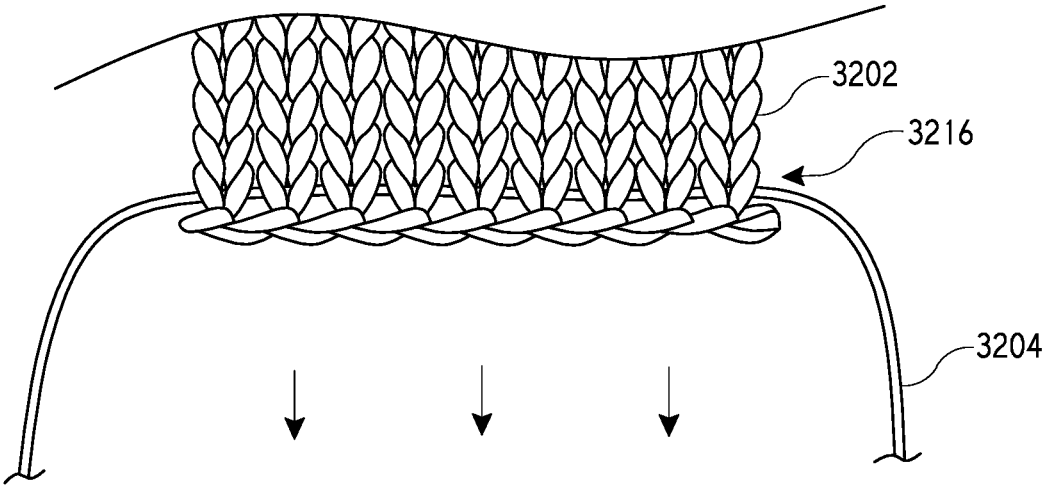
Figure 33C:
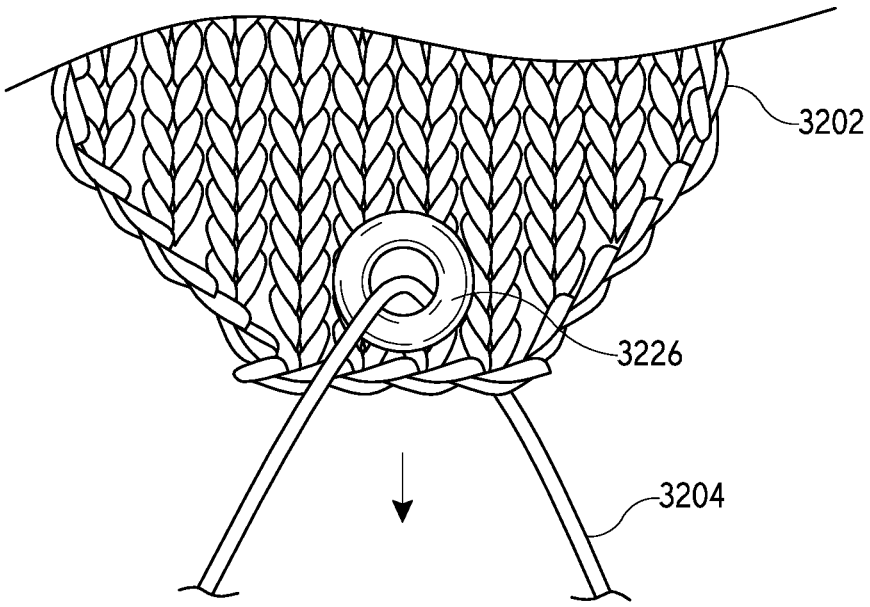
Figure 33D:
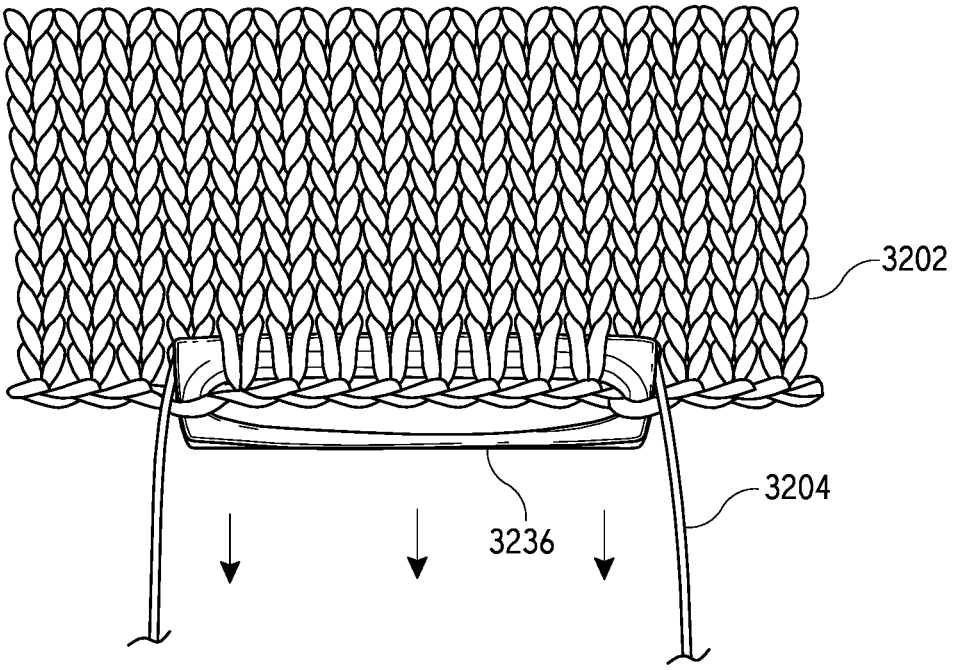
Figure 33E:
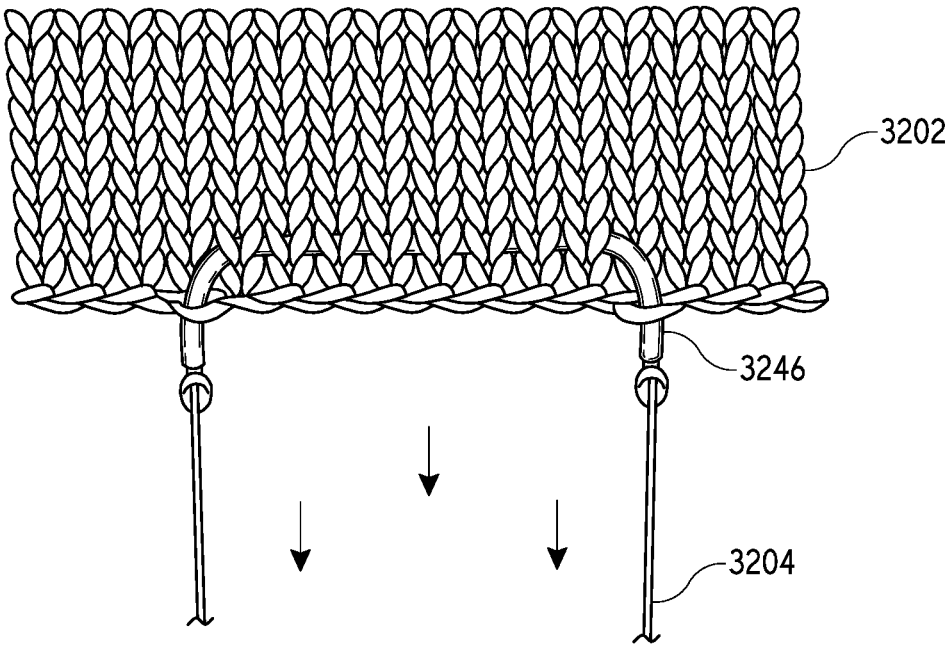

Referring now to FIGS. 33A-E, illustrated are various embodiments that may be employed to attach a material section to a tension member. In FIG. 33A, the multiple looped ends 3206 are knitted, woven, or otherwise formed in the distal end of the material section 3202. The tension member 3204 is inserted through the looped ends 3206, which causes the material section 3202 to be tensioned in response to tensioning of the tension member 3204. In FIG. 33B, the tension member 3204 is inserted directly through the distal end of the material section 3202. The tension member 3204 may be woven or routed through the distal end of the material section 3202 and/or the material section 3202 may have multiple layers and the tension member 3204 may be inserted between the multiple layers. In FIG. 33C, a grommet 3226 is positioned in the distal end of the material section 3202. The tension member 3204 is inserted through an aperture within the grommet 3226. In FIG. 33D, a guide component 3236, similar to those currently employed to guide or direct a tension member about a shoe, is woven, knitted, or otherwise positioned within the distal end of the material section 3202. The tension member 3204 is inserted through the guide component 3236. In FIG. 33E, a tubing section 3246 is woven, knitted, or otherwise positioned within the distal end of the material section 3202. The tension member 3204 is inserted through the channel or lumen of the tubing section 3246.

FIGS. 34A-B illustrate alternative tightening mechanisms that may be employed to tension a tension member 3303, which in turn tensions the respective material sections as described herein. The alternative tightening mechanisms replace the reel based device as the source of tensioning the tension member. The configuration of the material sections and/or the means in which the material sections are attached to the tightening mechanism may remain the same as any of the embodiments described herein. In FIG. 34A, a pullcord member 3302 is coupled with the tension member 3303. The pullcord member 3302 may be pulled by a user to tension the tension member 3303. In FIG. 34B, a motorized unit 3304 is attached to the shoe and to the tension member (not shown). The motorized unit 3304 is configured to tension the tension member. A control device 3306 may be used to actuate or operate the motorized unit 3304.

While several embodiments and arrangements of various components are described herein, it should be understood that the various components and/or combination of components described in the various embodiments may be modified, rearranged, changed, adjusted, and the like. For example, the arrangement of components in any of the described embodiments may be adjusted or rearranged and/or the various described components may be employed in any of the embodiments in which they are not currently described or employed. As such, it should be realized that the various embodiments are not limited to the specific arrangement and/or component structures described herein.

In addition, it is to be understood that any workable combination of the features and elements disclosed herein is also considered to be disclosed. Additionally, any time a feature is not discussed with regard in an embodiment in this disclosure, a person of skill in the art is hereby put on notice that some embodiments of the invention may implicitly and specifically exclude such features, thereby providing support for negative claim limitations.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A tension member guide that is coupleable with footwear and that is configured to direct or route a tension member about a path of the footwear, the tension member guide comprising:

a material body having:

a proximal end;

a distal end; and at least one channel that extends between the proximal end and the distal end of the material body; and a reinforcement material that is disposed within the at least one channel of the material body to reinforce the material body;

wherein the material body is folded between the proximal end and the distal end to form a loop or channel within which the tension member is insertable, the material body having a center portion and two end portions that are disposed on opposite sides of the center portion;

wherein the material body is formed of a woven material; and wherein the reinforcement material comprises reinforcing fibers or fiber bundles.

2. The tension member guide of claim 1, wherein the material body includes a plurality of channels that extend between the proximal end and the distal end of the material body, and wherein the plurality of channels are separated or divided by walls between the two end portions of the material body.

3. The tension member guide of claim 2, wherein the reinforcement material is distributed among the plurality of channels so that channels that are positioned nearer to the center portion of the material body have a greater density of the reinforcement material than channels positioned nearer to, or at, the two end portions.

4. The tension member guide of claim 1, wherein an inner surface of the loop or channel of the folded material body comprises a low friction material.

5. The tension member guide of claim 4, wherein the low friction material is attached to the inner surface of the loop or channel of the folded material body.

6. A tension member guide comprising:

a material body; and a reinforcement material that is coupled with the material body to reinforce the material body;

wherein the material body is folded to form a loop or channel within which a tension member is insertable;

wherein an inner surface of the loop or channel of the folded material body comprises a low friction material; and wherein the material body is formed of a woven material.

7. The tension member guide of claim 6, wherein the material body includes a plurality of channels formed therein and wherein the reinforcement material is disposed within one or more channels of the plurality of channels to reinforce the material body.

8. The tension member guide of claim 7, wherein the reinforcement material is distributed among the plurality of channels so that a density of the reinforcement material within the plurality of channels is greater nearer to a center portion of the material body.

9. The tension member guide of claim 8, wherein the increased density of the reinforcement material near the center portion of the material body causes the tension member guide to exhibit an increased flexing or bowing toward opposing end portions of the material body in response to tensioning of the tension member.

10. The tension member guide of claim 6, wherein the reinforcement material comprises reinforcing fibers or fiber bundles.

11. The tension member guide of claim 6, wherein the low friction material is attached to the inner surface of the loop or channel of the folded material body.

12. A method of coupling a tension member guide with an article comprising:

providing a tension member guide that includes:

a material body having a channel formed therein; and a reinforcement material that is disposed within the channel of the material body to reinforce the material body;

wherein the material body is folded to form a loop or channel within which a tension member is insertable; and wherein the material body is formed of a woven material; and coupling the tension member guide with the article.

13. The method of claim 12, further comprising inserting the tension member within the loop or channel formed in the folded material body.

14. The method of claim 12, wherein the article is a shoe or footwear.

15. The method of claim 12, wherein the material body includes a plurality of channels.

16. The method of claim 15, wherein the reinforcement material is distributed among the plurality of channels so that a density of the reinforcement material within the plurality of channels is greater nearer to a center portion of the material body in comparison with opposing end portions of the material body.

* * * * *